US006340561B1

(12) United States Patent
Naruse et al.

(10) Patent No.: US 6,340,561 B1
(45) Date of Patent: Jan. 22, 2002

(54) HEAT DEVELOPABLE COLOR PHOTOSENSITIVE MATERIAL

(75) Inventors: Hideaki Naruse; Yuki Mizukawa, both of Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/675,437

(22) Filed: Sep. 29, 2000

(30) Foreign Application Priority Data

Sep. 29, 1999 (JP) ..... 11-275755

(51) Int. Cl.[7] ..... G03C 8/40; G03C 8/12

(52) U.S. Cl. ..... 430/503; 430/203; 430/226; 430/380

(58) Field of Search ..... 430/203, 226, 430/505, 380

(56) References Cited

U.S. PATENT DOCUMENTS 3,227,550 A * 1/1966 Whitemore et al. ..... 430/226
4,483,914 A 11/1984 Naito et al. ..... 430/203
4,740,445 A * 4/1988 Hirai et al. ..... 430/203
5,470,688 A * 11/1995 Texter et al. ..... 430/226
5,976,756 A 11/1999 Nakamura et al. ..... 430/203
6,114,080 A * 9/2000 Texter et al. ..... 430/226

FOREIGN PATENT DOCUMENTS

JP 9-152705 * 6/1997

* cited by examiner

*Primary Examiner*—Richard L. Schilling
(74) *Attorney, Agent, or Firm*—Birch, Stewart, Kolasch & Birch, LLP

(57) ABSTRACT

Disclosed is a heat developable color photosensitive material, said material comprising a support having disposed thereon a photosensitive layer including at least two layers, any one of the layers containing a photosensitive silver halide, a binder, and an incorporated color developing agent, one layer containing a substantially colorless coupler which forms a diffusive dye by coupling with the oxidized form of the incorporated developing agent, another layer containing a compound represented by the general formula (1). In the color photosensitive material for heat development, the hue of the diffusive dye, which is formed by the coupling reaction between the substantially colorless compound and the oxidized form of the incorporated color developing agent, and the hue of the diffusive dye residue, which is represented by Dye in the general formula (1), differ from each other. And the general formula (1) being as follows:

$Cp\text{-}(L)_n\text{-}Dye$ General formula (1)

16 Claims, 1 Drawing Sheet

HEAT DEVELOPABLE COLOR PHOTOSENSITIVE MATERIAL

BACKGROUND OF THE INVENTION

1. Field of the Invention

The present invention relates to a color photosensitive material, which is used for image formation in a heat development process.

2. Description of the Related Art

It is known that a silver halide photographic photosensitive material can form images by heat development. This is described, for example, in "Fundamentals of Photographic Engineering—Non-silver Salt Photography Section", pp. 242–255, Corona Co., Ltd., 1982, U.S. Pat. No. 4,500,626, and so on. A heat development type photosensitive material utilizing a silver halide exhibits superior photographic characteristics such as sensitivity and gradation in comparison with a photosensitive material for use in an electronic photography, a diazo photography, or the like. As to methods for obtaining images by heat development of a silver halide photosensitive material, a variety of methods have been proposed. One of these methods is a color development process in which dye images are formed by a coupling reaction between the oxidized form of a developing agent and a coupler. As to the developing agents and the couplers usable in this color development process, there have been made various proposals. For example, U.S. Pat. No. 3,531,256 proposes a combination of a reducing agent based on p-phenylenediamine and a phenol or active methylene coupler; U.S. Pat. No. 3,761,270 proposes a reducing agent based on p-aminophenol; and U.S. Pat. No. 4,021,240 proposes a combination of a reducing agent based on sulfonamide phenol and a 4-equivalent coupler.

However, in the conventional heat development processes described above, undeveloped silver halides, which remain in photosensitive materials even after processing, form colors at the time of printout or with the passage of time. In addition, since reduced silver and the color images are present simultaneously in exposed regions, defects such as color muddiness are sometimes caused. In order to solve these problems, there has been proposed a heat development process based on a dye transfer system in which diffusive dyes are formed by heat development and the dyes thus formed are transferred to an image-receiving layer. For example, there has been proposed a process in which a compound comprising a dye-releasable material having a diffusive dye which has already formed color fixed thereto is incorporated into a photosensitive material so that, when the photosensitive material undergoes heat development, the diffusive dyes are diffused image-wise and transferred to an image-receiving layer (U.S. Pat. Nos. 4,500,625, 4,483,914, 4,503,137, and 4,559,290, Japanese Patent Application Laid-Open (JP-A) Nos. 58-149046, 60-133449, 59-218443, and 61-238056, European Patent Laid-Open No. 220,746A2, Journal of Technical Disclosure No.87-6199, European Patent Laid-Open No. 210660A2, and so on). This process is excellent in that both of a negative color image and a positive color image can be obtained by changing the kinds of the dye-releasable compounds or of the silver halides to be used. However, this process is associated with a problem that the sensitivity of the photosensitive material is low because a dye, which has already formed color, is fixed to the dye-releasable material in the photosensitive material.

On the other hand, also proposed is a heat development process based on a dye transfer system in which a colorless coupler and a developing agent are incorporated into a photosensitive material so that, when the photosensitive material undergoes heat development, the colorless coupler and the developing agent react with each other to form diffusive dyes image-wise which are transferred to an image-receiving layer. For example, Japanese Patent Application Publication (JP-B) No. 63-36487, and JP-A Nos. 5-224381 and 6-83005 disclose a photosensitive material for heat development which contains a color developer precursor capable of releasing p-phenylenediamine and a coupler; JP-A No. 59-111148 discloses a combination of a ureidoaniline-based reducing agent and an active methylene-type coupler; and JP-A No. 58-149047 discloses a photosensitive material utilizing a coupler having a polymeric chain in the leaving group thereof and releasing a diffusive dye in color development. These processes, which do not need to contain dyes, which have formed color in the photosensitive material, are excellent in that the sensitivity is raised. However, these processes present a problem that the color formability is relatively low and it is difficult to shorten the time required for the color formation. An example of the photosensitive materials, which have solved the above-mentioned problem, is a photosensitive material proposed in JP-A No. 9-152705 in which a dye is formed/released by a combination of a carbamoylhydrazine-based developing agent and an active methylene-type coupler. This process is excellent in color formability and in short period processability. However, improvement of this process is necessary because the color formability of cyan images in particular is still insufficient when images are formed by transfer.

SUMMARY OF THE INVENTION

The object of the present invention is to provide a heat developable color photosensitive material, characterized by good color formability, rapid processing and capability to form colors with reduced color muddiness.

In a first aspect of the present invention, there is provided a heat developable color photosensitive material, said material comprising a support having disposed thereon a photosensitive layer including at least two layers, any one of the layers containing a photosensitive silver halide, a binder, and an incorporated color developing agent, one layer containing a substantially colorless coupler which forms a diffusive dye by coupling with the oxidized form of the incorporated developing agent, another layer containing a compound represented by the general formula (1), wherein the hue of the diffusive dye, which is formed by the coupling reaction between the substantially colorless compound and the oxidized form of the incorporated color developing agent, and the hue of the diffusive dye residue, which is represented by Dye in the general formula (1), differ from each other and the general formula (1) being as follows:

$$\text{Cp-(L)}_n\text{-Dye} \qquad \text{General formula (1)}$$

wherein Cp represents a coupler residue, L represents a bivalent linking group, n is 0 or 1, Dye represents a diffusive dye residue, and $-(L)_n$-Dye is linked to the active site of coupling.

In a second aspect of the present invention, there is provided A heat developable color photosensitive material, said material comprising a support having disposed thereon a first photosensitive layer sensitive to the light of a first wavelength region $\lambda 1$ and a second photosensitive layer sensitive to the light of a second wavelength region $\lambda 2$, wherein the first photosensitive layer contains a photosensitive silver halide sensitive to the light of the region λ1, a binder, an incorporated color developing agent, and a substantially colorless coupler which forms a diffusive dye by coupling with the oxidized form of the incorporated developing agent while the second photosensitive layer contains a photosensitive silver halide sensitive to the light of the region λ2, a binder, an incorporated color developing agent, and a compound represented by the following general formula (1), wherein λ1 is not equal to λ2, wherein the hue of the diffusive dye, which is formed by the coupling reaction between the substantially colorless compound and the oxidized form of the incorporated color developing agent, and the hue of the diffusive dye residue, which is represented by Dye in the general formula (1), differ from each other, and the general formula (1) being as follows:

$$Cp\text{-}(L)_n\text{-}Dye \qquad \text{General formula (1)}$$

wherein Cp represents a coupler residue, L represents a bivalent linking group, n is 0 or 1, Dye represents a diffusive dye residue, and $-(L)_n$-Dye is linked to the active site of coupling.

In both the first and second aspect, the Cp is preferably selected from the coupler residues represented by the following general formulae (4) to (9):

General formula (4)

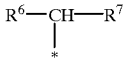

wherein $R^6$ and $R^7$ each represents independently an aryl group, a heterocyclic group, an alkoxycarbonyl group, an aryloxycarbonyl group, an acyl group, a carbamoyl group, a sulfamoyl group, a cyano group, a sulfonyl group, or a sulfinyl group, $R^6$ and $R^7$ may join together to form a 5-, 6-, or 7-membered ring, $R^6$ and $R^7$ may not be an aryl group at the same time; and -* indicates the site to which $-(L)_n$-Dye bonds;

General formula (5)

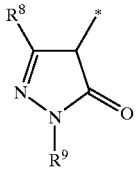

wherein $R^8$ represents a hydrogen atom or a substituent group; $R^9$ represents an alkyl group, an aryl group, or a heterocyclic group; and -* indicates the site to which $-(L)_n$-Dye bonds General formula (6)

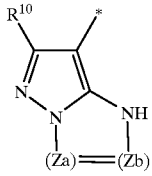

wherein $R^{10}$ represents a hydrogen atom or a substituent group; and Za and Zb independently represents —N═ or —C($R^{11}$)═; $R^{11}$ represents a hydrogen atom, an alkyl group, an aryl group, or a heterocyclic group; and -* indicates the site to which $-(L)_n$-Dye bonds;

General formula (7)

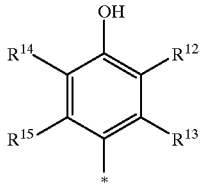

wherein $R^{12}$, $R^{13}$, $R^{14}$, and $R^{15}$ independently represents a hydrogen atom or a substituent group and $R^{14}$ and $R^{15}$may join together to form a 5-, 6-, or 7-membered saturated ring; and -* indicates the site to which $-(L)_n$-Dye bonds;

General formula (8)

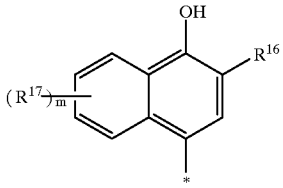

wherein $R^{16}$ represents a hydrogen atom or a substituent group; $R^{17}$ represents a substituent group; m is an integer of 0 to 4; and -* indicates the site to which $-(L)_n$-Dye bonds;

General formula (9)

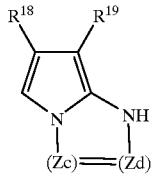

wherein $R^{18}$ and $R^{19}$ independently represents a hydrogen atom or a substituent group; Zc and Zd independently represents —N═ or ═C($R^{20}$)—; $R^{20}$ represents a hydrogen atom, an alkyl group, an aryl group, or a heterocyclic group; and -* indicates the site to which $-(L)_n$-Dye bonds.

DETAILED DESCRIPTION OF THE PREFERRED EMBODIMENTS

Figure 1:
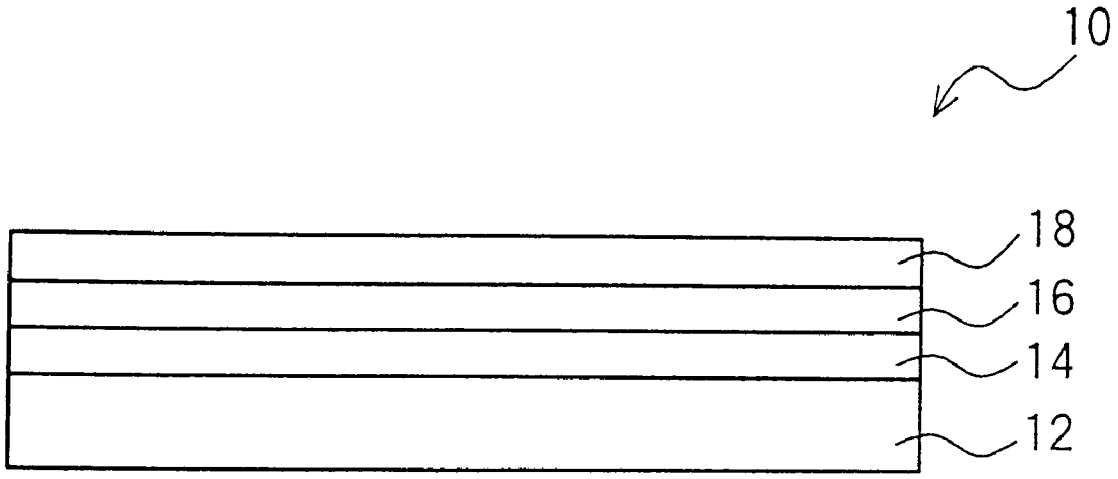
FIG. 1 is a schematic cross-sectional view of an example of the color photosensitive material for heat development of the present invention.

The photosensitive material for heat development of the present invention comprises a support having disposed thereon a photosensitive layer composed of two or more layers, wherein any one of the layers contains a photosensitive silver halide, a binder, an incorporated color developing agent, a substantially colorless coupler which forms a diffusive dye by coupling with the oxidized form of the incorporated developing agent, and a compound represented by the general formula (I). If necessary, the layer may contain other additives such as an organometallic salt based oxidizing agent or a dye-releasable compound (i.e., a dye-releasable compound wherein the dye is released by an oxidation/reduction reaction rather than by an oxidative coupling reaction). These components may be incorporated in different layers, or alternatively, two or more components may be incorporated in the same layer, but at least the substantially colorless coupler and the compound represented by the general formula (I) are incorporated in different layers. In addition, a layer containing a colored component (e.g., a dye-releasable compound or the like) may be formed beneath a layer containing a silver halide emulsion so that the sensitivity is raised.

The components incorporated in the photosensitive layer are described below.

The photosensitive layer contains a compound represented by the general formula (I). In the general formula (I), Cp represents a coupler residue. Cp may have any structure with the proviso that the coupler residue releases $-(L)_n$-Dye by a coupling reaction with the oxidized form of the incorporated color developing agent. Examples of the typical coupler residue include the coupler residues represented by the following general formulae (4) to (9).

General formula (4)

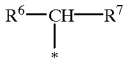

In the formula (4), $R^6$ and $R^7$ each represents independently an aryl group, a heterocyclic group, an alkoxycarbonyl group, an aryloxycarbonyl group, an acyl group, a carbamoyl group, a sulfamoyl group, a cyano group, a sulfonyl group, or a sulfinyl group, and $R^6$ and $R^7$ may join together to form a 5-, 6-, or 7-membered ring. $R^6$ and $R^7$ may not be an aryl group at the same time. -* indicates the site to which $-(L)_n$-Dye bonds.

General formula (5)

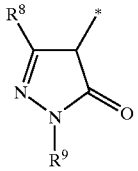

In the general formula (5), $R^8$ represents a hydrogen atom or a substituent group; and R represents an alkyl group, an aryl group, or a heterocyclic group.

General formula (6)

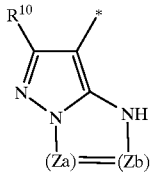

In the general formula (6), $R^{10}$ represents a hydrogen atom or a substituent group; and Za and Zb each represents independently —N═ or —C ($R^{11}$)═. $R^{11}$ represents a hydrogen atom, an alkyl group, an aryl group, or a heterocyclic group. -* indicates the site to which $-(L)_n$-Dye bonds.

General formula (7)

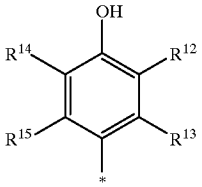

In the general formula (7), $R^{12}$, $R^{13}$, $R^{14}$, and $R^{15}$ each represents independently a hydrogen atom or a substituent group. $R^{14}$ and $R^{15}$ may join together to form a 5-, 6-, or 7-membered saturated ring.

General formula (8)

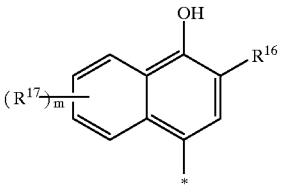

In the general formula (8), $R^{16}$ represents a hydrogen atom or a substituent group; and $R^{17}$ represents a substituent group. m is an integer of 0 to 4.

General formula (9)

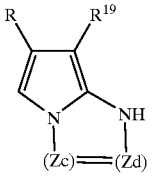

In the general formula (9), $R^{18}$ and $R^{19}$ each represents independently a hydrogen atom or a substituent group; and Zc and Zd each represents independently —N═ or ═C($R^{20}$)—. $R^{20}$ represents a hydrogen atom, an alkyl group, an aryl group, or a heterocyclic group.

Details of the substituent groups $R^6$ to $R^{20}$ in the general formulae (4) to (9) are given below.

$R^6$ and $R^7$ in the general formula (4) each represents independently an aryl group, a heterocyclic group, an alkoxycarbonyl group, an aryloxycarbonyl group, an acyl group, a carbamoyl group, a sulfamoyl group, a cyano group, a sulfonyl group, or a sulfinyl group. The aryl group indicated by $R^6$ or $R^7$ represents a substituted or unsubstituted aryl group (e.g., phenyl or naphthyl group) having 6 to 48, preferably 6 to 32, carbon atoms. Specific examples of the substituent groups of the substituted aryl group include a halogen atom (e.g., a, fluorine, chlorine, or bromine atom), an alkyl group (preferably a straight-chain, branched, or cyclic alkyl group having 1 to 48 carbon atoms, e.g., a methyl, ethyl, propyl, isopropyl, butyl, t-butyl, 1-octyl, tridecyl, cyclopropyl, cyclopentyl, cyclohexyl, 1-norbonyl, or 1-adamantyl group), an alkenyl group (preferably an alkenyl group having 2 to 32 carbon atoms, e.g., a vinyl, allyl, or 3-butene-1-yl group), an aryl group (preferably an aryl group having 6 to 32 carbon atoms, e.g., a phenyl, 1-naphthyl, or 2-naphthyl group), a heterocyclic group (preferably a 5- to 8-membered heterocyclic group having 1 to 32 carbon atoms, e.g., a 2-thienyl, 4-pyridyl, 2-furyl, 2-pyrimidinyl, 2-pyridyl, 2-benzothiazolyl, 1-imidazolyl, 1-pyrazolyl, or benzotriazole-2-yl group), a cyano group, a silyl group (preferably a silyl group having 3 to 32 carbon atoms, e.g., a trimethylsilyl, triethylsilyl, tributylsilyl, t-butyldimethylsilyl, or t-hexyldimethylsilyl group), a hydroxyl group, a carboxyl group, a nitro group, an alkoxy group (preferably an alkoxy group having 1 to 32 carbon atoms, e.g., a methoxy, ethoxy, 1-butoxy, 2-butoxy, isopropoxy, t-butoxy, dodecyloxy, cyclopentyloxy, or cyclohexyloxy group), an aryloxy group (preferably an aryloxy group having 6 to 32 carbon atoms, e.g., a phenoxy or 2-naphthoxy group), a heterocycloxy group (preferably a heterocycloxy group having 1 to 32 carbon atoms, e.g., a 1-phenyltetrazole-5-oxy, 2-tetrahydropyranyloxy, or 2-furyloxy group), a silyloxy group (preferably a silyloxy group having 1 to 32 carbon atoms, e.g., a trimethylsilyloxy, t-butyldimethylsilyloxy, or diphenylmethylsilyloxy group), an acyloxy group (preferably an acyloxy group having 2 to 32 carbon atoms, e.g., an acetoxy, pivaloyloxy, benzoyloxy, or dodecanoyloxy group), an alkoxycarbonyloxy group (preferably an alkoxycarbonyloxy group having 2 to 32 carbon atoms, e.g., an ethoxycarbonyloxy, t-butoxycarbonyloxy, or cyclohexyloxycarbonyloxy group), an aryloxycarbonyloxy group (preferably an aryloxycarbonyloxy group having 7 to 32 carbon atoms, e.g., a phenoxycarbonyloxy group), a carbamoyloxy group (preferably a carbamoyloxy group having 1 to 32 carbon atoms, e.g., an N,N-dimethylcarbamoyloxy or N-butylcarbamoyloxy group), a sulfamoyloxy group (preferably a sulfamoyloxy group having 1 to 32 carbon atoms, e.g., an N,N-diethylsulfamoyloxy or N-propylsulfamoyloxy group), an alkylsulfonyloxy group (preferably an alkylsulfonyloxy group having 1 to 32 carbon atoms, e.g., a methylsulfonyloxy, hexadecylsulfonyloxy, cyclohexylsulfonyloxy group), an arylsulfonyloxy group (preferably an arylsulfonyloxy group having 6 to 32 carbon atoms, e.g., a phenylsulfonyloxy group), an acyl group (preferably an acyl group having 1 to 32 carbon atoms, e.g., a formyl, acetyl, pivaloyl, benzoyl, tetradecanoyl, or cyclohexylcarbonyl group), an alkoxycarbonyl group (preferably an alkoxycarbonyl group having 2 to 32 carbon atoms, e.g., a methoxycarbonyl, ethoxycarbonyl, octadecyloxycarbonyl, or cyclohexyloxycarbony group), an aryloxycarbonyl group (preferably an aryloxycarbonyl group having 7 to 32 carbon atoms, e.g., a phenoxycarbonyl group), a carbamoyl group (preferably a carbamoyl group having 1 to 32 carbon atoms, e.g., a carbamoyl, N,N-dibutylcarbamoyl, N-ethyl-N-octylcarbamoyl, N-propylcarbamoyl group, N,N-dicyclohexylcarbamoyl, or N-phenylcarbamoyl group), an amino group (preferably an amino group having 32 or less carbon atoms, e.g., an amino, methylamino, N,N-dioctylamino, tetradecylamino, octadecylamino, or cyclohexylamino group) an anilino group (preferably an anilino group having 6 to 32 carbon atoms, e.g., an anilino or N-methylanilino group), a heterocycloamino group (preferably a heterocycloamino group having 1 to 32 carbon atoms, e.g., a 4-pyridylamino group), a carbonamide group (preferably a carbonamide group having 2 to 32 carbon atoms, e.g., an acetamide, benzamide, or tetradecanamide group), a ureido group (preferably a ureido group having 1 to 32 carbon atoms, e.g., a ureido, N,N-dimethylureido, or N-phenylureido group), an imido group (preferably an imido group having 32 or less carbon atoms, e.g., an N-succinimido or N-phthalimide group), an alkoxycarbonylamino group (preferably an alkoxycarbonylamino group having 2 to 32 carbon atoms, e.g., a methoxycarbonylamino, ethoxycarbonylamino, t-butoxycarbonylamino, octadecyloxycarbonylamino, or cyclohexyloxycarbonylamino group), an aryloxycarbonylamino group (preferably an aryloxycarbonylamino group having 7 to 32 carbon atoms, e.g., a phenoxycarbonylamino group), a sulfonamide group (preferably a sulfonamide group having 1 to 32 carbon atom, e.g., a methanesulfonamide, butanesulfonamide, benzenesulfoneamide, hexadecanesulfonamide, or cyclohexylsulfonylamino group), a sulfamoylamino group (preferably a sulfamoylamino group having 1 to 32 carbon atoms, e.g., an N,N-dipropylsulfamoylamino or N-ethyl-N-dodecylsulfamoylamino groups), an azo group (preferably an azo group having 1 to 32 carbon atoms, e.g., a phenylazo group), an alkylthio groups (preferably an alkylthio group having 1 to 32 carbon atoms, e.g., an ethylthio, octylthio, or cyclohexylthio group), an arylthio group (preferably an arylthio group having 6 to 32 carbon atoms, e.g., a phenylthio group), a heterocyclothio group (preferably a heterocyclothio group having 1 to 32 carbon atoms, e.g., a 2-benzothiazolylthio, 2-pyridylthio, or 1-phenyltetrazolylthio group), an alkylsulfinyl group (preferably an alkylsulfinyl group having 1 to 32 carbon atoms, e.g., a dodecanesulfinyl group), an arylsulfinyl group (preferably an arylsulfinyl group having 6 to 32 carbon atoms, e.g., a phenylsulfinyl group), an alkylsulfonyl group (preferably an alkylsulfonyl group having 1 to 32 carbon atoms, e.g., a methylsulfonyl, octylsulfonyl, or cyclohexylsulfonyl group), an arylsulfonyl group (preferably an arylsulfonyl group having 6 to 32 carbon atoms, e.g. , a phenylsulfonyl or 1-naphthylsulfonyl group), an alkylsulfonylcarbamoyl group (preferably an alkylsulfonylcarbamoyl group having 2 to 36 carbon atoms, e.g., a methylsulfonylcarbamoyl or butylsulfonylcarbamoyl group), an arylsulfonylcarbamoyl group (preferably an arylsulfonylcarbamoyl group having 7 to 32 carbon atoms, e.g., a phenylsulfonylcarbamoyl or p-toluenesulfonylcarbamoyl group), a sulfamoyl group (preferably a sulfamoyl group having 32 or less carbon atoms, e.g., a sulfamoyl, N,N-dipropylsulfamoyl, or N-ethyl-N-dodecylsulfamoyl groups), a sulfo group, a phosphonyl group (preferably a phosphonyl group having 1 to 32 carbon atoms, e.g., a phenoxyphosphonyl, octyloxyphosphonyl, or phenylphosphonyl group), and a phosphinoylamino group (a diethoxyphosphinoylamino or dioctyloxyphosphinoylamino group).

If these substituent groups are substitutable, these substituent groups may further have any of the above-listed substituent groups. If two or more substituent groups are present, these substituent groups maybe the same or different. Furthermore, the number of the substituent groups of substituted aryl groups may be more than one. If two or more substituent groups are present on an aryl group, these substituent groups may be the same or different.

The heterocyclic group represented by $R^6$ or $R^7$ is a 5- or 6-membered heterocyclic group having 3 to 48, preferably 3 to 32, carbon atoms. Examples of the heterocyclic group include a pyrazolyl group, an imidazolyl group, a thiazolyl group, an oxazolyl group, a furyl group, a pyridyl group, a pyrazinyl group, a pyrimidinyl group, a benzoxazolyl group, a benzthiazolyl group, a benzimidazolyl group, and a benzpyrazolyl group. If the heterocyclic groups $R^6$ or $R^7$ are substitutable, these groups may be substituted by any of the above-listed substituent groups of the substituted aryl group $R^6$ or $R^7$. If two or more substituent groups are present, these substituent groups may be the same or different.

The alkoxycarbonyl group represented by $R^6$ or $R^7$ is an alkoxycarbonyl group having 2 to 48, preferably 2 to 32, carbon atoms. Examples of the alkoxycarbonyl group include a methoxycarbonyl group, an ethoxycarbonyl group, a propyloxycarbonyl group, a butoxycarbonyl group, a hexyloxycarbonyl group, an octyloxycarbonyl group, a dodecyloxycarbonyl group, a hexadecyloxycarbonyl group, an isopropyloxycarbonyl group, a 2-ethylhexyloxycarbonyl group, a t-butyloxycarbonyl group, and a cyclohexyloxycarbonyl group. The alkyl group of the alkoxycarbonyl group may be substituted by any of the above-listed substituent groups of the substituted aryl group $R^6$ or $R^7$. If two or more substituent groups are present, these substituent groups may be the same or different.

The aryloxycarbonyl group represented by $R^6$ or $R^7$ is an aryloxycarbonyl group having 7 to 48, preferably 7 to 32, carbon atoms. Examples of the aryloxycarbonyl group include a phenoxycarbonyl group and a naphthoxycarbonyl group. The aryloxycarbonyl group may be substituted by any of the above-listed substituent groups of the substituted aryl group $R^6$ or $R^7$. If two or more substituent groups are present, these substituent groups may be the same or different.

The acyl group represented by $R^6$ or $R^7$ is an acyl group having 2 to 48, preferably 2 to 32, carbon atoms. Examples of the acyl group include an acetyl group, a propanoyl group, a butanoyl group, a hexanoyl group, an octanoyl group, a dodecanoyl group, a hexadecanoyl group, a 2-ethylhexanoyl group, an isobutanoyl group, a pivaloyl group, an adamantanoyl group, a cyclopropanoyl group, a cyclopentanoyl group, a cyclohexanoyl group, a benzoyl group, and a 2-indolinecarbonyl group. The acyl group may be substituted by any of the above-listed substituent groups of the substituted aryl group $R^6$ or $R^7$. If two or more substituent groups are present, these substituent groups may be the same or different.

The carbamoyl group represented by $R^6$or $R^7$is a carbamoyl group having 1 to 48, preferably 1 to 32, carbon atoms. Examples of the carbamoyl group include a carbamoyl group, an N-methylcarbamoyl group, an N-ethylcarbamoyl group, an N-isopropylcarbamoyl group, an N-butylcarbamoyl group, an N-octylcarbamoyl group, an N-dodecylcarbamoyl group, an N-cyclohexylcarbamoyl group, an N,N-diethylcarbamoyl group, an N,N-dibutylcarbamoyl group, an N-methyl-N-octadecylcarbamoyl group, an N-phenylcarbamoyl group, and an N,N-diphenylcarbamoyl group. The carbamoyl group may be substituted by any of the above-listed substituent groups of the substituted aryl group $R^6$ or $R^7$. If two or more substituent groups are present, these substituent groups may be the same or different.

The sulfamoyl group represented by $R^6$ or $R^7$is a sulfamoyl group having 0 to 48, preferably 0 to 32, carbon atoms. Examples of the sulfamoyl group include a sulfamoyl group, an N-methylsulfamoyl group, an N-ethylsulfamoyl group, an N-isopropylsulfamoyl group, an N-butylsulfamoyl group, an N-octylsulfamoyl group, an N-2-ethylhexylsulfamoyl group, an N-hexadecylsulfamoyl group, an N,N-dimethylsulfamoyl group, N,N-diethylsulfamoyl group, an N,N-dibutylsulfamoyl group, an N-methyl-N-dodecylsulfamoyl group, an N-cyclohexylsulfamoyl group, an N-phenylsulfamoyl group, and an N,N-diphenylsulfamoyl group. The sulfamoyl group may be substituted by any of the above-listed substituent groups of the substituted aryl group $R^6$ or $R^7$. If two or more substituent groups are present, these substituent groups may be the same or different.

The sulfonyl group represented by $R^6$ or $R^7$ is a sulfonyl group having 1 to 48, preferably 1 to 32, carbon atoms. Examples of the sulfonyl group include a methylsulfonyl group, an ethylsulfonyl group, a propylsulfonyl group, a butylsulfonyl group, an octylsulfonyl group, a dodecylsulfonyl group, an isopropylsulfonyl group, a 2-ethylhexylsulfonyl group, a cyclopentylsulfonyl group, a cyclohexylsulfonyl group, a phenylsulfonyl group, and a 4-methylphenylsulfonyl group and the like. The sulfonyl group may be substituted by any of the above-listed substituent groups of the substituted aryl group $R^6$ or $R^7$. If two or more substituent groups are present, these substituent groups may be the same or different.

The sulfinyl group represented by $R^6$ or $R^7$ is a sulfinyl group having 1 to 48, preferably 1 to 32, carbon atoms. Examples of the sulfinyl group include a methylsulfinyl group, an ethylsulfinyl group, a butylsulfinyl group, an octylsulfinyl group, a dodecylsulfinyl group, a cyclohexylsulfinyl group, and a phenylsulfinyl group. The sulfinyl group may be substituted by any of the above-listed substituent groups of the substituted aryl group $R^6$ or $R^7$. If two or more substituent groups are present, these substituent groups may be the same or different. Besides, $R^6$ and $R^7$ may join together to form a 5-, 6-, or 7-membered ring.

$R^6$ and $R^7$ may not be an aryl group at the same time. -* indicates the site to which $-(L)_n$-Dye bonds.

Examples of the coupler residue represented by the general formula (4) include a pivaloylacetamide type coupler residue, a benzoylacetamide type coupler residue, a malonic diester type coupler residue, a malonic diamide type coupler residue, a dibenzoylmethane type coupler residue, a malonic ester monoamide type coupler residue, a benzothiazolylacetamide type coupler residue, a benzoxazolylacetamide type coupler residue, a benzoimidazolylacetamide type coupler residue, a cycloalkanoylacetamide type coupler residue, an indoline-2-il-acetamide type coupler residue, an indazolone type coupler residue, a pyrazolidine-dione type coupler residue described in JP-A No. 7-36519, a quinazoline-4-one-2-il-acetamide type coupler residue described in U.S. Pat. No. 5,021,332, a 1,2,4-thiadiazine-1,1-dioxide-3-il-acetamide type coupler residue described in U.S. Pat. No. 5,021,330, a coupler residue described in European Patent No. 421221A, a coupler residue described in U.S. Pat. No. 5,454,149, and a coupler residue described in European Patent Laid-Open No. 0622673.

In the general formula (5), $R^8$ represents a hydrogen atom or a substituent group. Examples of the substituent groups represented by $R^8$ are the same as the above-listed examples of substituent groups of the substituted aryl group $R^6$ or $R^7$. The substituent groups represented by $R^8$ may be substituted by any of the above-listed substituent groups of the substituted aryl group $R^6$ or $R^7$. If two or more substituent groups are present, these substituent groups may be the same or different.

In the general formula (5), $R^9$ represents an alkyl group, an aryl group, or a heterocyclic group. Examples of the aryl group and heterocyclic group represented by $R^9$ are the same as the examples of the aryl group and heterocyclic group, respectively, represented by $R^6$ or $R^7$. Examples of the alkyl groups represented by $R^9$ are the same as the above listed examples of substituent alkyl groups of the substituent aryl group $R^6$ or $R^7$. The alkyl group, aryl group, and heterocyclic group represented by $R^9$ may be substituted by any of the above-listed substituent groups of the substituted aryl group $R^6$ or $R^7$. If two or more substituent groups are present, these substituent groups may be the same or different.

In the general formula (6), $R^{10}$ represents a hydrogen atom or a substituent group. Examples of the substituent groups represented by $R^{10}$ are the same as the above-listed examples of substituent groups of the substituted aryl group $R^6$ or $R^7$. The substituent groups represented by $R^{10}$ may be substituted by any of the above-listed substituent groups of the substituted aryl group $R^6$ or $R^7$. If two or more substituent groups are present, these substituent groups may be the same or different.

In the formula (6), Za and Zb each represents independently —N═ or —C($R^{11}$)═. $R^{11}$ represents a hydrogen atom, an alkyl group, an aryl group, or a heterocyclic group; and -* indicates the site to which -$(L)_n$-Dye bonds. Examples of the alkyl groups represented by $R^{11}$ are the same as the above-listed examples of substituent alkyl groups of the substituted aryl group $R^6$ or $R^7$. Examples of the aryl group and heterocyclic group represented by $R^{11}$ are the same as the examples of the aryl groups and heterocyclic groups, respectively, represented by the aryl or heterocyclic group $R^6$ or $R^7$. The alkyl group, aryl group, and heterocyclic group represented by $R^{11}$ may be substituted by any of the above-listed substituent groups of the substituted aryl group $R^6$ or $R^7$. If two or more substituent groups are present, these substituent groups may be the same or different.

In the general formula (7), $R^{12}$, $R^{13}$, $R^{14}$, and $R^{15}$ each represents independently a hydrogen atom or a substituent group. $R^{14}$ and $R^{15}$ may join together to form a 5-, 6-, or 7-membered saturated ring. Examples of the substituent groups $R^{12}$, $R^{13}$, $R^{14}$, and $R^{15}$ are the same as the examples of substituent groups of the substituted aryl groups represented by $R^6$ or $R^7$. The substituent groups represented by $R^{12}$, $R^{13}$, $R^{14}$, and $R^{15}$ may be substituted by any of the above-listed substituent groups of the substituted aryl group $R^6$ or $R^7$. If two or more substituent groups are present, these substituent groups may be the same or different.

In the general formula (8), $R^{16}$ represents a hydrogen atom or a substituent group. Examples of the substituent groups represented by $R^{16}$ are the same as the above-listed examples of substituent groups of the substituted aryl groups represented by $R^6$ or $R^7$. The substituent group $R^{16}$ may be substituted by any of the above-listed substituent groups of the substituted aryl group $R^6$ or $R^7$. If two or more substituent groups are present, these substituent groups may be the same or different.

In the general formula (8), $R^{17}$ represents a substituent group. Examples of the substituent groups represented by $R^{17}$ are the same as the above-listed examples of substituent groups of the substituted aryl groups represented by $R^6$ or $R^7$. The substituent group $R^{17}$ may be substituted by any of the above-listed substituent groups of the substituted aryl group $R^6$ or $R^7$. If two or more substituent groups are present, these substituent groups may be the same or different. m is an integer of 0 to 4.

In the general formula (9), $R^{18}$ and $R^{19}$ each represents independently a hydrogen atom or a substituent group. Examples of the substituent groups represented by $R^{18}$ and $R^{19}$ are the same as the examples of substituent groups of the substituted aryl groups represented by $R^6$ or $R^7$. The substituent groups $R^{18}$ and $R^{19}$ may be substituted by any of the above-listed substituent groups of the substituted aryl group $R^6$ or $R^7$. If two or more substituent groups are present, these substituent groups may be the same or different.

In the formula (9), Zc and Zd each represents independently —N═ or ═C($R^{20}$)—, wherein $R^{20}$ represents a hydrogen atom, an alkyl group, an aryl group, or a heterocyclic group. Examples of the alkyl groups represented by $R^{20}$ are the same as the examples of substituent alkyl groups of the substituted aryl group $R^6$ or $R^7$. Examples of the aryl group and the heterocyclic group represented by $R^{20}$ are the same as the examples of aryl groups and heterocyclic groups, respectively, represented by the aryl or heterocyclic group $R^6$ or $R^7$. The alkyl group, the aryl group, and the heterocyclic group represented by $R^{20}$ may be substituted by any of the above-listed substituent groups of the substituted aryl group $R^6$ or $R^7$. If two or more substituent groups are present, these substituent groups may be the same or different.

When Cp is represented by the general formula (4), preferably, $R^6$ and $R^7$ are each independently a heterocyclic group, an acyl group, an alkoxycarbonyl group, a carbamoyl group, or a cyano group. More preferable are a combination in which $R^6$ is a heterocyclic group and $R^7$ is a heterocyclic group, an acyl group, an alkoxycarbonyl group, a carbamoyl group, or a cyano group; a combination in which $R^6$ is an acyl group and $R^7$ is an alkoxycarbonyl group, a carbamoyl group, an acyl group, or a cyano group; a combination in which $R^6$ is an alkoxycarbonyl group and $R^7$ is an alkoxycarbonyl group, a carbamoyl group, or a cyano group; a combination in which $R^6$ is a carbamoyl group and $R^7$ is a carbamoyl group or a cyano group; and a combination in which $R^6$ is a cyano group and $R^7$ is a cyano group. Most preferable are a combination in which $R^6$ is a heterocyclic group and $R^7$ is an alkoxycarbonyl group, a carbamoyl group, or a cyano group; a combination in which $R^6$ is an acyl group and $R^7$ is a carbamoyl group; a combination in which $R^6$ is an alkoxycarbonyl group and $R^7$ is a carbamoyl group, and a combination in which $R^6$ is a carbamoyl group and $R^7$ is a carbamoyl group.

Specific examples (IV-1~50) of the coupler residue (Cp) represented by the general formula (4) are given below. However, it should be noted that Cp is not limited to these specific examples.

IV-1

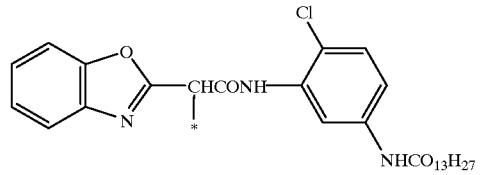

IV-2

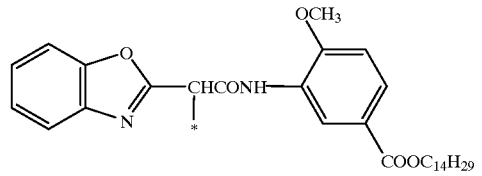

IV-3

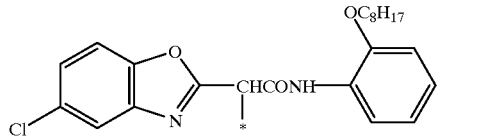

IV-4

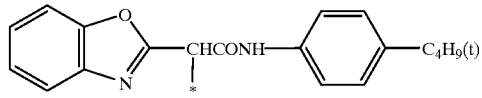

-continued
IV-5
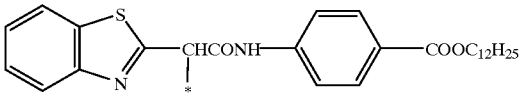
IV-6
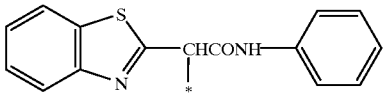
IV-7
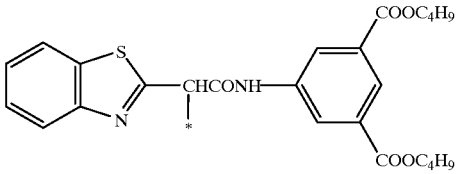
IV-8
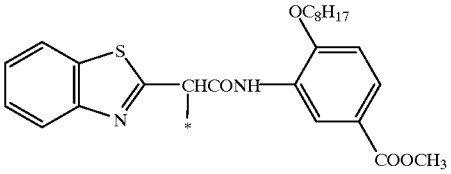
IV-9
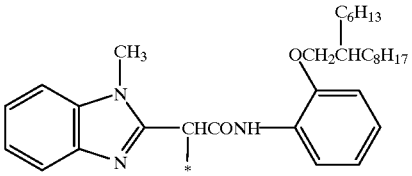
IV-10
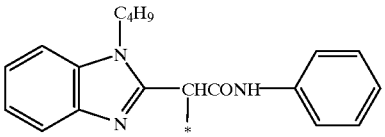
IV-11
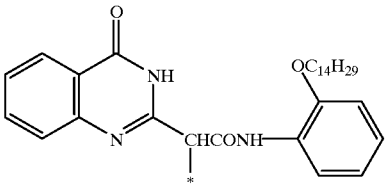
IV-12
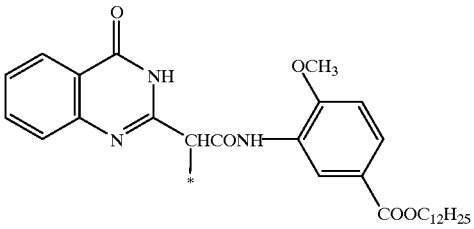
-continued
IV-13
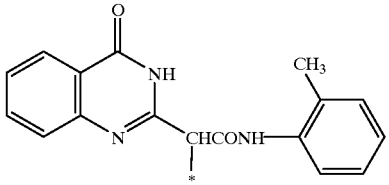
IV-14
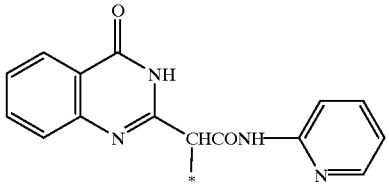
IV-15
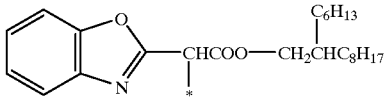
IV-16
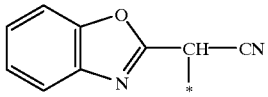
IV-17
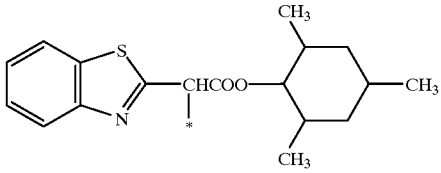
IV-18
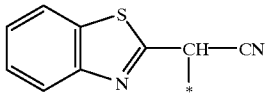
IV-19
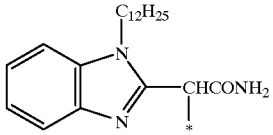
IV-20
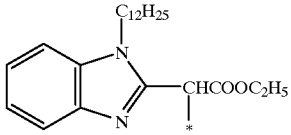
IV-21
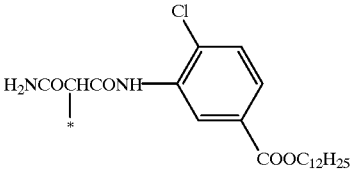

-continued
IV-22
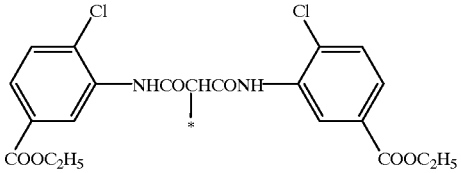
IV-23
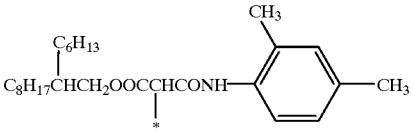
IV-24
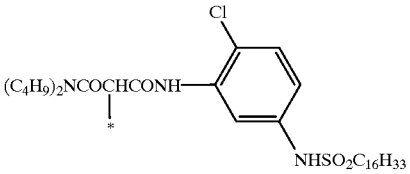
IV-25
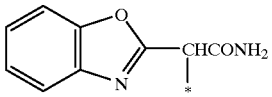
IV-26
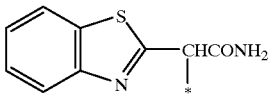
IV-27
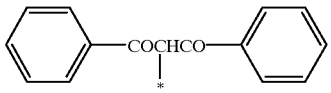
IV-28
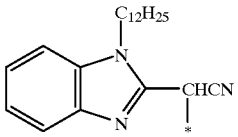
IV-29
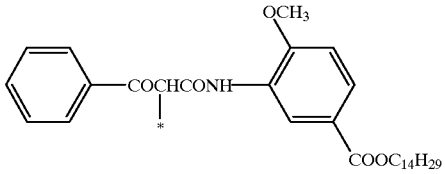
IV-30
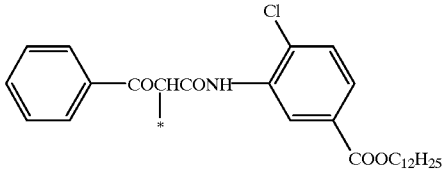
IV-31
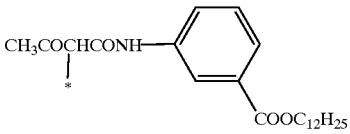
-continued
IV-32
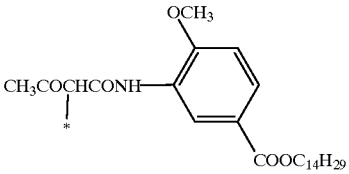
IV-33
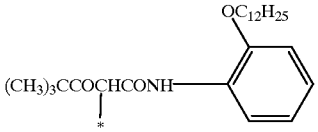
IV-34
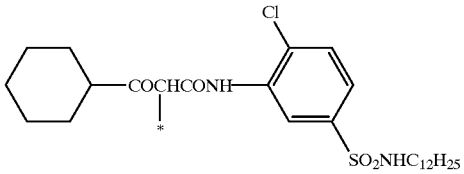
IV-35
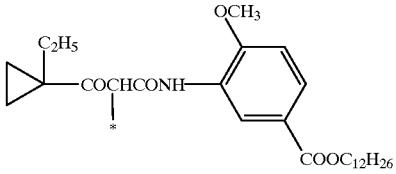
IV-36
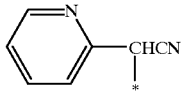
IV-37
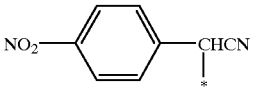
IV-38
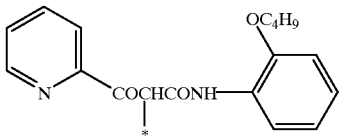
IV-39
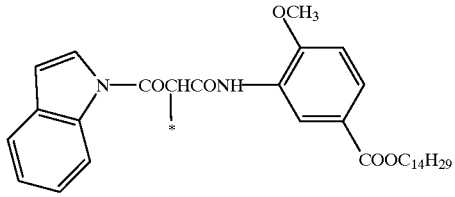
IV-40
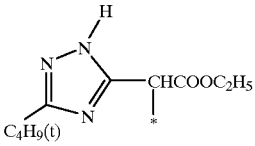

-continued

IV-41

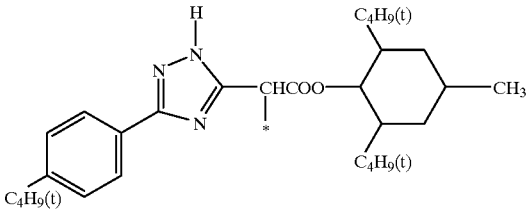

IV-42

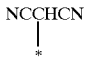

IV-43

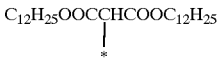

IV-44

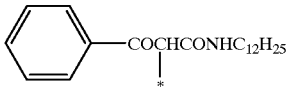

IV-45

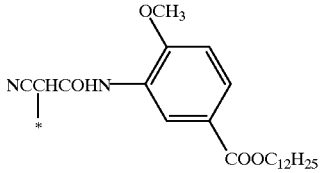

IV-46

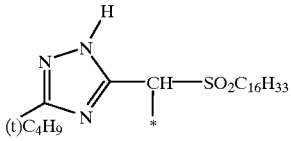

IV-47

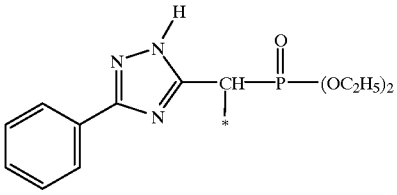

IV-48

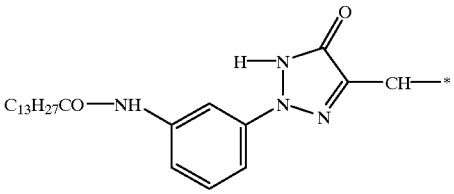

IV-49

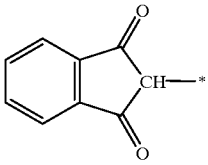

-continued

IV-50

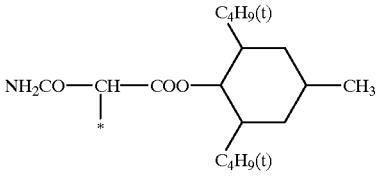

When Cp is represented by the general formula (5), preferably, $R^8$ is an alkyl group, an aryl group, a heterocyclic group, an alkoxy group, an acylamino group, an alkoxycarbonylamino group, a carbamoylamino group, an amino group, or an imido group. Preferably, $R^9$ is an alkyl group, an aryl group, or a heterocyclic group. More preferable is a combination in which $R^8$ is an alkyl group, an alkoxy group, an acylamino group, an alkoxycarbonylamino group, a carbamoylamino group, or an anilino group, and $R^9$ is an aryl group. Specific examples (V-1~10) of the coupler residue (cp) represented by the general formula (5) are given below. However, it should be noted that Cp is not limited to these specific examples.

V-1

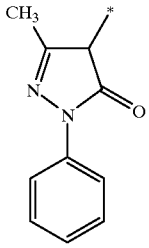

V-2

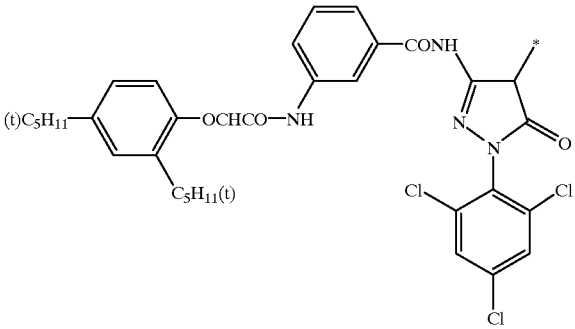

V-3

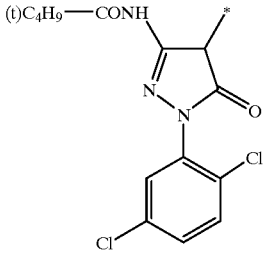

-continued

V-4

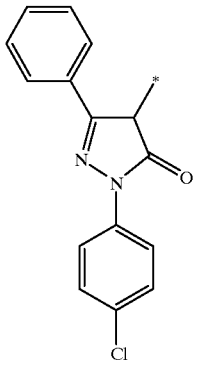

V-5

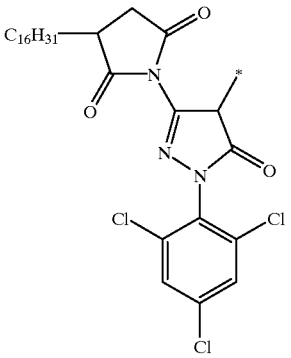

V-6

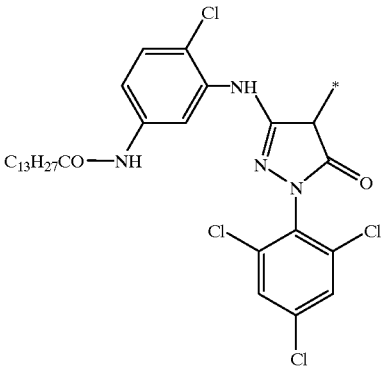

V-7

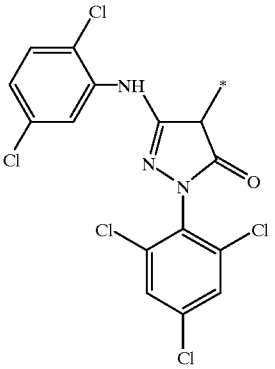

-continued

V-8

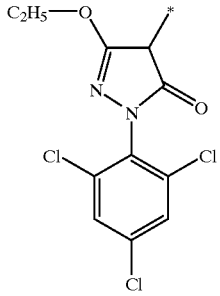

V-9

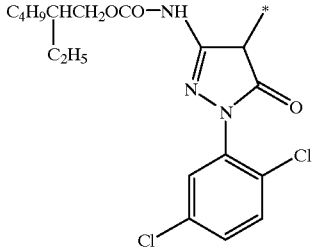

V-10

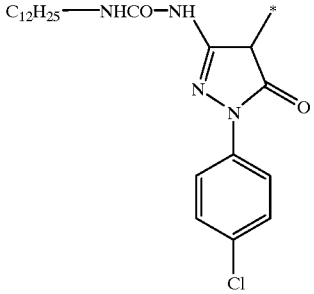

When Cp is represented by the general formula (6), preferrably, $R^{10}$ is an aryl group, a heterocyclic or an arylthio grou, an aryloxy group, an alkylthio group, or an arylthio group; and Za and Zb are each independently —N═ or ═C($R^{11}$)— wherein $R^{11}$ is an aryl group or a heterocyclic group. More preferrably is a combination in which $R^{10}$ is an alkyl group, an aryl group, an alkoxy group, or an aryloxy group; and Za is —N═ and Zb is ═C($R^{11}$)— or Za is ═C($R^{11}$)— and Zb is —N═ wherein $R^{11}$ is an alkyl group or an aryl group. Specific examples (VI-1~18) of the coupler residue (Cp) represented by the general formula (6) are given below. However, it should be noted that Cp is not limited to these specific examples.

V1-1

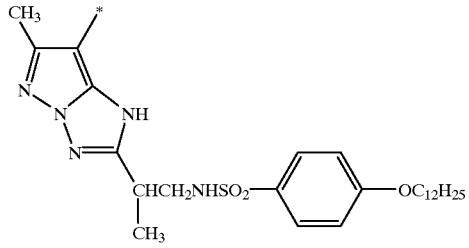

-continued
V1-2
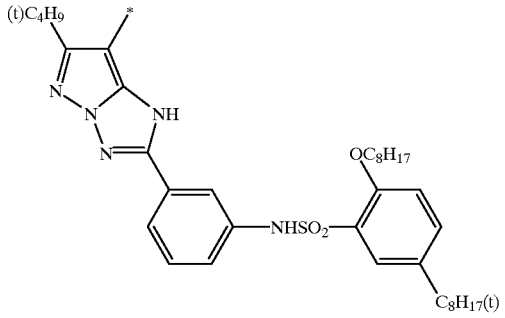
V1-3
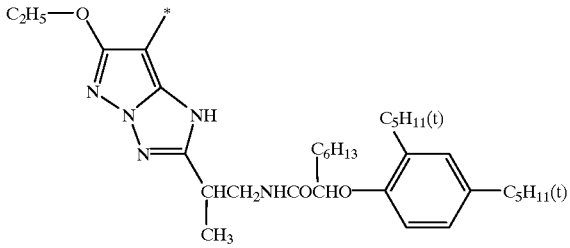
V1-4
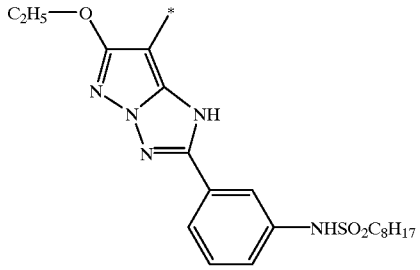
V1-5
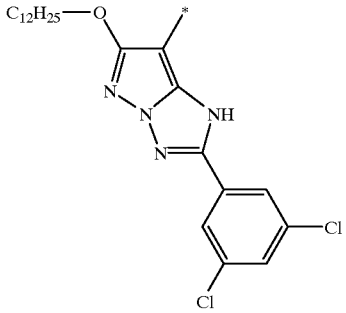
V1-6
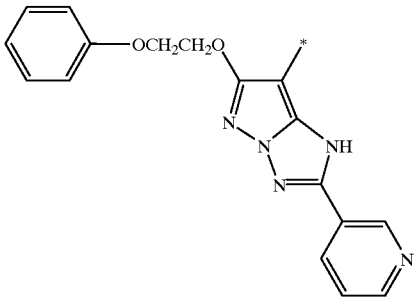
-continued
V1-7
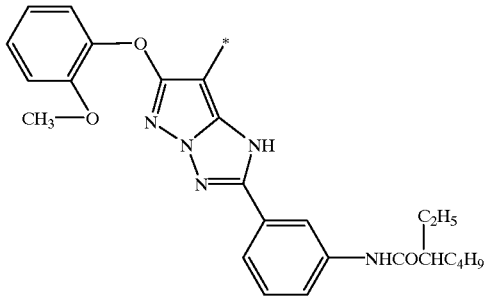
V1-8
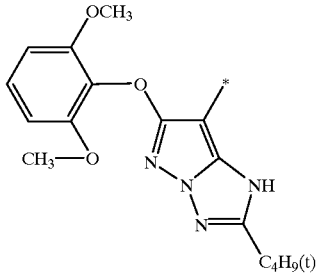
V1-9
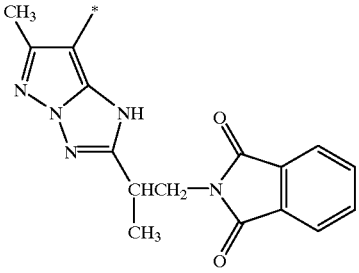
V1-10
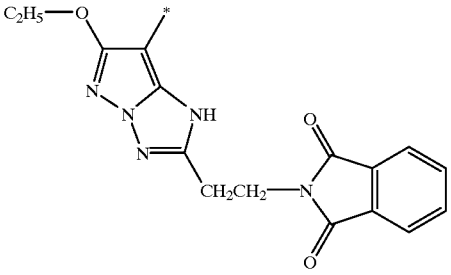
V1-11
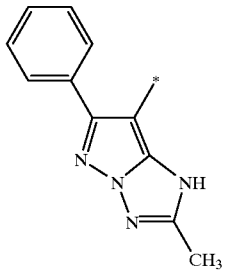

-continued

V1-12

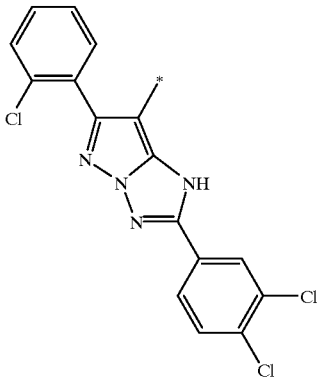

V1-13

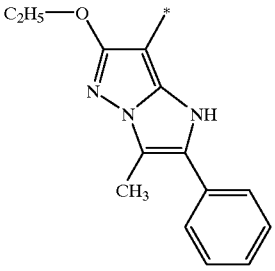

V1-14

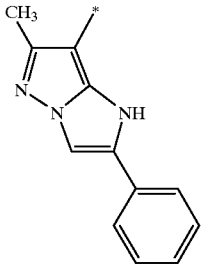

V1-15

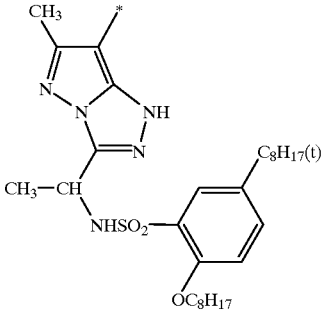

V1-16

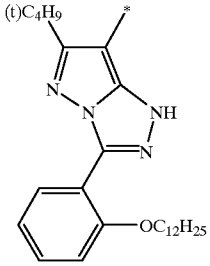

-continued

V1-17

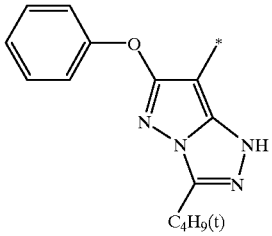

V1-18

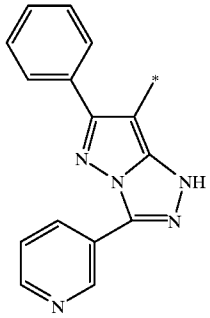

When Cp is represented by the general formula (7), preferable is a combination in which $R^{12}$ is a halogen atom, an alkyl group, a heterocyclic group, an alkoxy group, an acylamino group, an alkoxycarbonylamino group, or a carbamoylamino group, $R^{13}$ is a hydrogen atom, $R^{14}$ is a hydrogen atom, a halogen atom, an alkyl group, an alkoxy group, or an acylamino group, and $R^{15}$ is a hydrogen atom, a halogen atom, an alkyl group, an alkoxy group, an acylamino group, an alkoxycarbonyl group, or a carbamoylamino group; or a combination in which $R^{12}$ and $R^{13}$ are selected from the substituent groups previously listed as preferred substituent groups, while $R^{14}$ and $R^{15}$ join to form a saturated 5-, 6-, or 7-membered which is condensed with a benzene ring.

More preferable is a combination in which $R^{12}$ is an alkoxy group, an acylamino group, an alkoxycarbonylamino group, or acarbamoylamino group, $R^{13}$ is a hydrogen atom, $R^{14}$ is a hydrogen atom, a halogen atom, an alkyl group, an alkoxy group, or an acylamino group, and $R^{15}$ is a hydrogen atom, an alkyl group, an acylamino group, an alkoxycarbonyl group, or a carbamoylamino group. Specific examples (VII-1~20) of the coupler residue (Cp) represented by the general formula (7) are given below. However, it should be noted that Cp is not limited to these specific examples.

VII-1

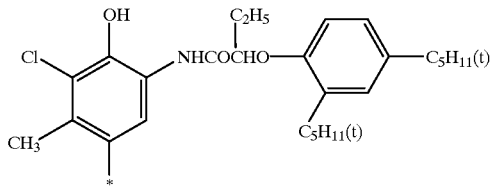

-continued
VII-2
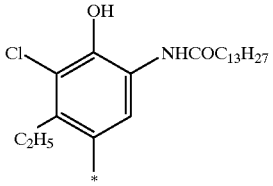
VII-3
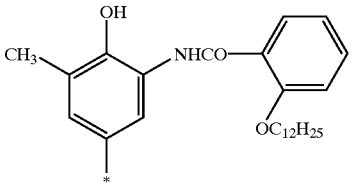
VII-4
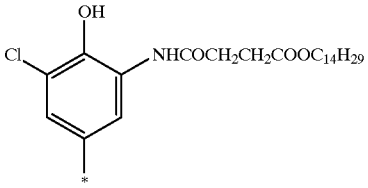
VII-5
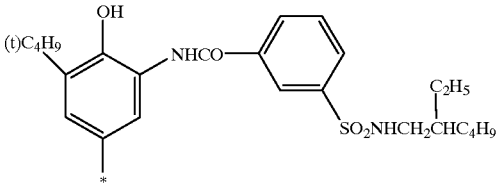
VII-6
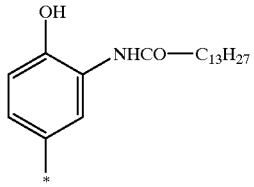
VII-7
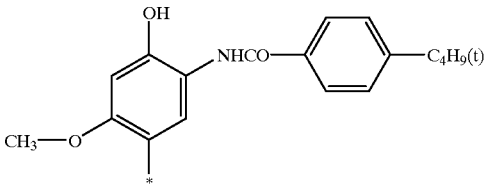
VII-8
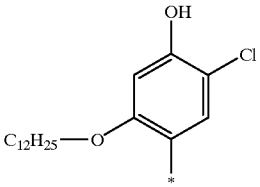
-continued
VII-9
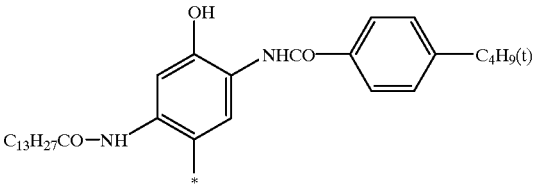
VII-10
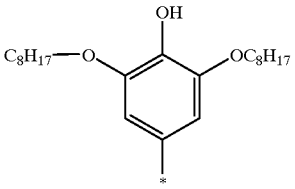
VII-11
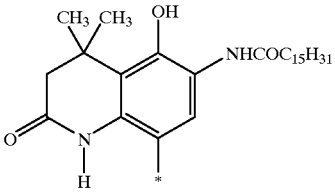
VII-12
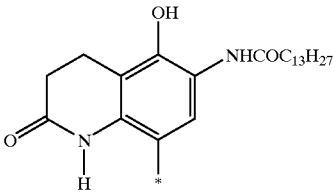
VII-13
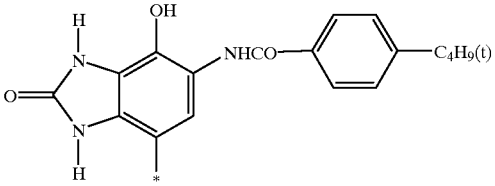
VII-14
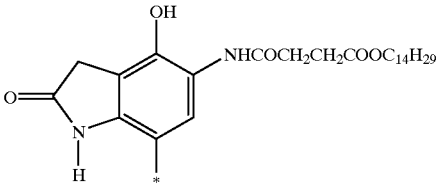
VII-15
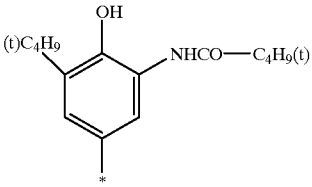

-continued

VII-16

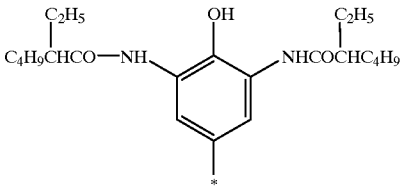

VII-17

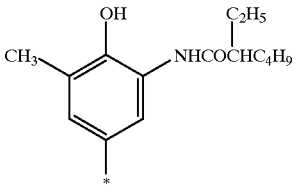

VII-18

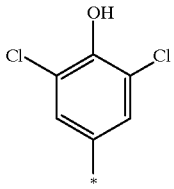

VII-19

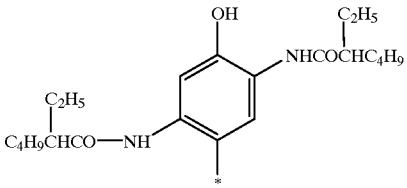

VII-20

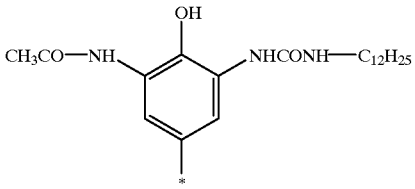

If Cp is represented by the general formula (8), preferably, $R^{16}$ is a hydrogen atom, a halogen atom, a heterocyclic group, an acylamino group, a carbamoyl group, or a sulfamoyl group; m is 0 or 1; and $R^{17}$ is an acylamino group, an alkoxycarbonylamino group, a carbamoylamino group, or a sulfonamide group. More preferable is a combination in which $R^{16}$ is a hydrogen atom, a halogen atom, a carbamoyl group, or a sulfamoyl group, m is 0 or 1, and $R^{17}$ is an acylamino group or an alkoxycarbonylamino group. Specific examples (VIII-1~10) of the coupler residue (Cp) represented by the general formula (8) are given below. However, it should be noted that Cp is not limited to these specific examples.

VIII-1

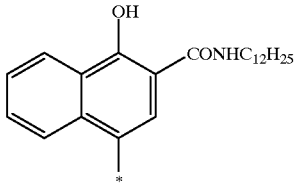

VIII-2

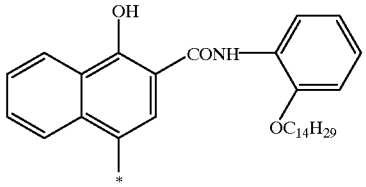

VIII-3

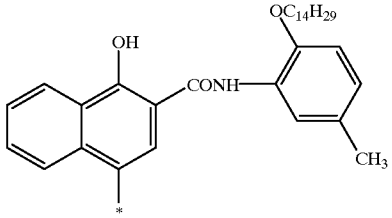

VIII-4

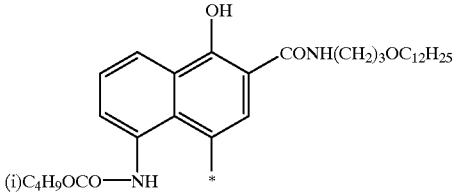

VIII-5

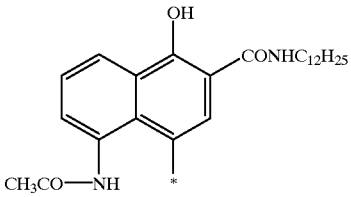

VIII-6

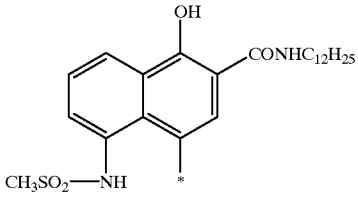

VIII-7

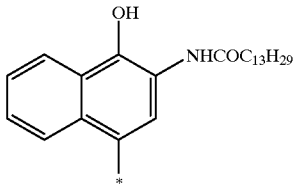

-continued

VIII-8

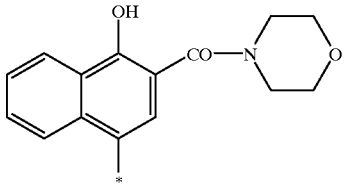

VIII-9

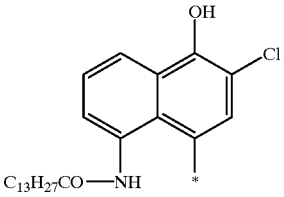

VIII-10

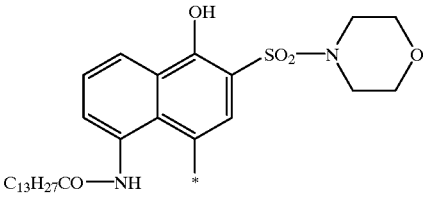

When Cp is represented by the general formula (9), preferably, $R^{18}$ is an alkoxycarbonyl group, a carbamoyl group, or a cyano group; $R^{19}$ is an alkoxycarbonyl group, a carbamoyl group, a cyano group, a sulfonyl group, or a phosphonyl group; and Zc and Zd are each independently —N═ or ═C($R^{20}$)— wherein $R^{20}$ is an alkyl group, an aryl group, or a heterocyclic group. More preferable is a combination in which $R^{18}$ is a cyano group, $R^{19}$ is an alkoxycarbonyl group or a cyano group, and Zc is —N═ and Zd is ═C($R^{20}$)— or Zc is ═C($R^{20}$)— and Zd is —N═ wherein $R^{20}$ is an alkyl group or an aryl group. Specific examples (IX-1~8) of the coupler residue (Cp) represented by the general formula (9) are given below. However, it should be noted that Cp is not limited to these specific examples.

IX-1

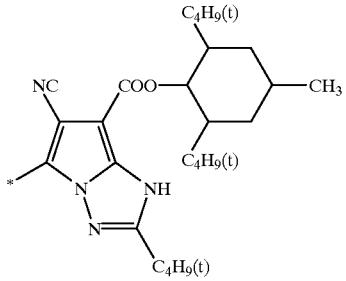

IX-2

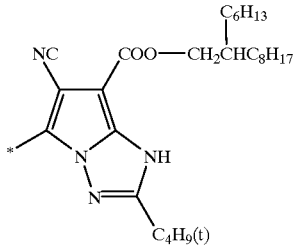

-continued

IX-3

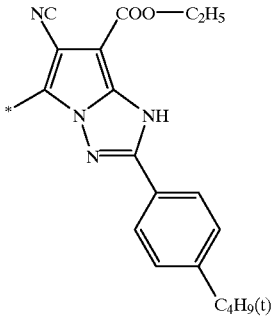

IX-4

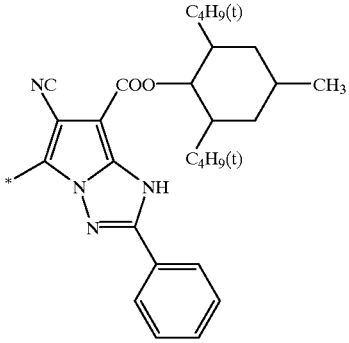

IX-5

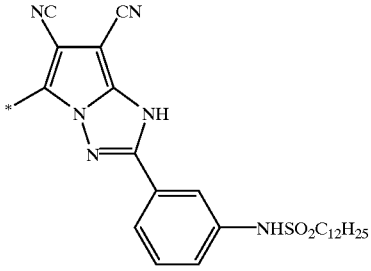

IX-6

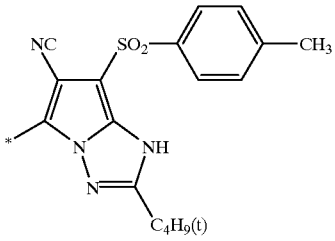

IX-7

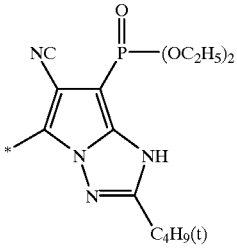

-continued

IX-8

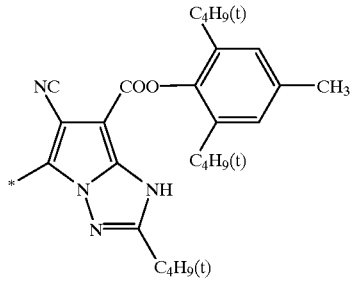

Examples of more preferable coupler residue (Cp) include the coupler residues represented by the general formula (4), (6), (7), or (8) (wherein preferable scopes of the substituent groups are as described previously). The most preferable is the coupler residue represented by the general formula (4).

In the general formula (1), L represents a bivalent linking group. The linking group may be —OC(=O)— or any group having a structure capable of cleaving the bond with the Dye after the cleavage of the bond between L and Cp of the general formula (1) when development processing is carried out. Examples of such groups include a group utilizing the cleaving reaction of hemiacetal described in U.S. Pat. Nos. 4,146,396, 4,652,516, and 4,698,297; a group causing a cleaving reaction by utilizing an intramolecular nucleophilic substitution reaction described in U.S. Pat. Nos. 4,248,962, 4,847,185, 4,857,440, and 5,262,291; a group causing a cleaving reaction by utilizing an electron transfer reaction described in U.S. Pat. Nos. 4,409,323 and 4,421,845; a group causing a cleaving reaction by utilizing a hydrolysis reaction of iminoketal described in U.S. Pat. No. 4,546,073; a group causing a cleaving reaction by utilizing a hydrolysis reaction of ester described in U. K. Patent No. 1,531,927; and a group causing a cleaving reaction by utilizing a reaction with sulfite ions described in European Patent Laid-Open Nos. 0572948 and 0684512.

Examples of preferable L represents a bivalent group selected by the bivalent groups consisting of —OC(=O)— and the groups represented by the following general formula (T-1) to (T-3).

| | |
|---|---|
| *-W-$(Y^1=Y^2)_j$-$C(R^{21})(R^{22})$-** | General formula (T-1) |
| *-W-CO-** | General formula (T-2) |
| *-W-LINK-E-** | General formula (T3) |

In the general formulae (T-1) to (T-3), * indicates the site to which the active site for coupling of the coupler bonds, and ** indicates the site on which—Dye of the general formula (1) bonds. In the general formulae (T-1) to (T-3), W represents an oxygen atom, a sulfur atom, or

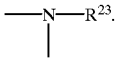

In the general formula (T-1), $Y^1$ and $Y^2$ each represents independently a substituted or unsubstituted methylene group or a nitrogen atom. j is 0, 1, or 2. If $Y^1$ and $Y^2$ each represents a substituted methylene group, examples of the substituent group thereof include the same groups as the above-listed substituent groups of the substituted aryl group $R^6$ or $R^7$. When $Y^1$ and $y^2$ each represents a substituted methylene group, any of the two substituent groups selected from the substituent groups thereof, $R^{21}$, $R^{22}$, and $R^{23}$ (when W represents N—$R^{23}$) may join together to form a ring structure (e.g., a benzene ring or a pyrazole ring). $R^{21}$ and $R^{22}$ each represents independently a hydrogen atom, an alkyl group, an aryl group, or a heterocyclic group. Examples of the alkyl groups, aryl groups, and heterocyclic groups represented by $R^{21}$ or $R^{22}$ are the same as the alkyl groups, aryl groups, and heterocyclic groups given as examples of the substituent groups of the substituted aryl group represented by $R^6$ or $R^7$. $R^{23}$ represents an alkyl group, an aryl group, an acyl group, or a sulfonyl group. Examples of the alkyl groups, aryl groups, acyl groups, and sulfonyl groups represented by $R^{23}$ are the same as the alkyl groups, aryl groups, acyl groups, and sulfonyl groups given as the substituent groups of the substituted aryl group represented by $R^6$ or $R^7$.

In the general formula (T-3), E represents a electrophilic group, LINK represents a linking group which creates a steric relationship enabling W and E to carry out an intramolecular nucleophilic substitution reaction.

Specific examples represented by the general formula (T-1), (T-2), or (T-3), include those of the timing groups described in JP-A No. 10-62923.

In the general formula (1), n is 0 or 1, and n is preferably 0.

In the general formula (1), Dye represents a dye residue in a colored state such as a yellow dye residue, a magenta dye residue, a cyan dye residue, or a black dye residue. Examples of such dyes include an azo dye, an azomethine dye, an azine dye, a quinophthalone dye, and a phthalocyanine dye.

Preferable dye residues are as follows. Examples of the yellow dye residue include the yellow dye residues described in JP-A Nos. 52-7727 and 54-79031; U.S. Pat. No. 4,473,632; JP-A Nos. 9-244199 and 61-270757; JP-B No. 62-15851; U.S. Pat. Nos. 4,830,957 and 4,837,142; JP-A Nos. 2-232059 and 6-301179; and so on.

Examples of the magenta dye residue include the magenta dye residues described in U.S. Pat. Nos. 3,453,107, 3,544,545, 3,932,380, 3,931,114, 3,932,308, 3,954,476, 4,233,237, 4,255,509, 4,250,246, 4,142,891, 4,207,104, and 4,287,292; JP-A Nos. 52-106727, 53-23628, 55-36804, 56-73057, 56-71060, 55-134, 49-114424, 50-115528, 55-4028, 60-140240, 60-14243, 61-55650, 62-71951, 61-273542, 4-331954, and 7- 305218; and so on.

Examples of the cyan dye residue include the cyan dye residues described in U.S. Pat. Nos. 3,482,972, 3,292,760, 3,942,987, 4,268,625, 4,171,220, 4,242,435, 4,142,891, 4,195,994, 4,147,544, 4,148,642, 4,013,635, and 4,273,708; U. K. Patent No. 1,551,138; European Patent (EPC) Nos. 53,037 and 53,040; Research Disclosure Nos. 17,630 (1987) and 16,475 (1977); JP-A Nos. 53-66227, 54-99431, 52-8827, 53-47823, 53-143323,54-99431, 56-71061,60-93434, 60-87134, 60-257579, 60-14243, 60-140240, 62-257151, 61-44301, 3-114042,7-219180, 11-125888 and 10-216914; and so on.

More preferable examples of the yellow dye residue include the yellow dye residues described in JP-A Nos. 2-232059 and 6-301179. More preferable examples of the magenta dye residue include the magenta dye residues described in JP-A Nos. 331954 and 7-305218. More preferable examples of the cyan dye residue include the cyan dye residues described in JP-A Nos. 11-125888 and 10-216914.

Examples (CP-1~84) of the specific compounds represented by the general formula (1) are given below. However, it should be noted that the compounds for use in the present invention are not limited to these examples.

Cp-1
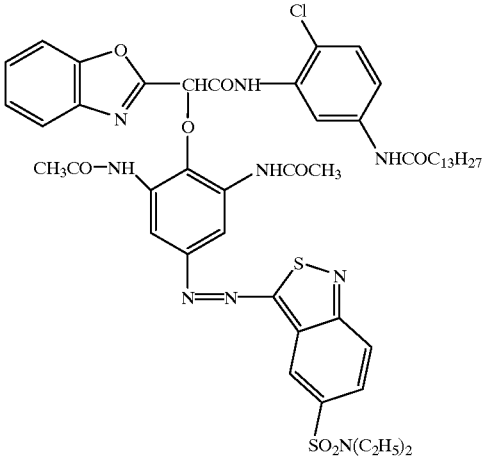
Cp-2
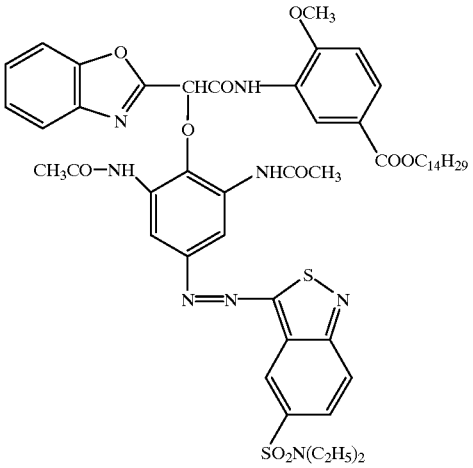
Cp-3
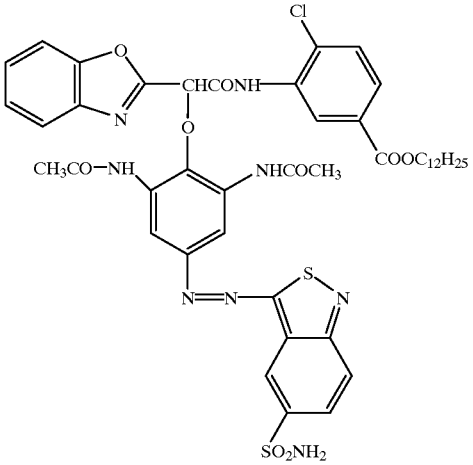

-continued
Cp-4
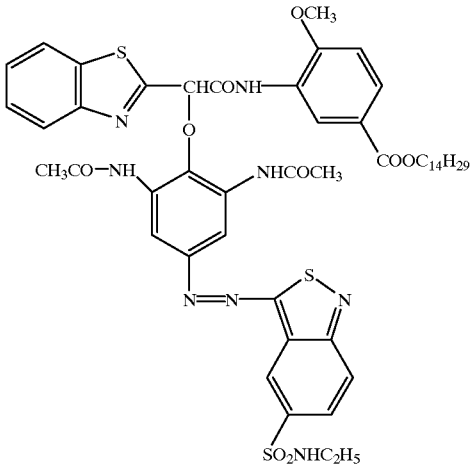
Cp-5
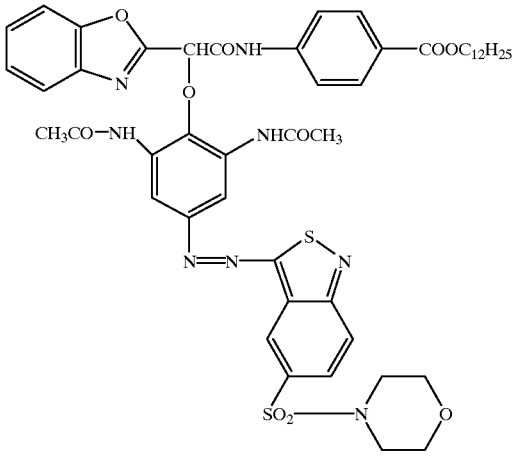
Cp-6
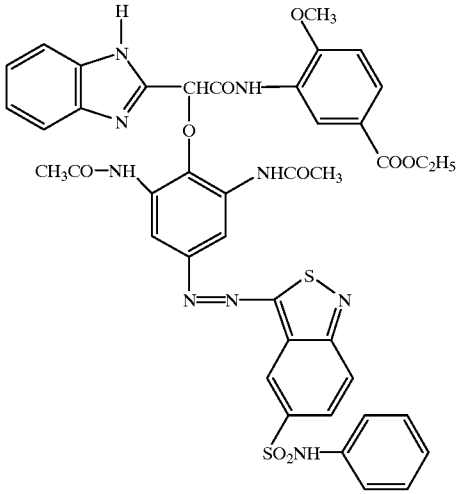

-continued
Cp-7
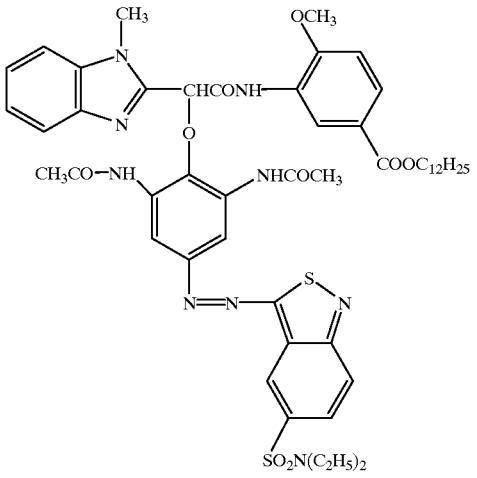
Cp-8
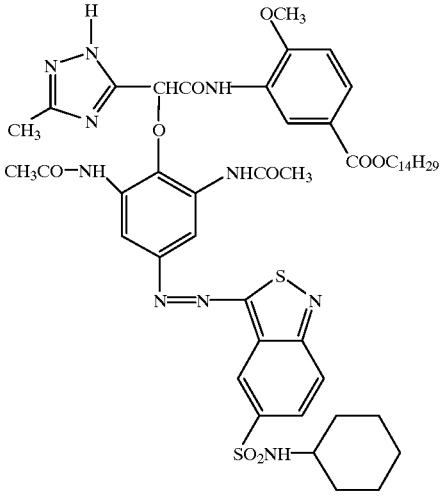
Cp-9
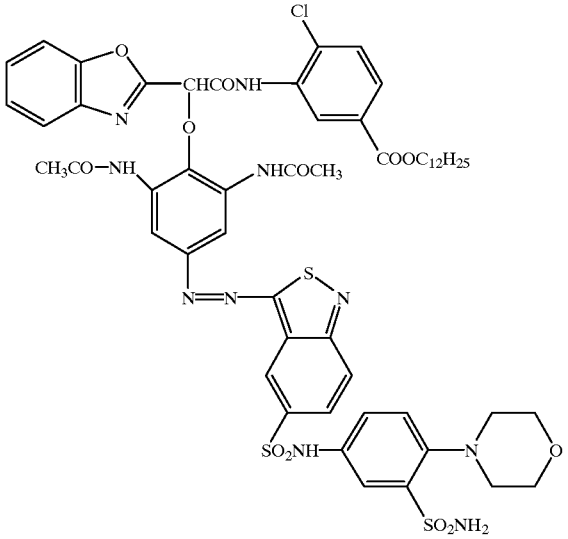

-continued
Cp-10
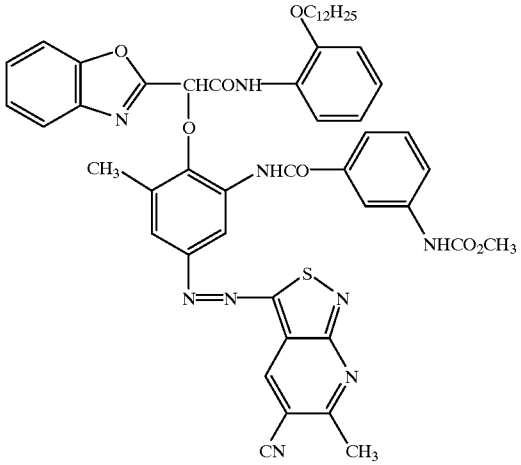
Cp-11
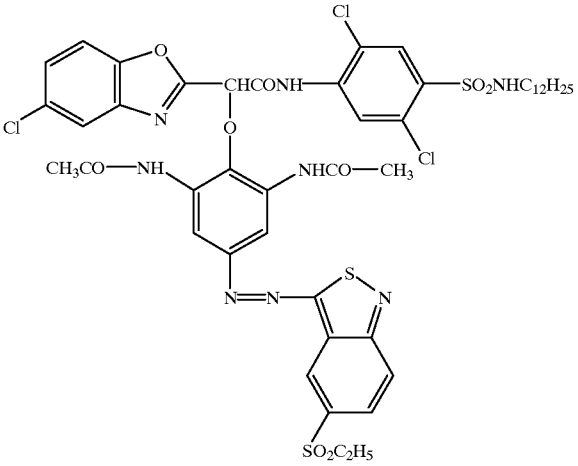
Cp-12
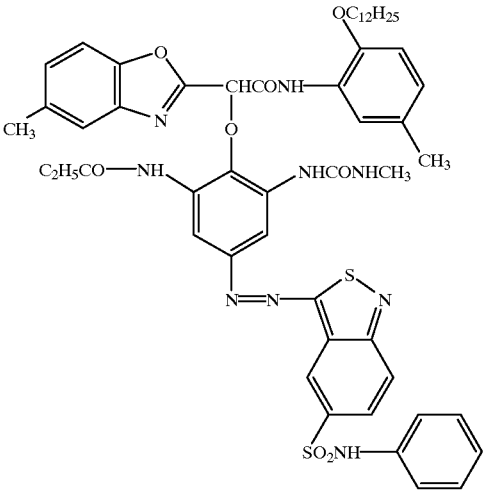

-continued
Cp-13
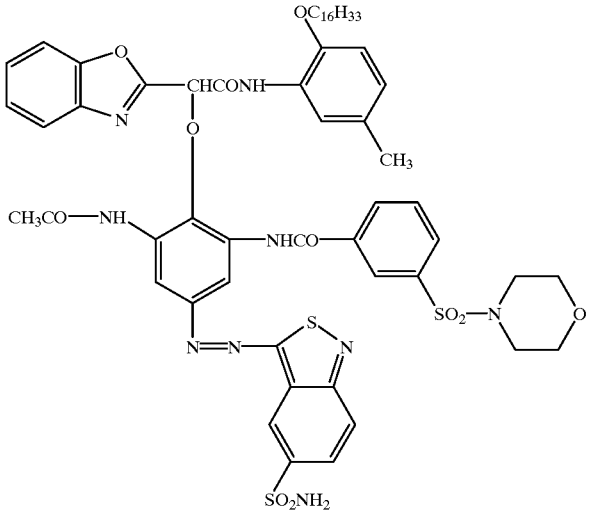
Cp-14
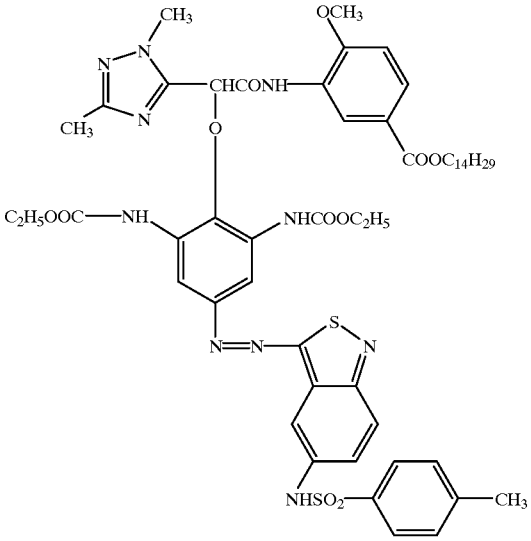
Cp-15
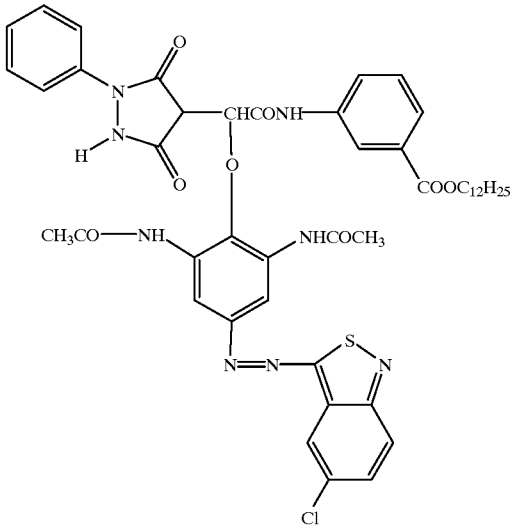

-continued
Cp-16
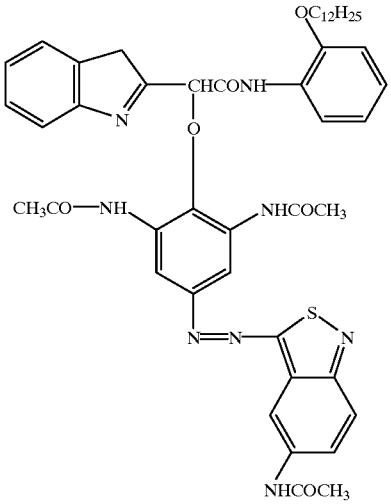
Cp-17
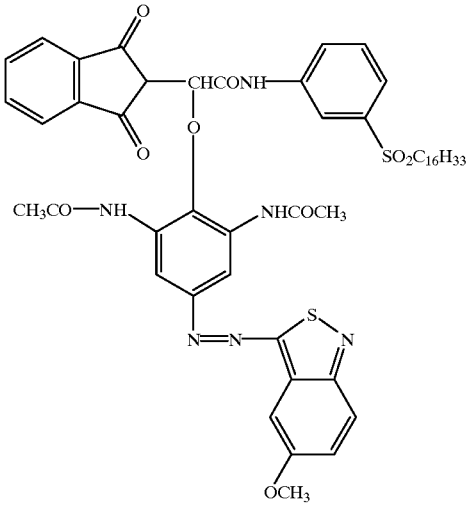
Cp-18
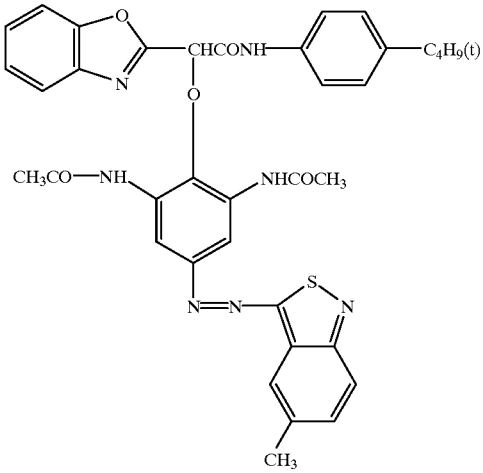

-continued
Cp-19
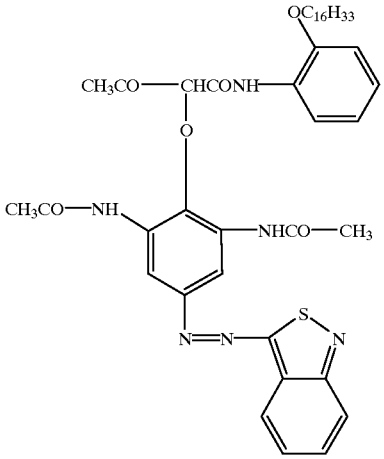
Cp-20
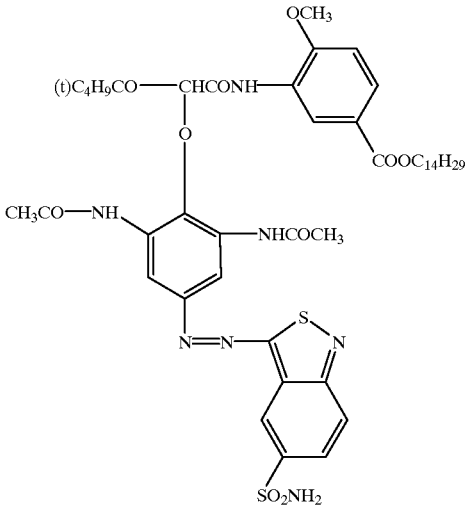
Cp-21
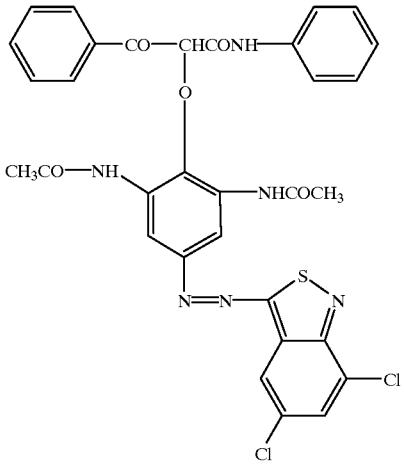

-continued
Cp-22
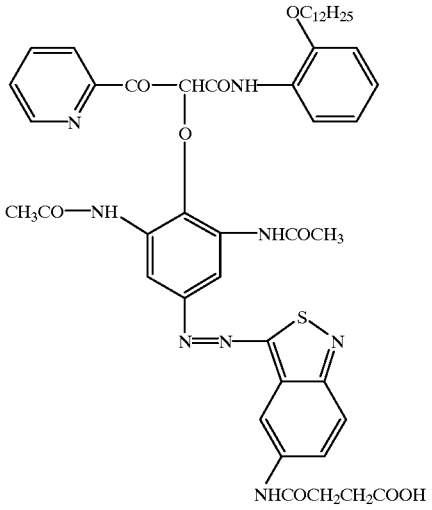
Cp-23
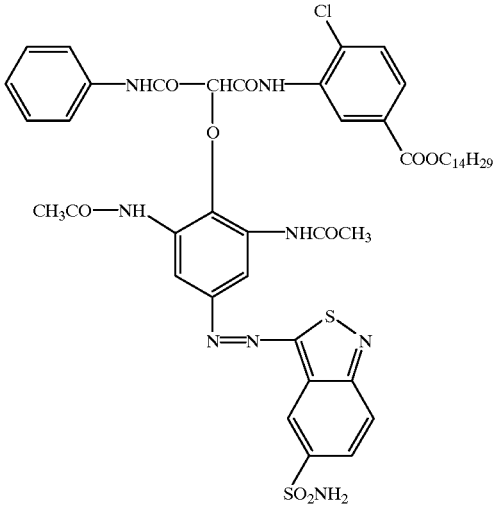
Cp-24
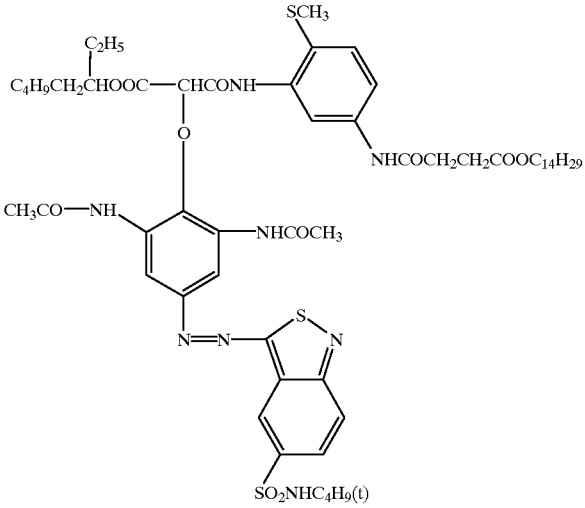

-continued
Cp-25
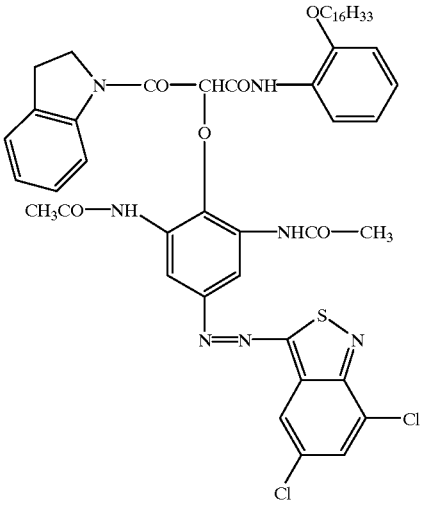
Cp-26
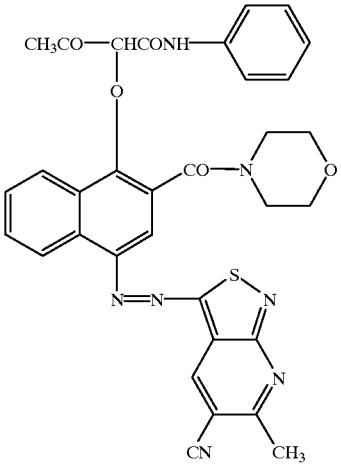
Cp-27
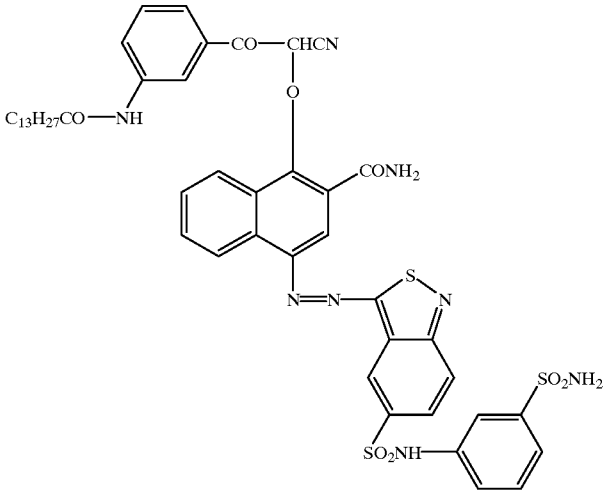

-continued
Cp-28
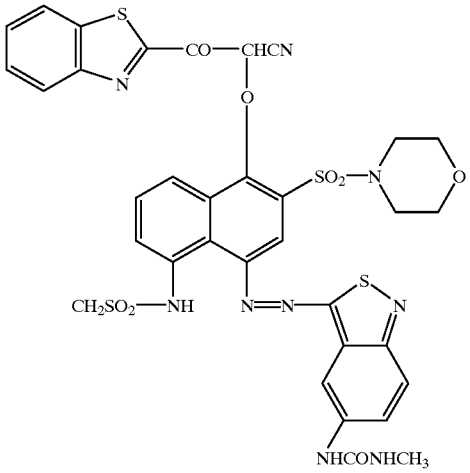
Cp-29
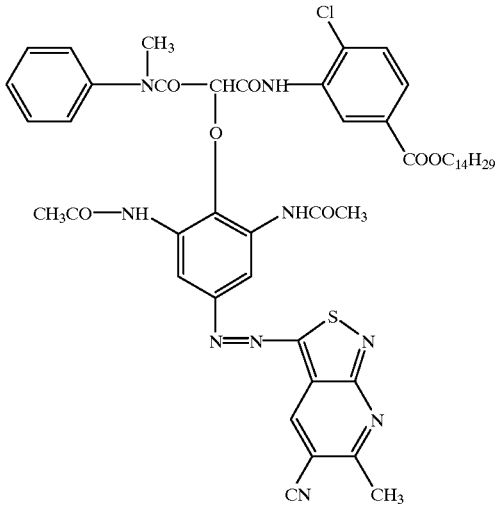
Cp-30
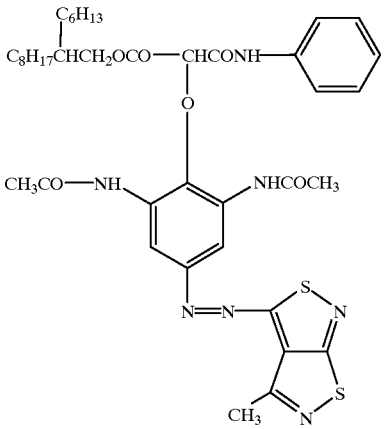

-continued
Cp-31
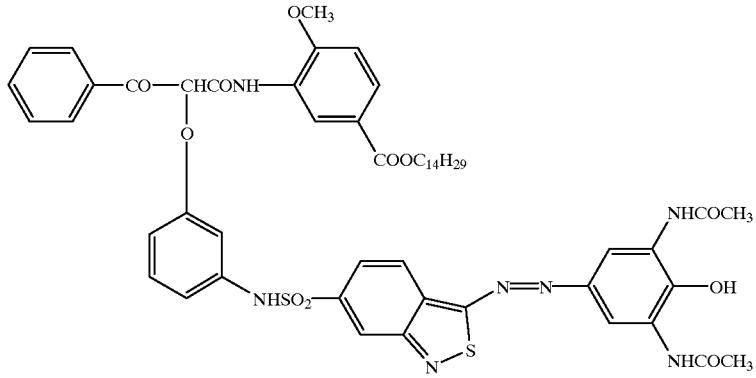
Cp-32
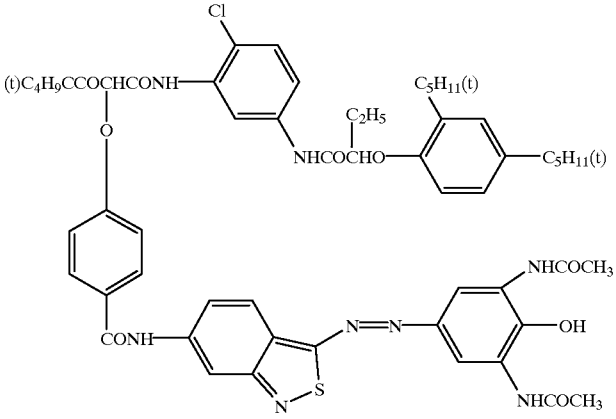
Cp-33
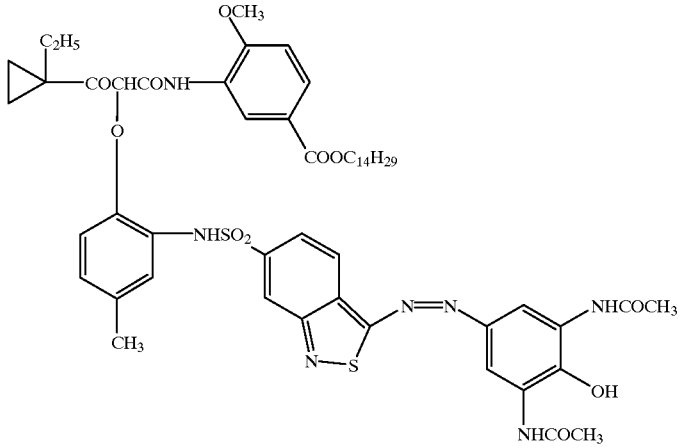

-continued
Cp-34
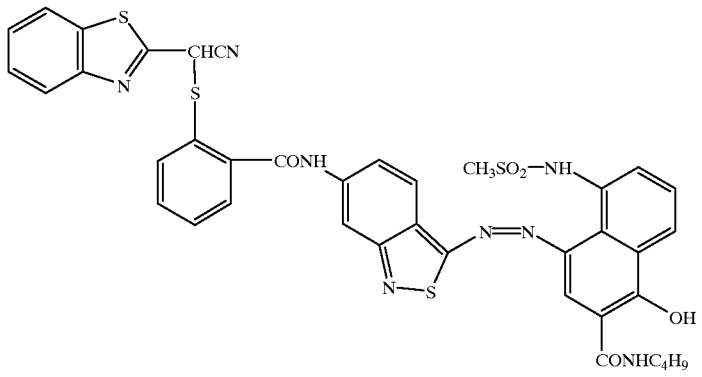
Cp-35
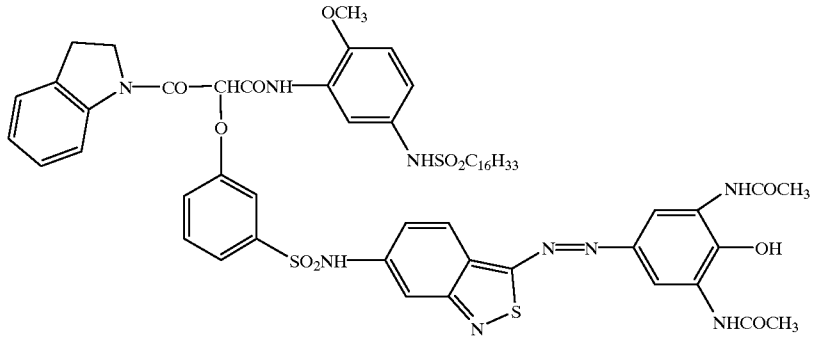
Cp-36
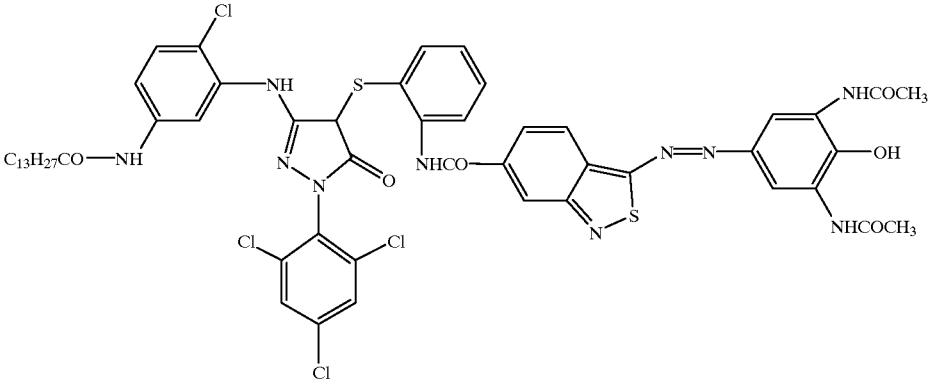
Cp-37
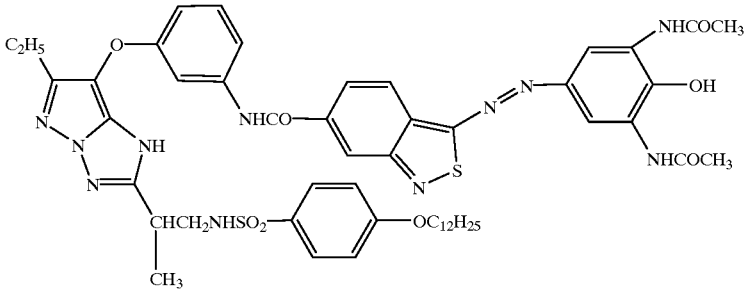

-continued
Cp-38
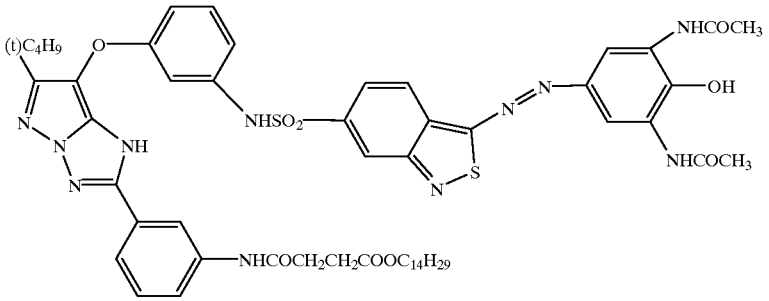
Cp-39
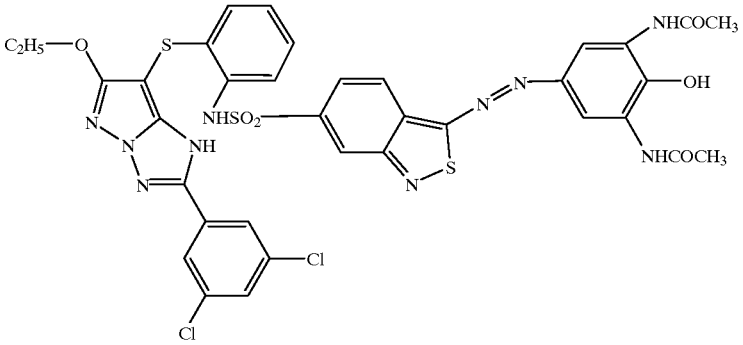
Cp-40
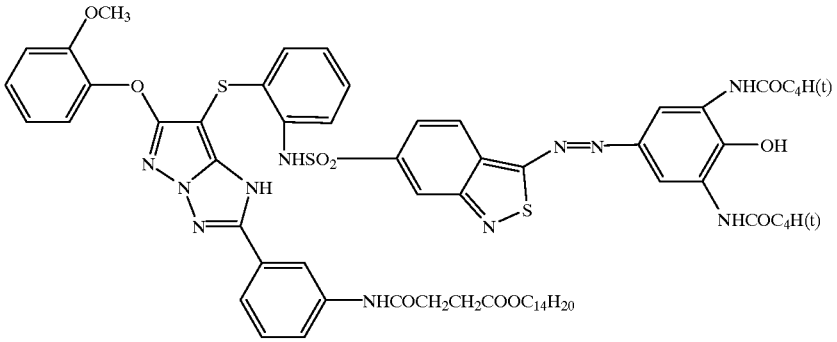
Cp-41
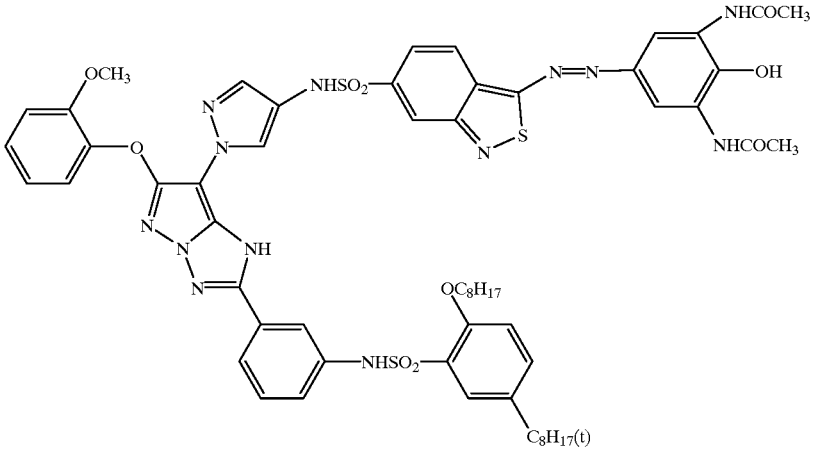

-continued
Cp-42
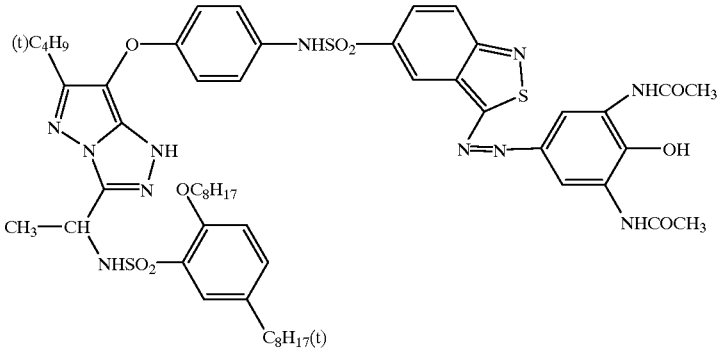
Cp-43
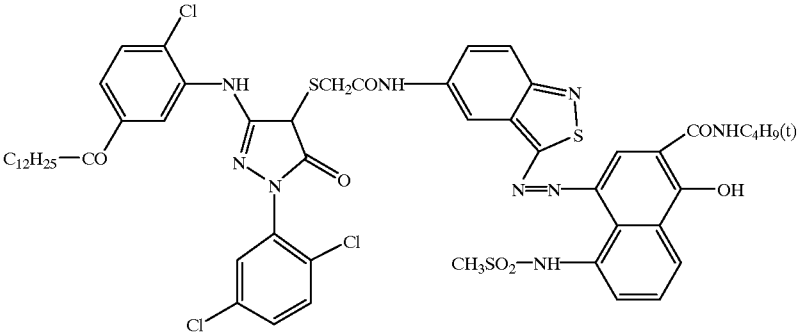
Cp-44
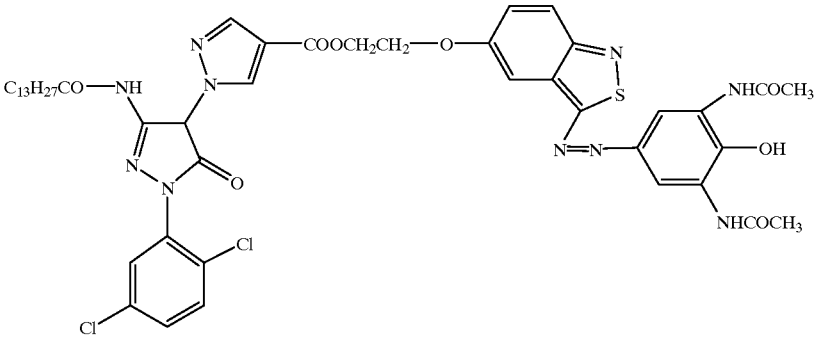
Cp-45
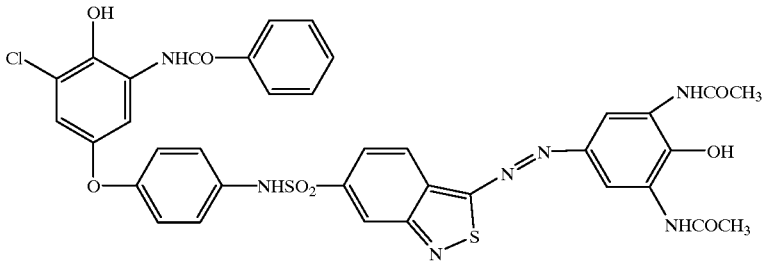
Cp-46
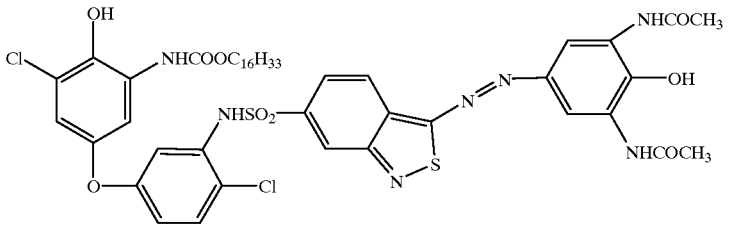

-continued
Cp-47
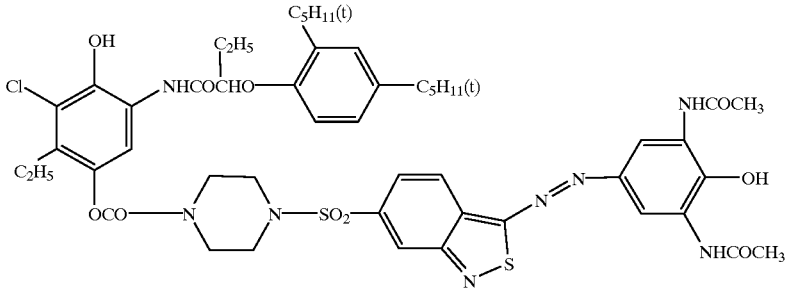
Cp-48
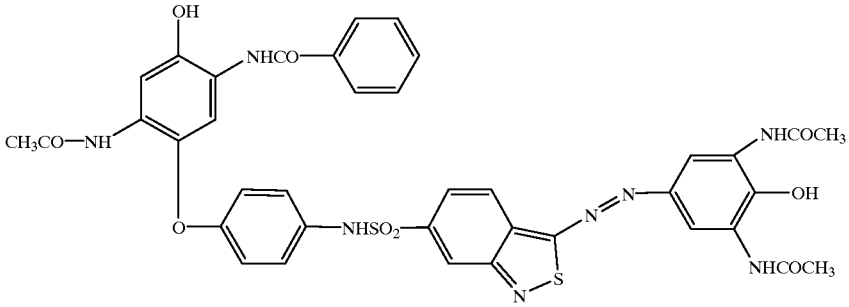
Cp-49
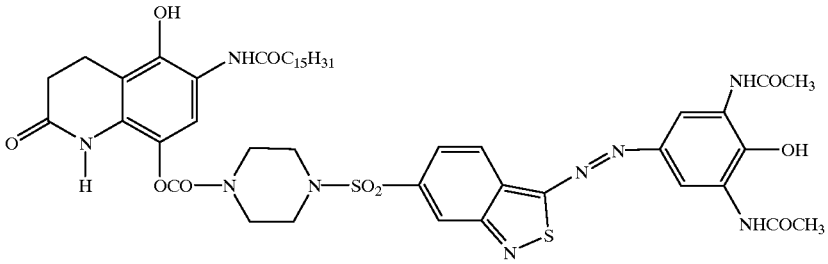
Cp-50
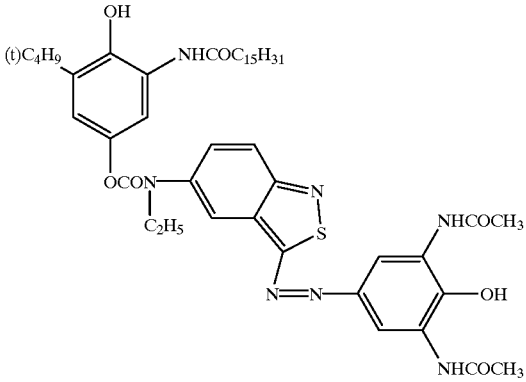

-continued
Cp-51
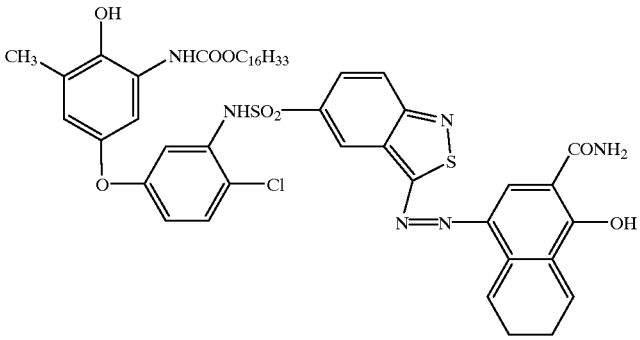
Cp-52
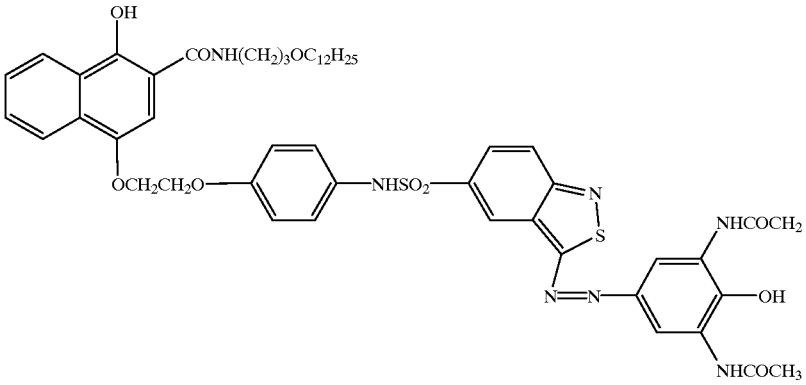
Cp-53
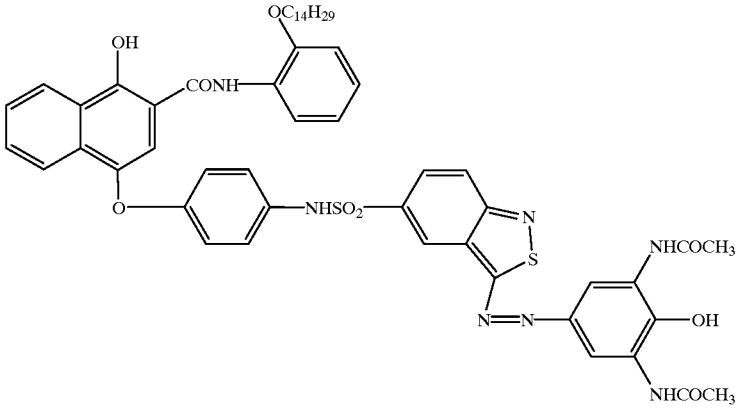
Cp-54
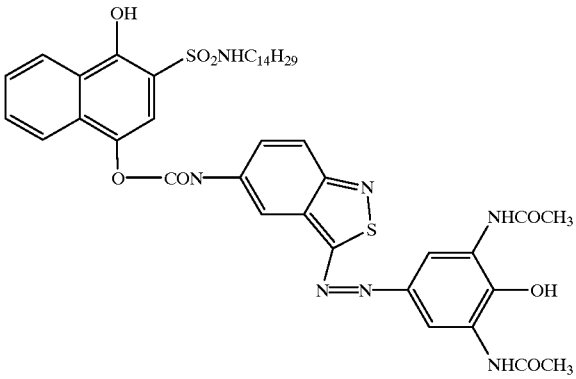

-continued
Cp-55
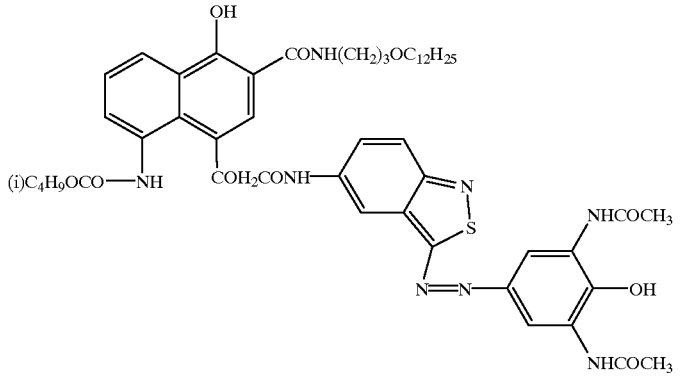
Cp-56
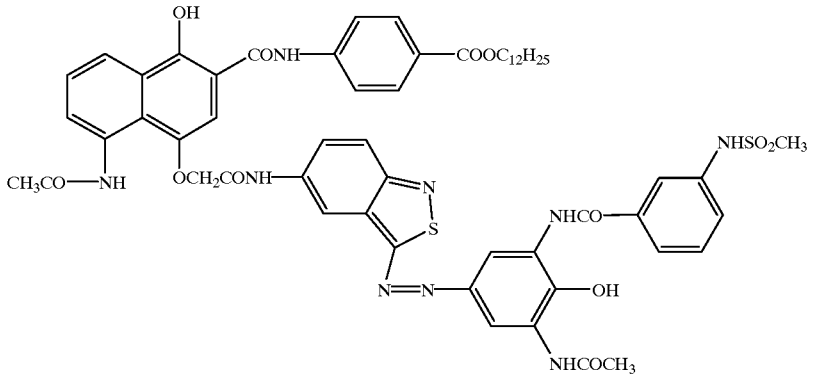
Cp-57
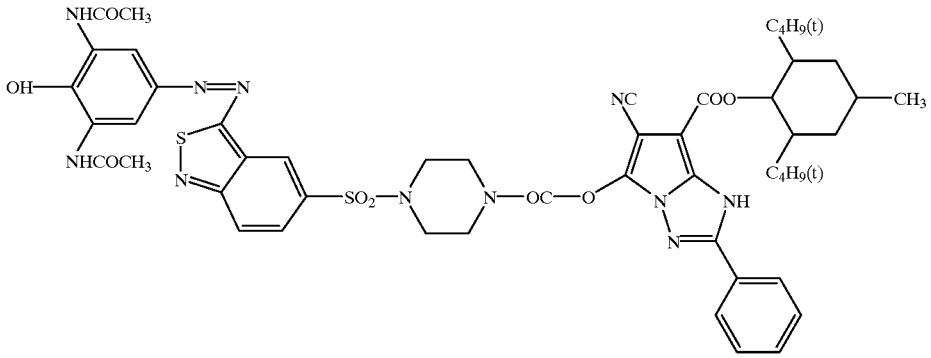
Cp-58
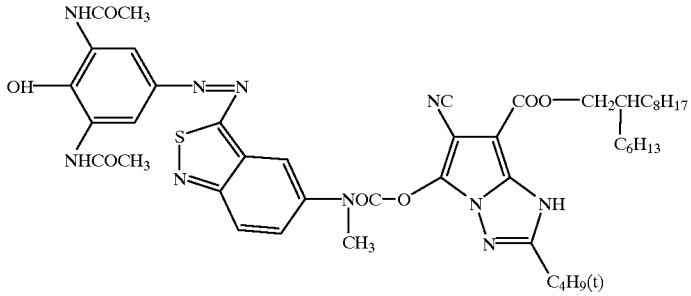

-continued
Cp-59
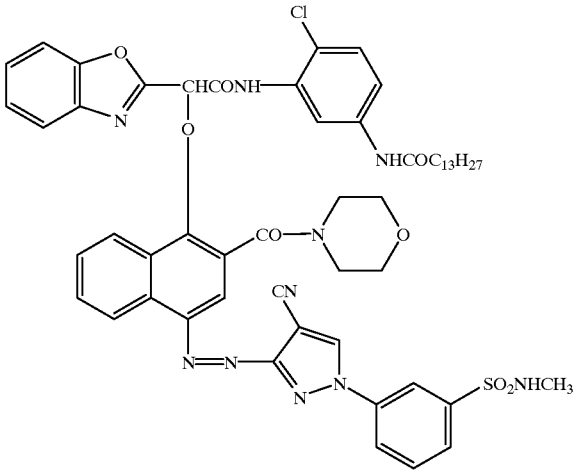
Cp-60
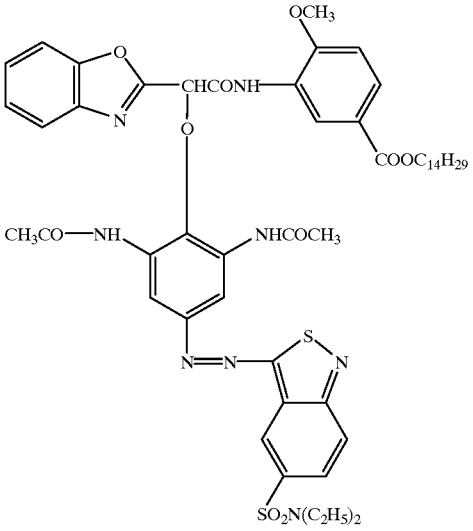
Cp-61
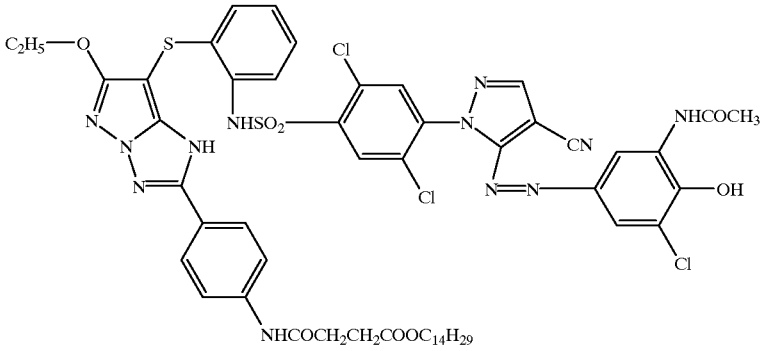

-continued
Cp-62
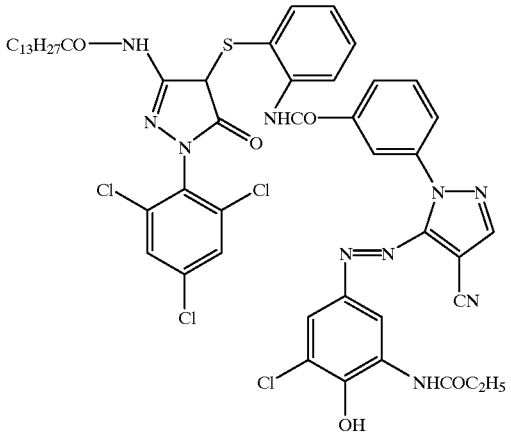
Cp-63
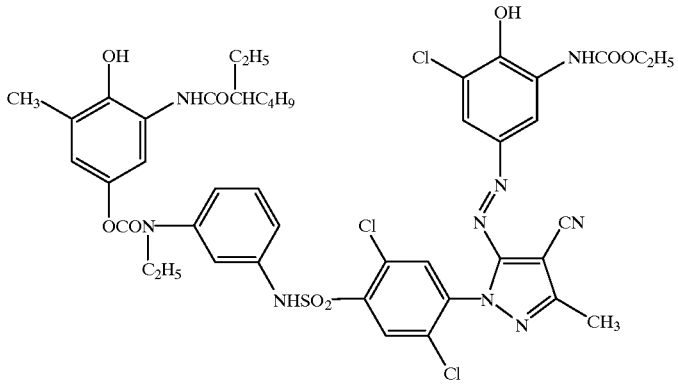
Cp-64
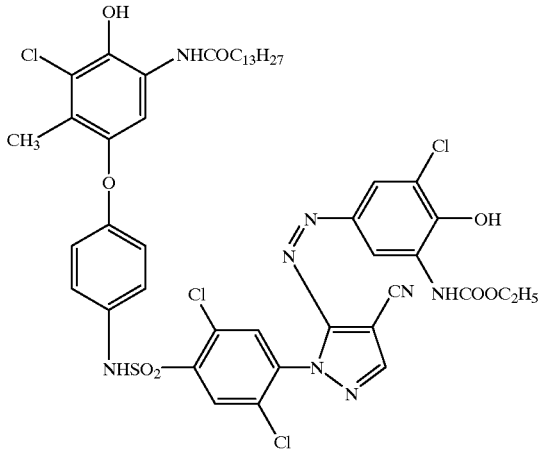
Cp-65
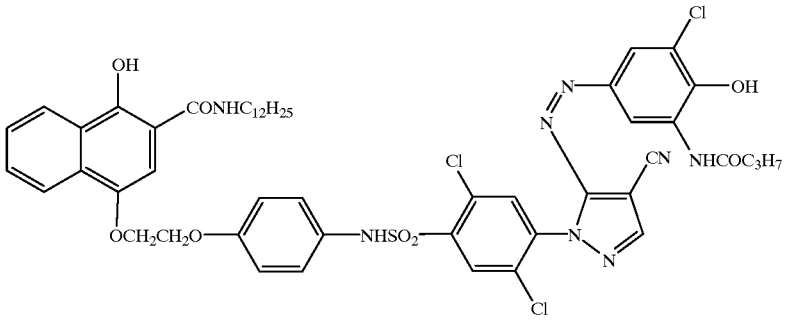

-continued
Cp-66
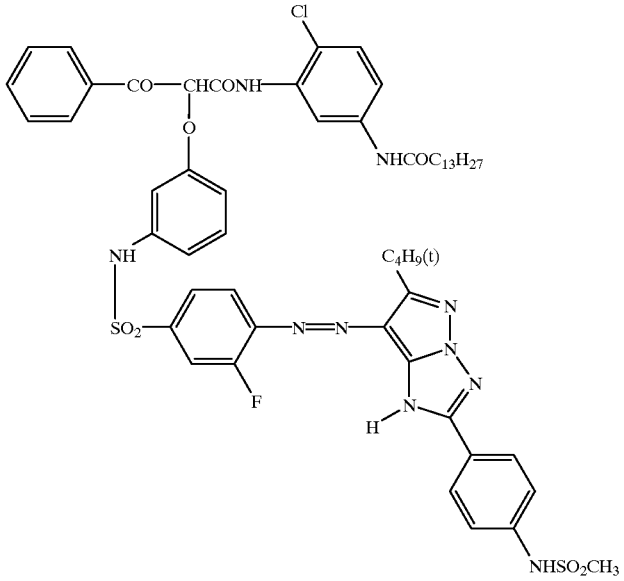
Cp-67
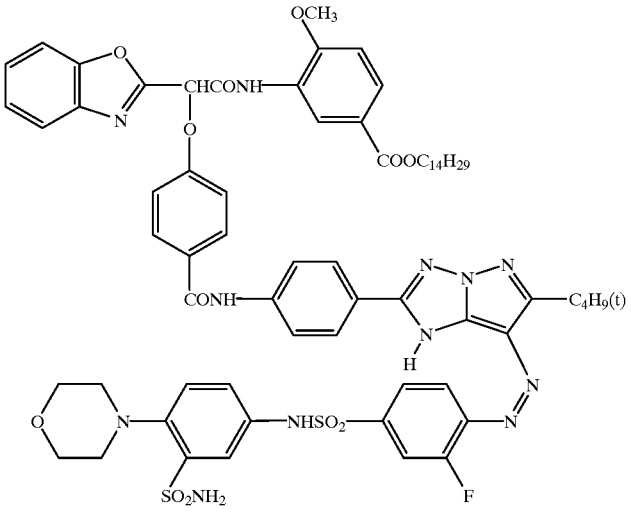
Cp-68
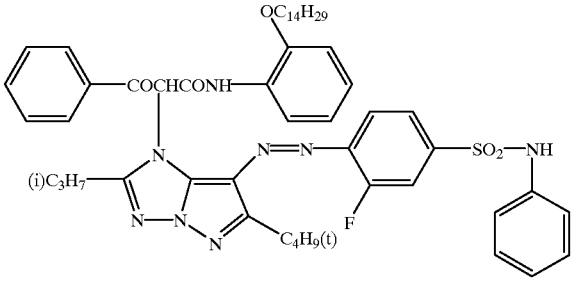

-continued
Cp-69
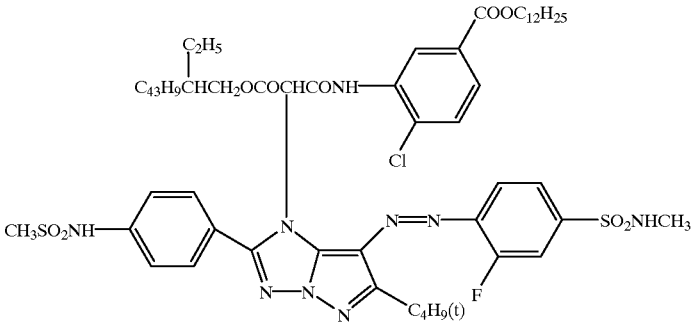
Cp-70
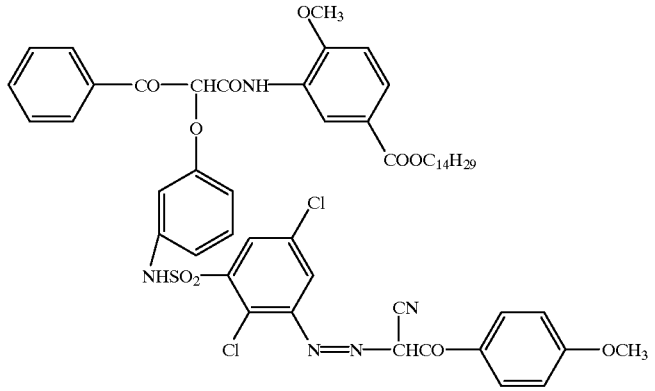
Cp-71
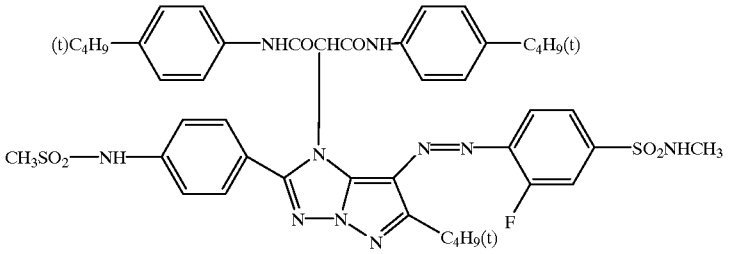
Cp-72
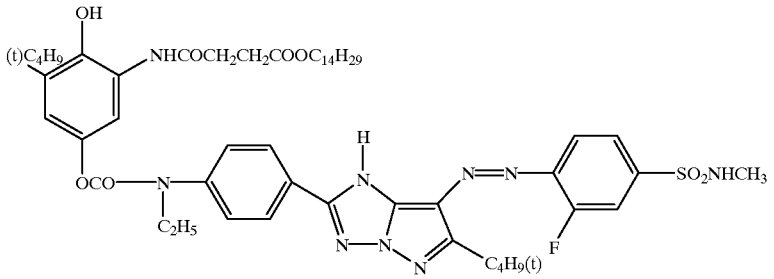

-continued
Cp-73
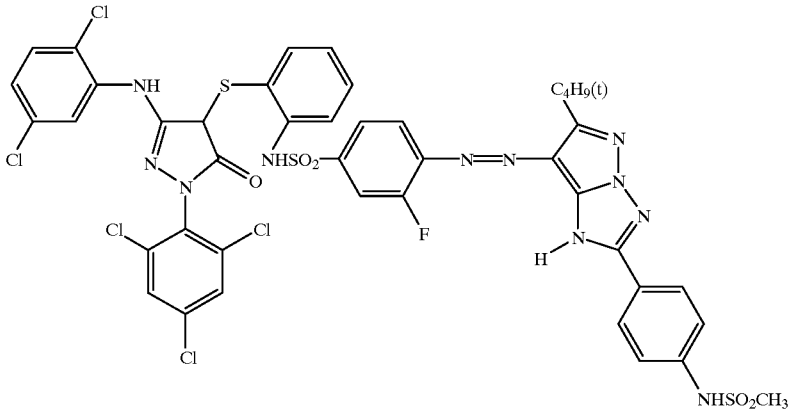
Cp-74
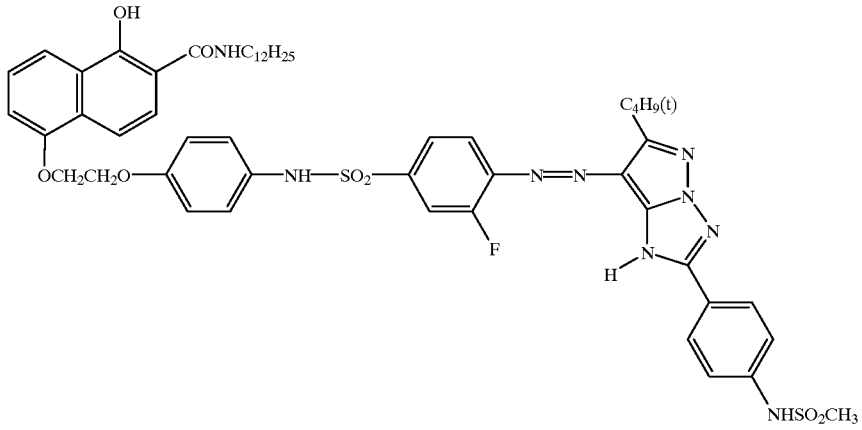
Cp-75
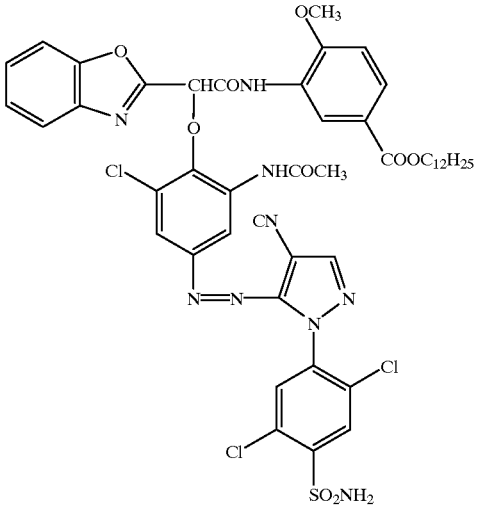

-continued
Cp-76
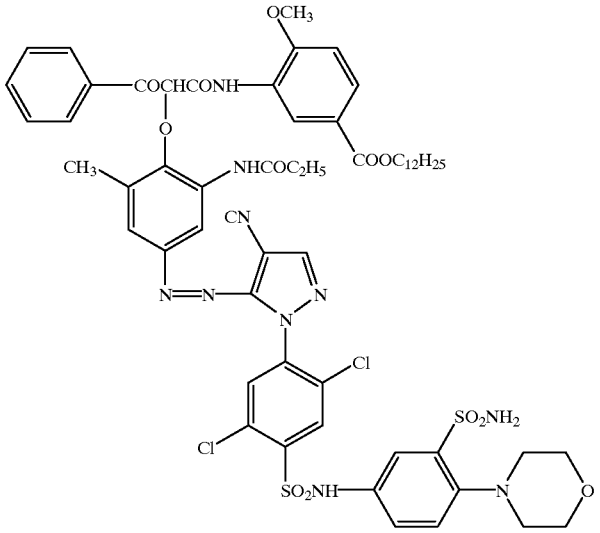
Cp-77
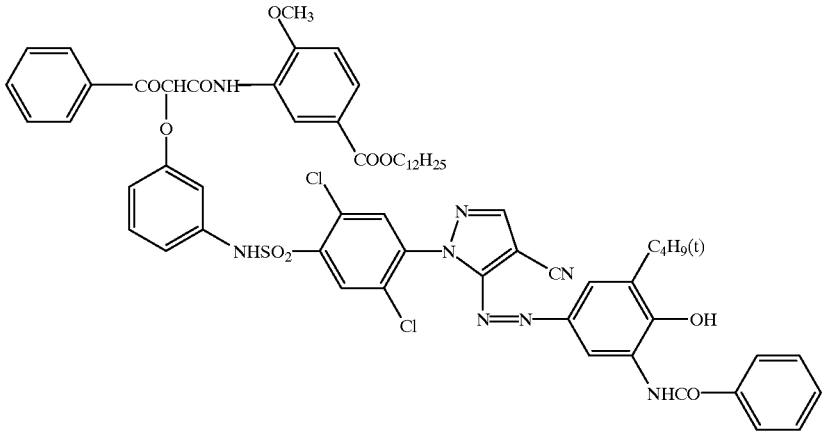
Cp-78
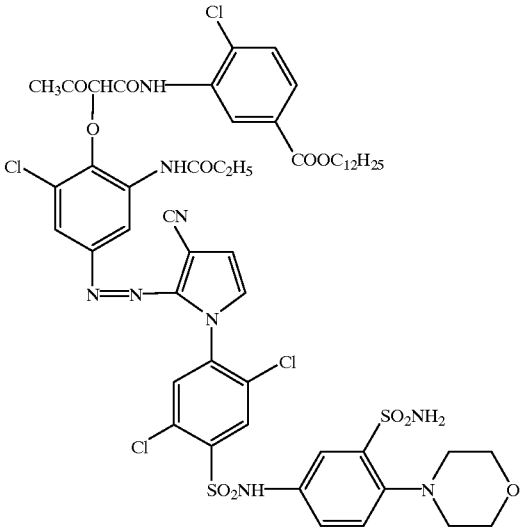

-continued
Cp-79
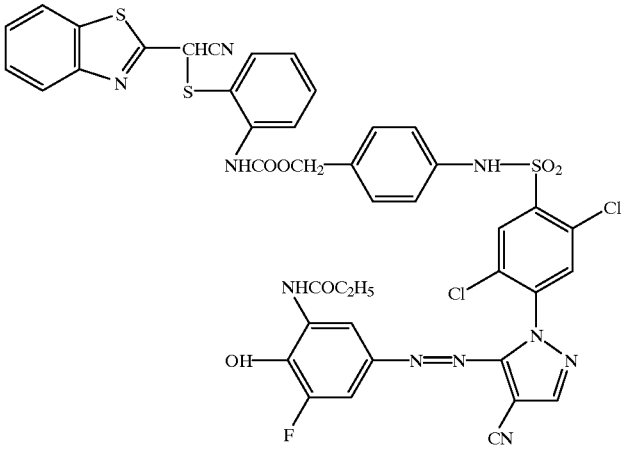
Cp-80
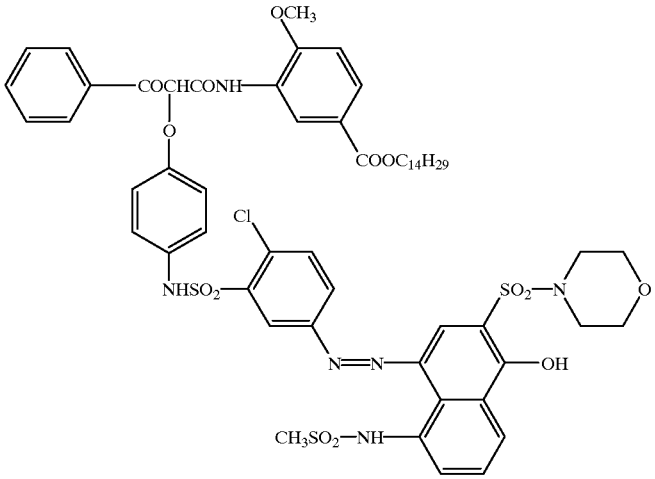
Cp-81
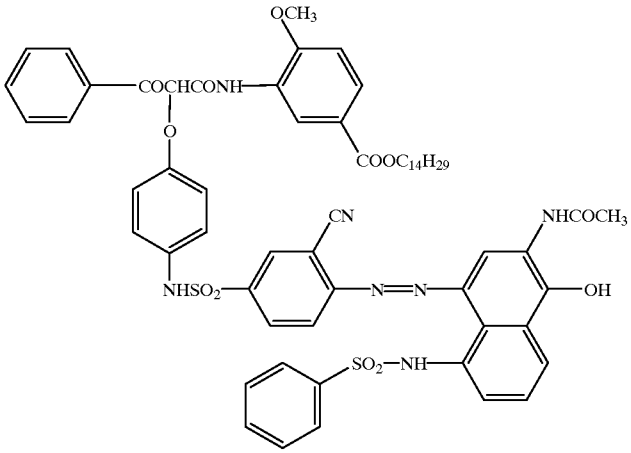

-continued
Cp-82
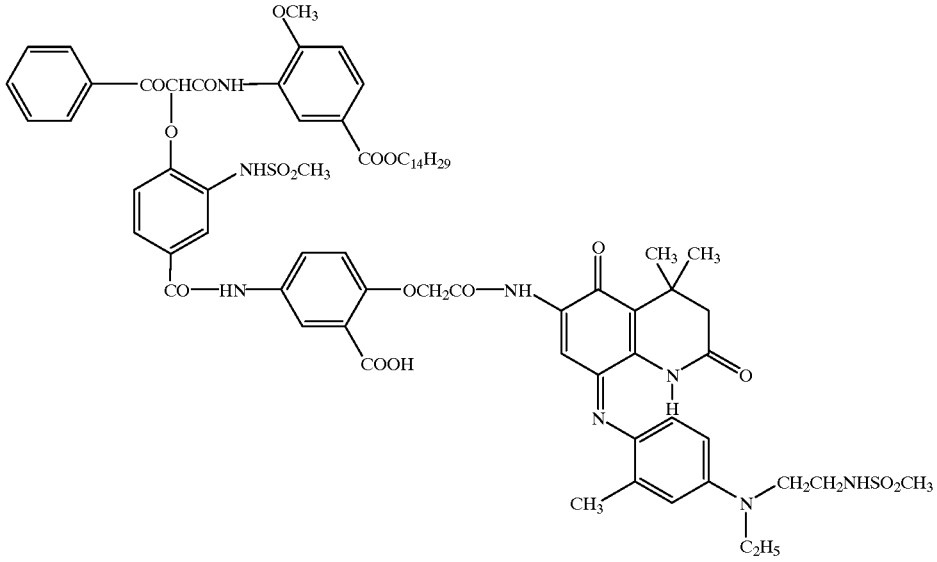
Cp-83
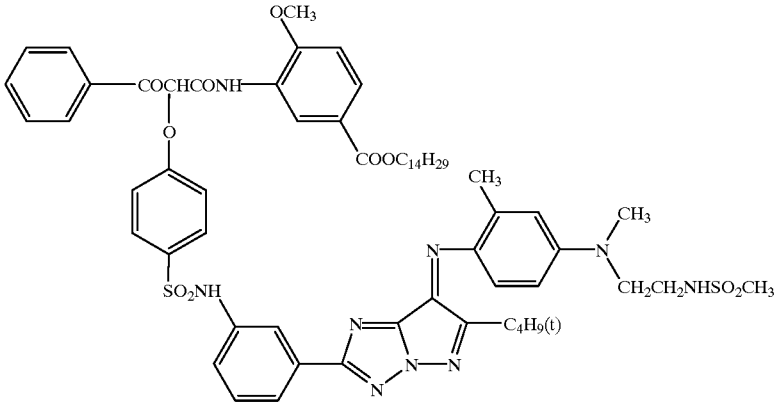
Cp-84
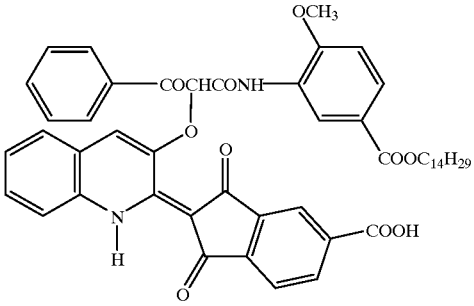

Examples of the synthesis of the compounds represented by the general formula (1) are given below.

SYNTHESIS EXAMPLE 1

<Synthesis of an exemplary Cp-1>

Synthesis was carried out according to the following reaction scheme A.

(Synthesis of an Intermediate A)

550 ml of methanol was added to 92.8 g (0.85 mol) of o-aminophenol and stirred at room temperature. 182 g (0.93 mol) of imino ether hydrochloride (material A) was added to the solution obtained above. The resulting solution was stirred at room temperature for 5 hours. Upon completion of the reaction, the reaction solution was poured into 1500 ml Reaction scheme A

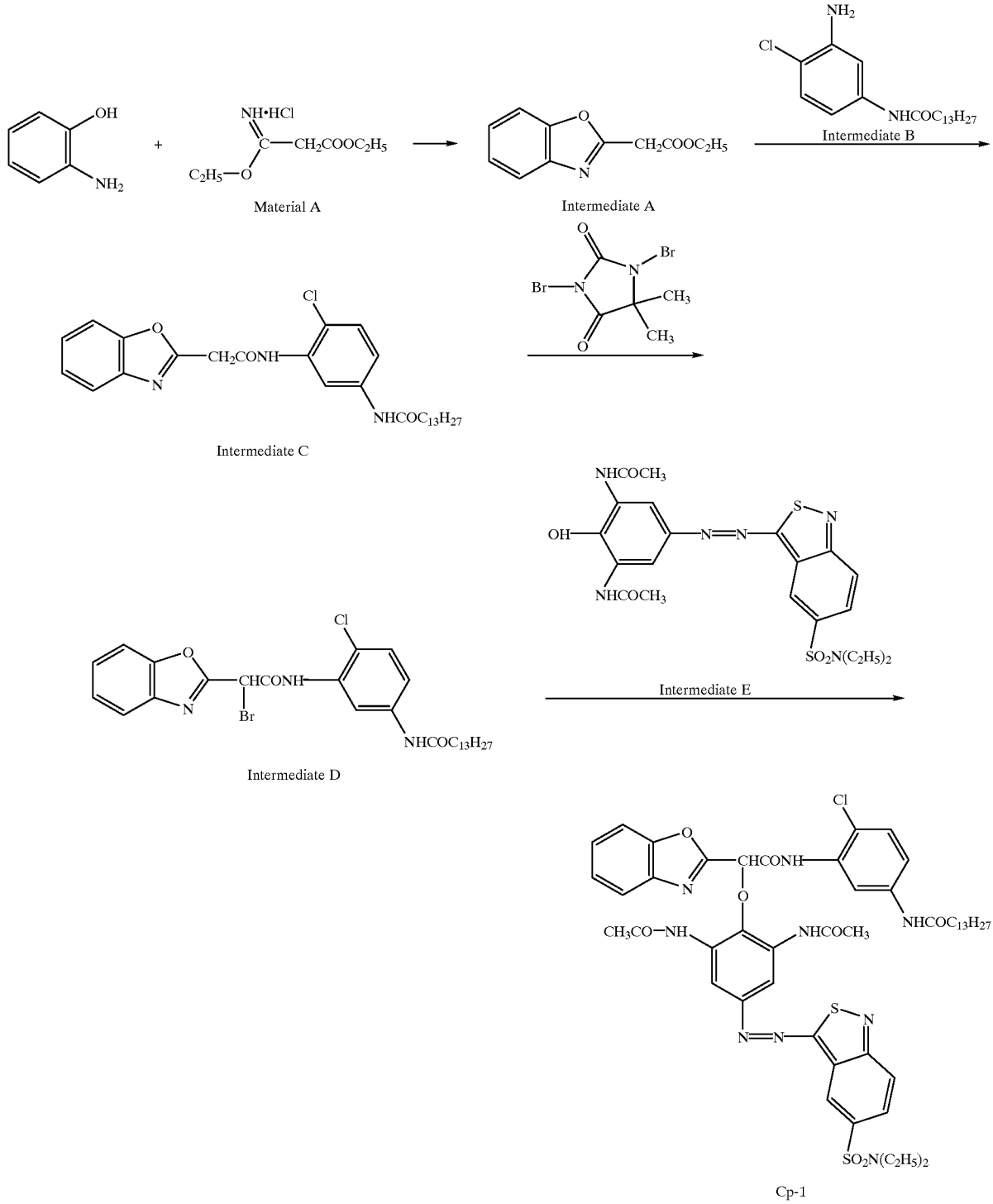

of water and thereafter the reaction product was extracted with ethyl acetate. The ethyl acetate solution was washed with water and thereafter dried with anhydrous magnesium sulfate. The solution thus obtained was subjected to distillation under a reduced pressure to distil off the ethyl acetate. In this way, 158 g (90.6%) of an oily substance, an intermediate A, was obtained.

(Synthesis of an Intermediate C)

13.5 g (0.06 mol) of the intermediate A obtained in the above-described procedure and 18.3 g (0.05 mol) of an aniline-type substance (intermediate B) were heated to a temperature of 140–160° C. and stirred in the absence of a solvent. The heating and mixing were carried out for 3 hours. Upon completion of the reaction, the reaction mixture was cooled to room temperature. Then, methanol was added to the reaction mixture to deposit crystals. The crystals were collected by filtration and thereafter dried. In this way, 25.5 g (97.3%) of an intermediate C was obtained.

(Synthesis of an Intermediate D)

Ethyl acetate was added to 25.2 g (0.047 mol) of the intermediate C obtained in the above-described procedure and stirred at room temperature. Next, 8.51 g (0.047 mol) of N-bromosuccinimide was added in several aliquot portions to the solution thus prepared. After the addition, the reaction solution was stirred for 3 hours at room temperature to carry out the reaction. Upon completion of the reaction, water was added to the reaction solution to wash the ethyl acetate solution. The solution was then subjected to distillation under a reduced pressure to distil off the ethyl acetate. Then, acetonitrile was added to the distillation residue to deposit crystals. The crystals were collected by filtration and thereafter dried. In this way, 18.2 g (63%) of an intermediate D was obtained.

(Synthesis of an Exemplary Compound Cp-1)

25 ml of dimethylacetamide was added to 5.05 g (0.01 mol) of the intermediate E and 1.82 g (0.012 mol) of DBU and stirred at room temperature. Next, 6.02 g (0.01 mol) of the bromine-type substance (intermediate D), which was obtained in the above-described procedure, was added to the solution thus prepared. After the addition, the reaction solution was stirred for 4 hours at room temperature to carry out the reaction. Upon completion of the reaction, a concentrated aqueous hydrochloric acid solution was added to the reaction solution to neutralize the solution. Then, 200 ml of water and 50 ml of ethyl acetate were added to the solution and the resulting solution was stirred at room temperature to thereby deposit crystals. The crystals were collected by filtration and thereafter dried. The crystals were purified by recrystallization from ethyl acetate. In this way, 3.8 g (37.6%) of an exemplary Cp-1 was obtained.

SYNTHESIS EXAMPLE 2

<Synthesis of an exemplary compound Cp-52>

Synthesis was carried out according to the following reaction scheme B.

Reaction scheme B

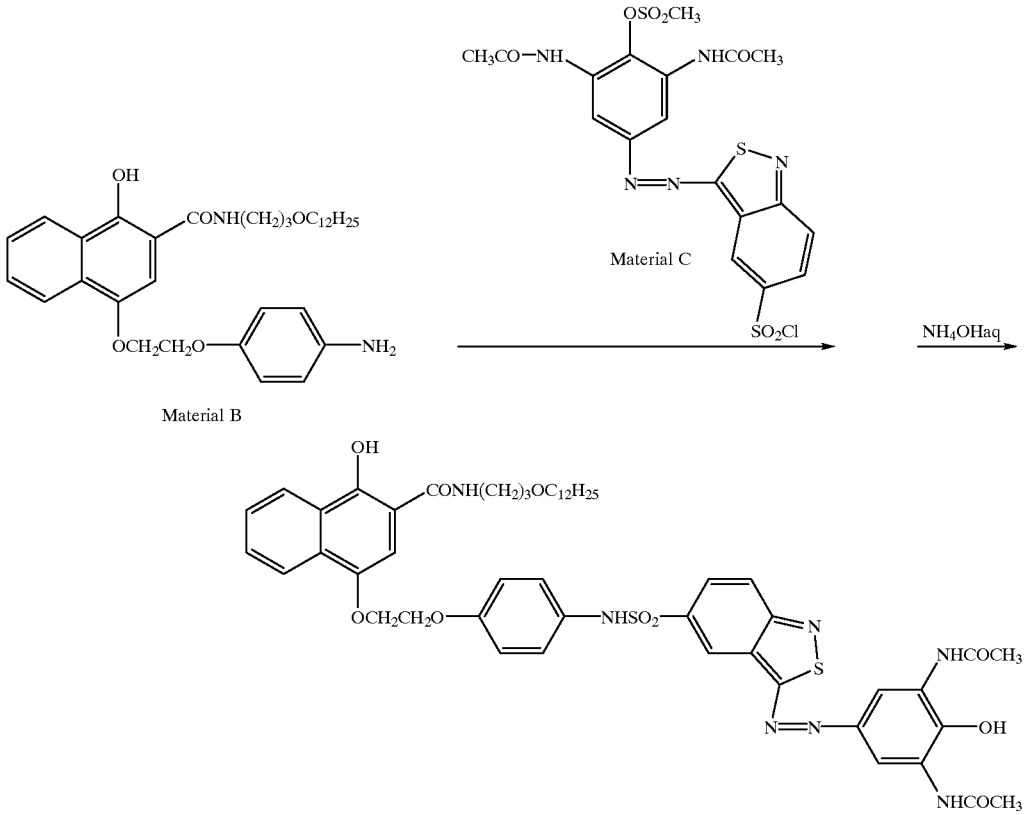

Cp-52

5.65 g (0.01 mol) of an amine-type substance (material B) and 0.97 ml of pyridine were dissolved in 30 ml of dimethylacetamide and the solution was stirred at room temperature. Next, 5.46 g (0.01 mol) of the material C powder was added in several aliquot portions to the solution thus prepared. The reaction solution was subsequently stirred for 4 hours at room temperature to complete the reaction. Upon completion of this reaction, 7.8 ml of a 25% ammonia aqueous solution was added dropwise to the reaction solution and the reaction solution was stirred for one additional hour at room temperature. Upon completion of the reaction, the reaction solution was a dilute aqueous solution of 1N hydrochloric acid to thereby deposit crystals. The crystals were collected by filtration and thereafter dried. The crystals were then subjected to purification by silica gel column chromatography (eluent: chloroform/ethyl acetate=1/1). The eluate was concentrated and methanol was added to the concentrated solution to thereby deposit crystals. The crystals were collected by filtration and thereafter dried. In this way, 7.8 g (78.3%) of an exemplary compound Cp-52 was obtained.

The photosensitive layer contains a substantially colorless coupler. The substantially colorless coupler is a compound which forms or releases a dye by an oxidative coupling reaction with an incorporated color developing agent. In the present invention, a coupler in conventional silver salt photography for use with a p-phenylenediamine developing agent may be used as the incorporated color developing agent. Among these couplers, a so-called "2-equivalent coupler" in which the coupling site is substituted by a leaving group for coupling other than a hydrogen atom is preferred. The 2-equivalent coupler is described, for example, in "Theory of the Photographic Process (4th Ed., T. H. James, Ed., MacMillan, 1977), pp.354–361, "Fundamentals of Photographic Engineering—Non-silver Salt Photography Section", pp.244–258, edited by Photographic Society of Japan, Corona Co., Ltd. (1998), and others.

Examples of the substantially colorless coupler include the couplers represented by the general formulae (1) to (12) described in U.S. Pat. No. 5,976,756 col.28–34. In these couplers, the total number of carbon atoms in the portions excluding Y is preferably not less than 1 and not more than 30, more preferably not less than 1 and not more than 24, and most preferably not less than 1 and not more than 18. Preferred examples of the substantially colorless coupler that can be used are the exemplary compounds (C-1) to (C-5) described in U.S. Pat. No. 5,976,756 col.34–56. U.S. Pat. No. 5,976,756 is incorporated herein by reference.

The term "substantially colorless" as used herein means that, when the coupler is incorporated in a photosensitive material, the coupler does not substantially lower the sensitivity of the photosensitive material at the time of exposure thereof.

In the present invention, the compound represented by the general formula (1) and the substantially colorless compound are incorporated in different layers. In addition, according to this combination, the hue of the diffusive dye, which is formed by a coupling reaction between the substantially colorless compound and the oxidized form of the incorporated color developing agent, and the hue of the diffusive dye (Dye), which is released from the compound represented by the general formula (1), differ from each other. For example, according to a combination, the color of the former dye is yellow or cyan while the color of the latter dye is magenta.

The photosensitive layer contains an incorporated color developing agent. Examples of the incorporated color developing agent that can be used in the present invention include the carbamoylhydrazine-based compounds described in JP-A Nos. 9-152705, 10-142764, and 11-125887. As for the function of the incorporated color developing agent, the oxidized form thereof may undergo a coupling reaction with the substantially colorless coupler to form a diffusive dye. In addition, the oxidized form may function to react with the compound represented by the general formula (1) to cause the release of Dye. Besides, the photosensitive layer may contain more than one incorporated color developing agent in order to correspond with each of the substantially colorless coupler and the compound represented by the general formula (1).

In the present invention, the each of contents of the substantially colorless coupler and the compound represented by the general formula (1) in the photosensitive layer can be determined according to the desired image density, $\epsilon$ of the dye to be formed, and the like. For example, in order to form images having a reflection density of 1.0 or greater, the coupler and the compound contents in the photosensitive layer are respectively 0.001–100 mmol/$m^2$, preferably 0.01–10 mmol/$m^2$, and more preferably 0.05–5.0 mmol/$m^2$, when $\epsilon$ of the dye to be formed by the coupling is approximately in the range from 5,000 to 500,000. On the other hand, the content of the incorporated developing agent in the photosensitive layer can be determined likewise according to the desired image density, $\epsilon$ of the dye to be formed, the content of the coupler, and so on. The molar quantity of the incorporated developing agent is 0.01–100 times, more preferably 0.1–10 times, the molar quantity of the coupler.

The photosensitive layer contains a photosensitive silver halide. Generally, the photosensitive silver halide is sensitized by a sensitizing dye in order to adjust or broaden the photosensitive wavelength region and is introduced usually as a silver halide emulsion, which contains the sensitizing dye and a water-soluble polymer such as gelatin, into the photosensitive layer. Examples of the silver halide, which is contained in the silver halide emulsion, include silver chloride, silver bromide, silver iodobromide, silver chlorobromide, silver chloroiodide, and silver chloroiodobromide. The silver halide emulsion for use in the present invention may be of a surface latent image type or of an internal latent image type. The internal latent image type emulsion is combined with a nucleating agent or a light-fogging agent so as to be used as a direct reversing emulsion. If the silver halide grains contained in the silver halide emulsion of the present invention are composed of a mixture of grains made up of different silver halides, the grain may have a homogeneous intra-grain composition. In addition, it is also preferable that the grain takes a so-called laminate structure made up of a plurality of layers having different halogen compositions inside the grain. Examples of the latter type may include a so-called core/shell type emulsion in which the composition inside grain differs from the composition on grain surface. Besides the laminate structure, also preferable is a structure in which local phases having different halogen compositions are present inside the grain. Preferred examples of such grains may include a grain having a structure in which the face, ridge, or top of a silver halide grain serving as a base is epitaxially joined by a silver halide having a different composition. Furthermore, it is also preferable that such a local phase is formed inside the grain. The silver halide grains constituting the silver halide emulsion may have a monodispersed or polydispersed grain size distribution. For example, as described in JP-A Nos. 1-167743 and 4-223463, methods in which the gradation is adjusted by blending monodispersed emulsions having different grain sizes and sensitivities, are preferably employed. The grain size is preferably 0.1 to 2 μm and most preferably 0.2 to 1.5 μm. The crystal habit of the silver halide grain may be selected from a crystal with a regular structure such as a cube, octahedron, or tetradecahedron, a crystal with a irregular structure such as such as one with a plane having a high aspect ratio, a crystal having a crystal defect such as twin planes, and a mixture of the foregoing.

More specifically, all silver halides prepared by the methods described in the following publications can be used. U.S. Pat. No. 4,500,626, column 50, and U.S. Pat. No. 4,628,021; Journal of Research Disclosure (hereinafter abbreviated as RD) No. 17,029 (1978), No. 17,643 (December, 1978), pp.22–23, No. 18,716 (November, 1979), pp.648, No.307, 105 (November, 1989), pp.863–865; JP-A Nos. 62-253159, 64-13546, 2-236546, and 3-110555; P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964.

The photosensitive silver halide emulsion preferably contains ions of transition metals, such as titanium, iron, cobalt, ruthenium, rhodium, osmium, iridium, and platinum, or typical metal ions, such as zinc, cadmium, thallium, and lead, in the interior or surface of grains for a variety of purposes such as enhancement of sensitivity, sharpening of contrast, improvement of reciprocity failure, improvement of the stability of latent image, and improvement of pressure resistance. These metal ions are introduced as salts or complex salts. Particularly when ions of transition metals are introduced, it is preferable to use these ions as a complex having ammonia, halogen, cyan, thiocyan, nitrosyl, or the like as a ligand, or as a complex having an organic ligand such as imidazole, triazole, pyridine, bipyridine, or the like as a ligand. These ligands are used alone or in combinations of two or more species. In addition, these compounds may be used alone or in combinations of two or more. The amounts added of these compounds vary depending on the purposes of use, but the amounts are generally about $10^{-9}$ to $10^{-3}$ mol per mol of silver halide. When introduced, these compounds may be introduced uniformly into the grain or may be localized inside or on the surface of the grain. More specifically, the emulsions described in JP-A Nos. 2-236542 and 1-116637, Japanese Patent Application No. 4-126629, and others are preferably used.

Such compound as a rhodanate, ammonia, a tetra-substituted thioether compound, an organic thioether derivative described in JP-B No. 47-11386, a sulfur-containing compound described in JP-A No. 53-144319, or the like can be used as a silver halide solvent in the grain forming stage of the photosensitive silver halide emulsion of the present invention.

For other conditions, reference will be made, for example, to P. Glafkides, Chimie et Physique Photographique, Paul Montel, 1967; G. F. Duffin, Photographic Emulsion Chemistry, Focal Press, 1966; V. L. Zelikman et al., Making and Coating Photographic Emulsion, Focal Press, 1964; and the like. That is, an employable method may be any one selected from an acidic method, a neutral method, and an ammonia method. Further, any method selected from a single jet method, a double jet method, and a combination thereof may be used as a method for reacting a soluble silver salt with a soluble halogen salt. A double jet method is advantageously employed for obtaining a monodispersed emulsion. An inverse mixing method in which grains are formed in the presence of an excess of silver ions can also be employed. A so-called controlled double jet method in which pAg of the liquid phase for the formation of silver halide is kept constant can also be employed as a double jet method.

The concentrations, adding amounts, and adding rates of the silver salt and halogen salt to be added may be increased in order to accelerate the growth of the grains (JP-A Nos. 55-142329 and 55-158124, and U.S. Pat. No. 3,650,757). The stirring of the reaction mixture may be effected by any known method. Further, the temperature and pH of the reaction mixture during the formation of silver halide grains may be selected depending on the purposes. The pH ranges preferably from 2.3 to 8.5 and more preferably from 2.5 to 7.5.

In the process for the formation of the photosensitive silver halide emulsion of the present invention, a so-called desalting treatment is preferably performed so as to remove excess of the salts. For this purpose, employable are a noodle washing process in which water-washing is carried out by gelling gelatin; and a precipitation process which utilizes a compound such as an inorganic salt comprising a polyvalent anion (e.g., sodium sulfate), an anionic surfactant, an anionic polymer (e.g., sodium polystyrenesulfonate), or a gelatin derivative (e.g., aliphatic-acylated gelatin, aromatic-acylated gelatin, aromatic-carbamoylated gelatin, or the like). The precipitation process is preferably employed.

Normally, the photosensitive silver halide emulsion is a chemically sensitized silver halide emulsion. For the sensitization of the photosensitive silver halide emulsion of the present invention, a sensitizing method by means of chalcogen, such as sulfur sensitization, selenium sensitization, or tellurium sensitization, a sensitization method by means of a noble metal, such as gold, platinum, or palladium, and a sensitization method by means of reduction, which are all known sensitizing methods, may be used alone or in combination thereof (e.g., JP-A Nos. 3-110555 and 5-241267). These chemical sensitization methods can be performed in the presence of a nitrogen-containing heterocyclic compound (JP-A No. 62-253159). Also, an anti-fogging agent may be added to a silver halide emulsion after the chemical sensitization thereof. More specifically, the methods, which are described in JP-A Nos. 5-45833 and 62-40446, can be used. When a chemical sensitization is carried out, the pH is preferably in the range of 5.3 to 10.5 and more preferably in the range of 5.5 to 8.5, while the pAg is preferably in the range of 6.0 to 10.5 and more preferably in the range of 6.8 to 9.0.

In order to impart color-sensitivity, such as green-sensitivity, red-sensitivity, or infrared-sensitivity, to the photosensitive silver halide, the photosensitive silver halide emulsion is spectrally sensitized by means of a methine dye or the like. Further, if necessary, a blue-sensitive emulsion may be spectrally sensitized in order to increase sensitivity to a blue color region. Examples of dyes employable in spectral sensitization include cyanine dyes, merocyanine dyes, complex cyanine dyes, complex merocyanine dyes, holopolar cyanine dyes, hemicyanine dyes, styryl dyes, and hemioxonol dyes. More specific examples of these sensitizing dyes are disclosed in, for example, U.S. Pat. No. 4,617,257, and JP-A Nos. 59-180550, 64-13546, 5-45828, and 5-45834. Although these sensitizing dyes may be used alone, they may also be used in a combination thereof. A combination of these sensitizing dyes is often used particularly for supersensitization or for wavelength adjustment of spectral sensitivity. The photosensitive silver halide emulsion may contain, together with the sensitizing dye, a compound which is a dye having no spectral sensitization effect in itself or a compound substantially incapable of absorbing visible light but which exhibits a supersensitizing effect (these compounds are described in, for example, U.S. Pat. No. 3,615,641 and JP-A No.63-23145). These sensitizing dyes may be added to the emulsion at the stage of chemical ripening or thereabout, or before or after the formation of the nuclei of the silver halide grains in accordance with the descriptions in U.S. Pat. Nos. 4,183,756 and 4,225,666. These sensitizing dyes or supersensitizers may be added to the emulsion as a solution in an organic solvent, such as methanol, as a dispersion in gelatin, or as a solution of a surfactant. The amount to be added is generally in the range of $10^{-8}$ to $10^{-2}$ mol per mol of silver halide.

The coating weight of the photosensitive silver halide emulsion is preferably in the range of 1 mg to 10 g/m$^2$, more preferably in the range of 10 mg to 10 g/m$^2$, based on the weight of silver.

The photosensitive layer contains a binder. The binder is preferably a hydrophilic material. Examples of the binder may include those described in the aforesaid Research Disclosure and in JP-A No.64-13546, pp.71–75. More specifically, the binder is preferably a transparent or translucent hydrophilic material, exemplified by a naturally occurring compound, such as a protein including gelatin and a gelatin derivative, and a polysaccharide including a cellulose derivative, starch, gum arabic, dextran, and pullulan, and by a synthetic polymer such as polyvinyl alcohol, polyvinyl pyrrolidone, and an acrylamide polymer. Also usable as the binder is a highly water-absorbent polymer described in U.S. Pat. No. 4,960,681, JP-A No. 62-245260, and others. For example, a homopolymer composed of a vinyl monomer having —COOM or —$SO_3M$ (M stands for a hydrogen atom or an alkali metal), or a copolymer obtained by a combination of these vinyl monomers or by a combination of any of these vinyl monomers and another vinyl monomer such as sodium methacrylate or ammonium methacrylate (e.g., SUMIKAGEL L-5H manufactured by Sumitomo Chemical Co., Ltd.). These binders may be used alone or in combinations of two or more types. In particular, a combination of gelatin and any of the above-mentioned polymeric compounds is preferable. As to the gelatin, depending on the purposes, it may be selected fromlime-treated gelatin, acid-treated gelatin, and delimed gelatin which has undergone a deliming treatment to decrease the content of calcium. Alternatively, the use of a combination of these treated gelatin substances is also preferable.

In the case where a system involving heat development by use of a small amount of water is adopted, the use of the above-mentioned highly water-absorbent polymer as the binder makes it possible to rapidly absorb water. Further, the use of the above-mentioned highly water-absorbent polymer in the dye-fixing layer or protective layer thereof prevents the dye after transfer from being transferred again from the dye-fixing element to other elements.

The coating weight of the binder is preferably 20 g or less per m$^2$, more preferably 10 g or less per m$^2$, and most preferably 7 to 0.5 g per m$^2$.

An organic metal salt may be used as an oxidizing agent together with a photosensitive silver halide emulsion in the photosensitive layer. Among these organic metal salts, an organic silver salt is particularly preferable. Examples of the organic compounds which can be used for the preparation of the above-mentioned organic silver salts based oxidizing agents include benzotriazoles, fatty acids, and other compounds described in U.S. Pat. No. 4,500,626, columns 52–53. The silver acetylide, which is described in U.S. Pat. No. 4,775,613, is also useful. These organic silver salts may be used alone or in combination of two or more species. The above-mentioned organic silver salt can be used in an amount ranging from 0.01 to 10 mol, preferably from 0.01 to 1 mol, per mol of the photosensitive silver halide. The total coating weight of the photosensitive silver halide emulsion and the organic silver salt is preferably in the range of 0.05 mg to 10 g/m$^2$, more preferably 0.1 g to 4 g/m$^2$, based on the weight of silver.

The photosensitive layer may contain a reducing agent. The reducing agent functions to accelerate development. Examples of such reducing agents may include reducing agents known in the field of a photosensitive material for heat development. In addition, a dye-releasable compound may be used as the reducing agent (in this case, other reducing agent may be used together with the dye-releasable compound). Furthermore, a reducing agent precursor, which itself has no reducing capability but is given a reducing capability by the action of a nucleophilic reagent or heat in the developing process, can also be used. Examples of the reducing agents usable in the present invention include the reducing agents and reducing agent precursors described in U.S. Pat. No. 4,500,626, columns 49–50, U.S. Pat. Nos. 4,839,272, 4,330,617, 4,590,152, 5,017,454, and 5,139,919; JP-A Nos.60-140335, pp.17–18, 57-40245, 56-138736, 59-178458, 59-53831, 59-182449, 59-182450, 60-119555, 60-128436, 60-128439, 60-198540, 60-181742, 61-259253, 62-201434, 62-244044, 62-131253, 62-131256, 63-10151, 64-13546, pp.40–57, 1-120553, 2-32338, 2-35451, 2-234158, and 3-160443; and European Patent No. 220,746, pp.78–96.

Furthermore, combinations of reducing agents, which are disclosed in U.S. Pat. No. 3,039,869, can also be used.

In the case where a diffusion-resistant reducing agent is used, an electron transport agent and/or a precursor thereof may be used in combination with the diffusion-resistant reducing agent, if necessary, so as to accelerate the electron transfer between the diffusion-resistant reducing agent and developable silver halides. Particularly preferable examples of these compounds for use in the present invention may include those described in above-mentioned U.S. Pat. No. 5,139,919, European Patent Laid-Open No.418,743, JP-A Nos. 1-138556, and 3-102353. Also suitable for use are the methods, described in JP-A Nos. 2-230143 and 2-235044, in which these compounds are introduced into layers in a stable manner. The electron transport agent or a precursor thereof may be selected from the reducing agents or precursors thereof listed previously. The mobility of the electron transport agent or precursor thereof is desirably larger than that of the diffusion-resistant reducing agent (i.e., electron donor). Particularly useful electron transport agents are 1-phenyl-3-pyrazolidone based compounds or aminophenol-based compounds. The diffusion-resistant reducing agent (i.e., electron donor) for use in combination with the electron transport agent may be one which is selected from the reducing agents listed previously and which has substantially no mobility in the layer of the photosensitive material. Preferable examples of such reducing agents include hydroquinones, sulfonamidephenols, sulfonamidenaphthols, the compounds described as electron donors in JP-A No. 53-110827, U.S. Pat. Nos. 5,032,487, 5,026,634, and 4,839,272, and dye-releasable compounds which are described later and characterized by a diffusion-resistant property and a reducing capability.

A precursor of an electron donor, described in JP-A No. 3-160443, is also suited for use in the present invention. For such purposes as prevention against color mixing of an intermediate or protective layer, improvement of color reproduction, improvement of whiteness of white background, and prevention of silver from being transferred to dye fixing materials, the above-described reducing agents can be used. Specifically, the reducing agents, which are described in European Patent Laid-Open Nos. 524, 649 and 357,040, and JP-A Nos. 4-249245, 2-64633, 2-46,450, and 63-186240, are preferably used. Also usable are reductive compounds capable of releasing a development inhibitor which are described in JP-B No. 3-63733, JP-A Nos. 1-150135, 2-110557, 2-64634, and 3-43735, and European Patent Laid-Open No. 451, 833.

In the present invention, the total amount added of the reducing agent is 0.01 to 20 mol, preferably 0.1 to 10 mol, per mol of silver.

The reducing agent is preferably incorporated in the color photosensitive material for heat development, but it may be supplied from an external source by, for example, diffusion from a dye-fixing material which is described later.

In a system in which images are formed by the diffusion transfer of dyes, a variety of compounds may be added to the photosensitive layer or other constituent layers of the color photosensitive material for heat development of the present invention in order to immobilize or decolorize unnecessary dyes or colored substances for the purpose of improving whiteness of the white background of the image to be obtained. More specifically, compounds described in European Patent Laid-Open Nos. 353,741 and 461,416, and JP-A Nos. 63-163345 and 62-203158 can be used.

In the photosensitive layer or other constituent layers of the color photosensitive material for heat development of the present invention, a variety of pigments or dyes may be used to improve color separation or to raise sensitivity.

More specifically, usable for such purposes are compounds described in the aforesaid Research Disclosure as well as compounds or layer structures described in European Patent Laid-Open Nos. 479,167 and 502,508, JP-A Nos. 1-167838, 4-343355, 2-168252, and 61-20943, European Patent Laid-Open Nos. 479,167 and 502,508, and others.

It is possible to use a plasticizer, a slicking agent, or an organic solvent having a high boiling point as an agent to improve the peelability of the color photosensitive material in the photosensitive layer and/or other constituent layers of the photosensitive material for heat development of the present invention. Specific examples of the plasticizer, slicking agent, and organic solvent include those described in the aforesaid Research Disclosure, JP-A No. 62-245253, and others.

In addition, for the above-described purpose, a variety of silicone oils (all types of silicone oils including not only a dimethylsilicone oil but also a modified silicone oil having various organic groups introduced into dimethylsiloxane) can also be used. Examples of the silicone oil include various modified silicone oils, carboxy-modified silicone (trade name: X-22-3710) in particular, described in a technical publication "Modified Silicone Oils", pp. 6–18B, issued from Shin-Etsu Silicone Co., Ltd. Also useful are silicone oils described in JP-A Nos. 62-215953 and 63-46449.

The photosensitive layer and/or other constituent layers of the color photosensitive material for heat development of the present invention may contain a hardener. Examples of the hardener include the hardeners described in the aforesaid Research Disclosure, U.S. Pat. No. 4,678,739, column 41, and U.S. Pat. No. 4,791,042, JP-A Nos. 59-116655, 62-245261, 61-18942, and 4-218044, and others. More specifically, examples of these hardeners include aldehydes (e.g., formaldehyde), aziridines, epoxies, vinylsulfones (e.g., N,N'-ethylene-bis(vinylsulfonylacetamide) ethane), N-methylol compounds (e.g., dimethylolurea), and polymeric compounds (e.g., compounds described in JP-A No. 62-234157 and others). The amount to be added of the hardener is preferably in the range of 0.001 g to 1 g, more preferably 0.005 to 0.5 g, per gram of gelatin if gelatin is used as the binder. The hardener may be added to any one layer of the constituent layers of the photosensitive material, or aliquot portions of the hardener may be added to two or more layers of these materials.

The photosensitive layer and/or other constituent layers of the color photosensitive material for heat development of the present invention may contain an anti-fogging agent or a photographic stabilizer as well as a precursor thereof, examples of which include the compounds described in the aforesaid Research Disclosure, U.S. Pat. Nos. 5,089,378, 4,500,627 and 4,614,702, JP-A No.64-13564, pp.7–9, pp.57–71, and pp. 81–97, U.S. Pat. Nos.4,775,610, 4,626,500, and 4,983,494, JP-A Nos.62-174747, 62-239148, 63-2647474, 1-150135, 2-110557, and 2-178650, RD 17,643 (1978) pp. 24–25, and others. The amounts to be used of these compounds are preferably in the range of $5\times10^{-6}$ to $1\times10^{-1}$ mol, more preferably $1\times10^{-5}$ to $1\times10^{-2}$ mol, per mol of silver.

A variety of surfactants can be used in the photosensitive layer and/or other constituent layers of the color photosensitive material for heat development of the present invention for such purposes as coating aids, improvement of peelability, improvement of sliding property, prevention of electrostatic charge, and acceleration of development. Specific examples of the surfactant are described in the aforesaid Research Disclosure, JP-A No.62-173463, 62-183457, and others. In addition, for such purposes as improvement of sliding property, prevention of electrostatic charge, and improvement of peelability, an organic fluorine-containing compound may be incorporated in the photosensitive layer and/or other constituent layers of the photosensitive material for heat development of the present invention. Typical examples of the organic fluorine-containing compound include a fluorine-containing surfactant and a hydrophobic fluorine-containing compound such as an oily fluorine compound, e.g., fluorocarbon oil, and a solid fluorine-containing resin, e.g., tetrafluoroethylene, described in JP-B No. 57-9053, columns 8–17, JP-A Nos. 61-20944 and 62-135826, and others.

A matting agent may be used in the photosensitive layer and/or other constituent layers of the color photosensitive material for heat development of the present invention for such purposes as prevention of adhesion, improvement of sliding property, and surface matting. Examples of the matting agent include the compounds such as silicon dioxide, polyolefin, and polymethacrylate, described in JP-A No. 61-88256, pp.29, as well as compounds such as benzoguanamine resin beads, polycarbonate resin beads, and AS resin beads, described in JP-A Nos. 63-274944 and 63-274952. In addition, the compounds described in the aforesaid Research Disclosure can be used. The matting agent can be added not only to the uppermost layer (protective layer) but also to an underlayer, if necessary. Further, the photosensitive layer and/or other constituent layers of the photosensitive material for heat development of the present invention may contain a thermal solvent, a defoaming agent, an antibacterial/mildewproofing agent, colloidal silica, and so on. Specific examples of these additives are described in JP-A No. 61-88256, pp. 26–32, JP-A No. 3-11338, JP-B No. 2-51496, and others.

The photosensitive layer and/or other constituent layers of the color photosensitive material for heat development of the present invention may contain an image formation accelerator. The functions of the image formation accelerator include the acceleration of an oxidation/reduction reaction between a silver salt oxidizing agent and a reducing agent, the acceleration of such reactions as dye formation, dye decomposition, and release of a diffusive dye from a dye-releaseble material, and the acceleration of the dye movement from the color photosensitive material layer for heat development to a dye fixing layer. From the viewpoint of physicochemical functions, the image formation accelerators are classified into a base or base precursor, a nucleophilic compound, an organic solvent having a high boiling point (oil), a thermal solvent, a surfactant, a compound capable of interacting with silver or silver ions, and others. However, since these substances ordinarily have a plurality of functions, these substances usually exhibit combinations of the above-mentioned functions. The details are described in U.S. Pat. No. 4,678,739, columns 38–40. Examples of the base precursor include a salt made from an organic acid and a base and capable of decarboxylation by heat and a compound capable of releasing an amine by an intramolecular nucleophilic substitution reaction, a Lossen rearrangement, or a Bechmann rearrangement. Specific examples of these compounds are described in U.S. Pat. Nos. 4,514,493 and 4,657,848.

In the system in which heat development and transfer of dyes are performed simultaneously in the presence of a small amount of water, it is preferable that a base and/or a base precursor is incorporated in a dye fixing material, which is described later, from the standpoint of enhancing the storability of the color photosensitive material for heat development.

In addition, also usable as a base precursor are a combination of a difficultly soluble metal compound and a compound capable of reacting with the metal ion constituting the difficultly soluble metal compound to form a complex (hereinafter referred to as a complex forming compound) as described in European Patent Laid-Open No. 210,660 and U.S. Pat. No. 4,740,445 and a compound which generates a base by electrolysis as described in JP-A No. 61-232451. In particular, the former type is effective. It is advantageous that the difficultly soluble metal compound and the complex forming compound be added separately to the color photosensitive material for heat development and to a dye fixing material described later.

In the photosensitive layer and/or other constituent layers of the color photosensitive material for heat development of the present invention, a variety of development inhibitors can be used in order to obtain images of constant quality always independent of the variation in the processing temperature and processing time when development is performed. Development stopper as used here refers to a compound which terminates the development by rapidly neutralizing or reacting with the base to decrease the base concentration in the layer or a compound which inhibits the development by interacting with silver or a silver salt, after a proper stage of development is achieved. Specific examples of the stopper include an acid precursor which releases an acid upon heating, an electrophilic compound which causes a substitution reaction with a base present upon heating, a nitrogen-containing heterocyclic compound, and a mercapto compound or a precursor thereof. Details of these compounds are described in JP-A No.62-253159, pp.31–32.

A compound capable of activating development and stabilizing images simultaneously can be used in the photosensitive layer and/or other constituent layers of the color photosensitive material for heat development of the present invention. Specific examples of the compound are described in U.S. Pat. No. 4,500,626, columns 51–52.

The photosensitive layer and/or other constituent layers of the color photosensitive material for heat development of the present invention may contain various photographic additives known in the art. The photographic additives are described in RD No. 17,643, No. 18,716, and No. 307,105. The following table shows the relevant references.

These photographic additives may also be incorporated in the dye-fixing layer described later.

| Additives | RD17,643 | RD18,716 | RD307,105 |
|---|---|---|---|
| 1. Chemical sensitizers | page 23 | page 648, right column | page 866 |
| 2. Sensitivity raising agents | | page 648, right column | |
| 3. Spectral sensitizers, Supersensitizers | pages 23–24 | page 648, right column to page 649, right column | pages 866–868 |
| 4. Fluorescent brighteners | page 24 | page 648, right column | page 868 |
| 5. Anti-fogging agents, Stabilizers | pages 24–25 | page 649, right column | pages 868–870 |
| 6. Light absorbers, Filter dyes, Ultraviolet absorbers | pages 25–26 | page 649, right column to page 650, left column | page 873 |
| 7. Dye image stabilizers | page 25 | page 650, left column | page 872 |
| 8. Hardeners | page 26 | page 651, left column | pages 874–875 |
| 9. Binders | page 26 | page 651, left column | pages 873–874 |
| 10. Plasticizers, Lubricants | page 27 | page 650, right column | page 876 |
| 11. Coating aids, Surfactants | pages 26–27 | page 650, right column | pages 875–876 |
| 12. Antistatic agents | page 27 | page 650, right column | pages 876–877 |
| 13. Matting agents | | | pages 878–879 |

A material that can withstand the processing temperature is used as a support for the color photosensitive material for heat development of the present invention. Generally, examples of the support include supports for use in photography such as paper, a synthetic polymer (film), and the like, as described in "Fundamentals of Photographic Engineering—Silver Salt Photography Section", pp. 223–240, edited by the Photographic Society of Japan, Corona Co., Ltd., 1979. Specific examples of the support include polyethylene terephthalate, polyethylene naphthalate, polycarbonate, polyvinyl chloride, polystyrene, polypropylene, polyimide, and cellulose (e.g., triacetylcellulose) as well as those materials which are prepared by incorporating a pigment such as titanium oxide into the foregoing substances. Additional examples of the support include film-process synthetic paper made from polypropylene or the like, mix-milled paper made from a synthetic resin pulp such as polyethylene and natural pulp, Yankee paper, baryta paper, coated paper (cast-coated paper in particular), metals, clothes, glass, and so on. The support may be composed of a single material, or otherwise it may be a material whose one side or both sides are laminated with a synthetic polymer such as polyethylene. If necessary, the layer to be laminated may contain a pigment, such as titanium oxide, ultramarine blue, and carbon black, or a dye. Other supports, which can be used in the present invention, include those described in, e.g., JP-A Nos.62-253159, pp.

29–31, 1-161236, pp.14–17, 63-316848, 2-22651, and 3-56955, and U.S. Pat. No. 5,001,033.

The backside of the support may be coated with a mixture comprising a hydrophilic binder and a semiconducting metal oxide, such as alumina sol or tin oxide, or an antistatic agent such as carbon black or the like. Specifically, supports described in, for example, JP-A No. 63-220246 and others, can be used. Further, it is preferable to carry out a surface treatment or to apply an undercoat layer to the support surface in order to improve the adhesion to the hydrophilic binder.

The color photosensitive material for heat development of the present invention can be prepared by applying a coating liquid for forming photosensitive layer, which contains the above-described various components, to the support and thereafter drying the coating layer to form the photosensitive layer. The photosensitive layer is comprised of two or more layers. The coating liquids for layers may be applied to the support simultaneously or the coating liquids for layers may be applied successively. As to the application and drying, conventionally known methods may be employed.

When the coupler is added to the photosensitive layer, the following way may be employed. First, the coupler, the developing agent to be incorporated, and an organic solvent having a high boiling point (e.g., analkyl esterof phosphoric acid, an alkyl ester of phthalic acid) are mixed. The mixture is dissolved in an organic solvent having a low boiling point (e.g., ethyl acetate or methyl ethyl ketone). The resulting solution is then dispersed in water by means of an emulsification dispersing method conventionally known in the art. Following that, the aqueous emulsion is added. Besides, the addition by means of a solid dispersion as described in JP-A No. 63-271339 is also possible.

The compound represented by the general formula (1) and optional hydrophobic additives such as a reducing agent can be introduced into the layer of the color photosensitive material for heat development by means of a known method such as the method described in U.S. Pat. No. 2,322,027. In this case, any of the organic solvents having a high boiling point, which solvents are described, for example, in U.S. Pat. Nos. 4,555,470, 4,536,466, 4,536,467, 4,587,206, 4,555,476, and 4,599,296, and JP-B No. 3-62256, can be used, if necessary, together with an organic solvent having a low boiling point ranging from 50 to 160° C. Besides, two or more species of, for example, the hydrophobic additives, the organic solvents having a high boiling point, and others may be used in combinations. The proper amount of the organic solvent having a high boiling point is 10 g or less, preferably 5 g or less, and more preferably 1–0.1 g, per gram of the compound represented by the general formula (1). The proper amount of the organic solvent having a high boiling point is 1 cc or less, preferably 0.5 cc or less, and particularly preferably 0.3 cc or less, per gram of the binder. Further, the hydrophobic additive may be dispersed and added by means of a polymer described in JP-B No. 51-39853 and JP-A No. 51-59943. Furthermore, the hydrophobic additive may be transformed into a dispersion of fine particles as described in JP-A No. 62-30242 so that the resulting dispersion is added. Besides the above-described methods, if the hydrophobic additive is a compound substantially insoluble in water, the compound may be dispersed in the binder so that the compound is introduced into the layer. When a hydrophobic compound is dispersed to form a hydrophilic colloidal dispersion, various surfactants may be used. For example, use may be made of the surfactants listed in JP-A No. 59-157636, pp.37–38, and the aforesaid Research Disclosure.

For the color photosensitive material of the present invention to form images of colors covering wide areas in a chromaticity diagram, the photosensitive layer needs to have layers of at least 3 primary colors of yellow, magenta, and cyan, preferably combined such that at least the 3 layers contain silver halide emulsion layers, respectively, which are sensitive in different wavelength regions. Examples of the combination include a combination of a blue-sensitive layer, a green-sensitive layer, and a red-sensitive layer, a combination of a green-sensitive layer, a red-sensitive layer, and an infrared-sensitive layer, and a combination of a red-sensitive layer, an infrared-sensitive layer (1), and an infrared-sensitive layer (2), as described in, for example, JP-A Nos. 59-180550, 64-13546, and 62-253159, and European Patent Laid-Open No. 479,167. A variety of configurational orders of layers known in ordinary color photosensitive materials can be adopted for arranging the above-described layers. In addition, if necessary, each of the above-described photosensitive layers may be divided into 2 or more layers as described in JP-A No. 1-252954.

In the color photosensitive material for heat development of the present invention, a variety of non-photosensitive layers, such as a protective layer, an undercoat layer, an intermediate layer, a yellow filter layer, and an antihalation layer, may be formed between the silver halide emulsion layers, or as the uppermost layer or the lowermost layer. Further, an auxiliary layer, such as a back layer, may be formed on the backside of the support. More specifically, it is possible to form various layers which include the layer constructions described in above-mentioned patents, an undercoat layer described in U.S. Pat. No. 5,051,335, an intermediate layer containing a solid pigment described in JP-A Nos.1-167838 and 61-20943, an intermediate layer containing a reducing agent and a DIR compound described in JP-A Nos. 1-129553, 5-34884, and 2-64634, an intermediate layer containing an electron transport agent described in U.S. Pat. Nos. 5,017,454, and 4, 139,919, and JP-A No. 2-235044, and a protective layer containing a reducing agent described in JP-A No. 4-249245 as well as a combination of these layers. It is preferable that the support has an antistatic property and is designed such that the surface resistivity is not greater than $10^{12}$ Ω.cm.

The color photosensitive material for heat development of the present invention is used together with a dye-fixing material in an image forming system by diffusion transfer of dyes so that images are formed. As to the mode of providing the dye-fixing material, it may be provided on a support other than that of the photosensitive material or it may be provided on the same support as that of the photosensitive material. The relationship between the photosensitive material and the dye-fixing material, the relationship between the photosensitive material and the support, and the relationship between the photosensitive material and the white reflective layer, all described in U.S. Pat. No. 4,500,626, column 57, also apply to the present invention.

The dye-fixing material is, for example, a material comprising a support having thereon a layer at least capable of fixing dyes (i.e., dyes diffused and transferred from the color photosensitive material for heat development) for forming images (this layer is hereinafter referred to as "dye-fixing layer" upon occasion). In accordance with the methods for fixing dyes, the dye-fixing layer contains such materials as a mordant, a metal salt, an ink absorbent, and the like. Further, if necessary, the dye-fixing layer may be provided with a surface protective layer, a timing layer, and an acid-neutralizing layer, so that such materials as a binder, a base generator, a thermal solvent, a brightener, an antifogging agent, a stabilizer, a hardener, a plasticizer, an organic solvent having a high boiling point, a coating aid, a surfactant, an antistatic agent, a matting agent, a slicking agent, and an antioxidant are incorporated.

The mordant may be a mordant known in the field of photography. Examples of the mordant include the mordants described in U.S. Pat. No. 4,500,626, columns 58–59; the mordants described in JP-A No. 61-88256, pp.32–41, and JP-A No. 161236, pp.4–7; and the mordants described in U.S. Pat. Nos. 4,774,162, 4,619,883, and 4,594,308. Also usable is a dye-acceptive polymeric compound described in U.S. Pat. No. 4,463,079.

The binder for use in the dye-fixing material of the present invention is preferably the aforesaid hydrophilic binder. The hydrophilic binder is preferably combined with a carrageenan as described in European Patent Laid-Open No. 443,529 or with a latex having a glass transition temperature of 40° C. or below as described in JP-B No. 3-74820. If necessary, the dye-fixing layer may be provided with auxiliary layers such as a protective layer, a peelable layer, an undercoat layer, an intermediate layer, a back layer, a curling-prevention layer. In particular, the formation of a protective layer is useful.

Examples of the support of the dye-fixing material may be the same supports as those for use in the color photosensitive material for heat development.

The dye-receiving layer and other constituent layers of the dye-fixing material may contain an anti-fading agent. The anti-fading agent is, for example, an antioxidant, an ultraviolet light absorber, or a metal complex. In addition, also useful are the dye image stabilizer or the ultraviolet light absorber described in the aforesaid Research Disclosure. Examples of the antioxidant include chroman-based compounds, coumaran-based compounds, phenol-based compounds (e.g., hindered phenols), hydroquinone derivatives, hindered amine derivatives, and spiroindan-based compounds. Also effective are the compounds described in JP-A No. 61-159644. Examples of the ultraviolet light absorber include benzotriazole-based compounds (e.g., U.S. Pat. No. 3,533,794), 4-thiazolidone-based compounds (e.g., U.S. Pat. No. 3,352,681), and benzophenone-based compounds (e.g., JP-A No. 46-2784) as well as other compounds described in JP-A Nos. 54-48535, 62-136641, and 61-88256. Also effective are the polymers capable of absorbing ultraviolet light described in JP-A No. 62-260152. Examples of the metal complex include the compounds described in U.S. Pat. Nos. 4,241,155, 4,245,018, columns 3–36, U.S. Pat. No. 4,245,195, columns 3–8, and JP-A Nos. 62-174741, 61-88256, pp. 27–29, 63-199248, 1-75568, and 1-74272.

The anti-fading agent may be supplied to the dye-fixing material from an external source such as a solvent for transfer. The antioxidants, ultraviolet light absorbers, metal complexes may be used in combinations thereof.

The dye-receiving layer and/or other constituent layers of the dye-fixing material may contain a fluorescent brightener. Examples of the fluorescent brightener include the compounds described in, for example, K. Veenkatarman, Ed., "The Chemistry of Synthetic Dyes", Vol. 5, Chapter 8, and JP-A No. 61-143752. Specific examples of the fluorescent brightener include stilbene-based compounds, coumarin-based compounds, biphenyl-based compounds, benzoxazolyl-based compounds, naphthalimide compounds, pyrazoline-based compounds, and carbostyryl-based compounds. The fluorescent brightener may be supplied to the dye-fixing material from an external source such as a solvent for transfer. In addition, the fluorescent brightener may be used in combination with an anti-fading agent or an ultraviolet light absorber. Specific examples of these anti-fading agent, ultraviolet light absorber, and fluorescent brightener are described in JP-A Nos. 62-215272, pp.125–137, and 1-161236, pp.17–43.

Examples of the image forming methods using the color photosensitive material for heat development of the present invention are explained below.

According to the color photosensitive material for heat development of the present invention, images can be formed in the dye-fixing material by a process comprising an exposing step in which the color photosensitive material for heat development is irradiated image-wise with light and a diffusion-transfer step in which the dyes are diffused and transferred from the photosensitive layer of the color photosensitive material for heat development to the dye-fixing layer of the dye-fixing material after the exposing step or simultaneously with the exposing step. Examples of the method for irradiating the color photosensitive material for heat development image-wise with light include a method in which image information is converted into electric signals to cause a light-emitting diode to emit light or to cause a laser device (e.g., laser diode or gas laser device) to produce a laser so that scanning exposure is carried out (these methods are described in, for example, JP-A Nos. 2-129625, 3-338182, 4-9388, and 4-281442), and a method in which image information is outputted to an image display device, such as CRT, liquid crystal display, electroluminescence display, or plasma display, so that exposure to light is carried out directly or via an optical system.

Examples of the light source that can be used for irradiating the color photosensitive material for heat development with light image-wise include light sources or exposing methods such as light emitting diodes, laser light sources, and CRT light sources described in U.S. Pat. No. 4,500,626, column 56, and JP-A Nos. 2-53378 and 2-54672. Further, it is also possible to carry out image-wise exposure by using a wavelength conversion element made up of a combination of a nonlinear optical element and a coherent light source such as a laser. The term "a nonlinear optical element" as used herein means a material capable of creating nonlinearity between polarity which emerges when exposed to a strong photoelectric field such as laser light, and an electric field. Examples of such materials that are preferably used include inorganic compounds represented by lithium niobate, potassium dihydrogenphosphate KDP), lithium iodate, $BaB_2O_4$, and the like, a urea derivative, a nitroaniline derivative, a nitropyridine-N-oxide derivative such as 3-methyl-4-nitropyridine-N-oxide (POM), and compounds described in JP-A Nos. 61-53462 and 62-210432. As for the modes of the wavelength conversion element, a single crystal optical waveguide type, a fiber-type, and others are known, and any of them is useful.

For image-wise irradiation with light, there may be used image signals such as signals obtainable from a video camera, an electronic still camera, and the like, television signals represented by Nippon Television Signals Code ((NTSC), image signals obtained by dividing the original image into pixels using, for example, a scanner, and image signals produced using a computer represented by CG or CAD.

After the color photosensitive material for heat development is exposed image-wise, the dyes are subjected to diffusion transfer from the photosensitive layer of the color photosensitive material for heat development to the dye-fixing layer of the dye-fixing material so that images are formed on the dye-fixing material. Before or simultaneously with the diffusion transfer of dyes, the photosensitive material for heat development and/or the dye fixing material is heated to carry out the heat development. When being heated, it is preferable that the photosensitive layer of the color photosensitive material for heat development and the dye-fixing layer of the dye-fixing material are tightly adhered to each other. The heating temperature in the heat development is preferably about 50 to 250° C. The diffusion transfer step of the dyes may be carried out simultaneously with the heat development or may be carried out after the heat development step. In the latter case, although the transfer can be carried out at a temperature ranging from the temperature of the heat development to room temperature, a particularly preferred temperature range is between 50° C. and a temperature which is about 10° C. below the temperature of the heat development.

Examples of the method for heating the color photosensitive material for heat development and/or dye-fixing material include a method in which the material is brought into contact with a heated block or plate, a method in which the material is brought into contact with such an object as a hot plate, a hot presser, a heat roller, a heat drum, a halogen lamp heater, or an infrared or far infrared lamp heater, and a method in which the material is passed through a high-temperature atmosphere. Further, the color photosensitive material for heat development and/or dye-fixing material may have an electroconductive heat generator layer, which acts as a heating means. The heat generating element described, for example, in JP-A No. 61-145544 can be used as the heat generating element to be incorporated in the above-mentioned heat generator layer. As to a method in which the color photosensitive material for heat development and the dye fixing material are put together, the methods described in JP-A Nos. 62-253159 and 61-147244, pp. 27 can be employed.

Although the transfer of dyes can be made by heat alone, a solvent may be used in order to accelerate the transfer of dyes. Also useful is a method in which development and transfer are carried out simultaneously or consecutively by heating in the presence of a small amount of a solvent (water in particular) as described in U.S. Pat. Nos. 4,704,345 and 4,740,445, JP-A No. 61-238056, and others. In this method, the heating temperature is preferably between 50° C. and the boiling point of the solvent. For example, if the solvent is water, the heating temperature is preferably 50 to 100° C. Examples of the solvent to be used for the acceleration of development and/or diffusion transfer of dyes include water, a basic aqueous solution containing an inorganic alkali metal salt or an organic base (the base for this purpose is selected from the bases listed in the explanation of image formation accelerators), a solvent having a low boiling point, and a mixture of the solvent having a low boiling point with water or the foregoing basic aqueous solution. The solvent may contain such substances as a surfactant, an anti-fogging agent, a compound capable of forming a complex with a difficultly soluble metal salt, a mildewproofing agent, and an antibacterial agent.

The solvent can be supplied to the color photosensitive material for heat development, to the dye-fixing material or to both of them. The amount of the solvent to be used is not more than the weight of the solvent required for the maximum swelling of the entire coating layers. Preferred examples of methods for supplying a solvent (water in particular) to these materials include the methods described in JP-A Nos. 62-253159, pp.5, 63-85544, and others. Further, a solvent encapsulated into microcapsules or in the form of a hydrate may be incorporated in advance into the photosensitive material for heat development or dye fixing material or into both of them. The temperature of water to be supplied may be in the range of 30 to 60° C. as described, for example, in JP-A No. 63-85544. It is useful to keep the temperature of water at 45° C. or above in order to prevent the growth of bacteria particularly in the water. In order to accelerate the transfer of dyes, a hydrophilic thermal solvent, which is a solid at normal temperature but melts at a high temperature, may be incorporated into the color photosensitive material for heat development and/or dye-fixing material. The layer into which the thermal solvent is incorporated may be any one selected from a photosensitive silver halide emulsion layer, an intermediate layer, a protective layer, and a dye-fixing layer, but the dye-fixing layer and/or a layer adjacent thereto is preferred. Examples of the hydrophilic thermal solvent include urea-based compounds, pyridine-based compounds, amides, sulfonamides, imides, alcohols, oximes, and other heterocyclic compounds.

Any of various apparatus for heat development can be used for the image formation processing of the color photosensitive material for heat development of the present invention. Preferred examples of the apparatus include the apparatus described in JP-A Nos. 59-75247, 59-177547, 59-181353, 60-18951, 6-130509, 6-095338, and 6-095267, and Japanese Utility Model Application Laid-Open No. 62-25944. Commercially available apparatus that can be used include Pictrostat 100, Pictrostat 200, Pictrography 3000, and Pictrography 2000, all of which are manufactured by Fuji Photo Film Co., Ltd.

An embodiment suitable for the application of the color photosensitive material for heat development of the present invention to a full-color image forming photosensitive material is shown in FIG. 1.

The color photosensitive material for heat development 10 has a first photosensitive layer 14, a second photosensitive layer 16, and a third photosensitive layer 18 on a support 12. The first photosensitive layer 14 contains a binder, a silver halide emulsion spectrally sensitized to a longwave infrared wavelength region, a compound Y which is represented by the general formula (1) and releases a yellow dye, and an incorporated color developing agent Y. The second photosensitive layer 16 contains a binder, a silver halide emulsion spectrally sensitized to a shortwave infrared wavelength region, an incorporated color developing agent C, and a substantially colorless coupler C which reacts with the oxidized form of the incorporated development agent C to form a diffusive cyan dye. The third photosensitive layer 20 contains a binder, a silver halide emulsion spectrally sensitized in a red wavelength region, a compound M which is represented by the general formula (1) and releases a magenta dye, and an incorporated color developing agent M.

An embodiment for image formation using the color photosensitive material for heat development 10 by a diffusion transfer process utilizing heat development is described below.

In the color photosensitive material for heat development 10, the photosensitive layers 14, 16, and 18 are successively exposed image-wise to the respective light wavelengths so that latent image nuclei are formed in the photosensitive silver halides contained in the respective layers. The silver halides having latent image nuclei formed therein are reduced to silver by the incorporated developing agents Y, C, M contained in the respective layers 14, 16, and 18, while the incorporated developing agents Y, C, M are converted into respective oxidized forms. The incorporated developing agents Y and M react, respectively, with the compounds Y and M contained in the first and third photosensitive layers. As a result, the compounds Y and M release, respectively, a yellow dye and magenta dye (the portions represented by Dye in the general formula (1)). On the other hand, the oxidized form of the incorporated developing agent C reacts with the colorless coupler C to form a diffusive cyan dye. Then, when the color photosensitive material for heat development 10 is superposed on a mordant sheet (not shown) containing a mordant so that the color photosensitive material for heat development 10 and/or the mordant sheet is heated, the yellow, cyan, and magenta dyes are thermally diffused and transferred, respectively, from the exposed portions of the photosensitive layers 14, 16, and 18 to the mordant sheet so that the dyes are fixed by the mordant. In this way, a full-color image is formed on the mordant sheet.

In the color photosensitive material for heat development of the present invention, a protective layer may be provided on the photosensitive layer (i.e., on the photosensitive layer 18 in the FIG. 1), if necessary. In addition, an undercoat layer may be provided between the support and a non-photosensitive layer. An intermediate layer may be provided between photosensitive layers. Further, auxiliary layers, such as a yellow filter layer, an antihalation layer, a back layer, and so on, may be formed.

The color photosensitive material for heat development of the present invention is not limited to the layer construction shown in the above-described mode of implementation, and any layer construction may be used with the proviso that two or more photosensitive layers are present. For example, in order to raise the sensitivity to a higher level, the photosensitive layer may have a 2-layered laminate construction such that the upper layer is composed of a silver halide emulsion containing a photosensitive silver halide while the lower layer contains a compound represented by the general formula (1) or the substantially colorless coupler. The combination of colors is not limited to the combination shown in the above-described mode of implementation. In addition, although the above-described mode of implementation employs a 3-layer combination made up of a red-sensitive layer, a shortwave infrared-sensitive layer, and a longwave infrared-sensitive layer, the color photosensitive material for heat development of the present invention is not limited to this combination. Therefore, a variety of arrangements known in conventional color photosensitive materials may be adopted in the present invention. Although the two photosensitive layers are sensitive to infrared light in the construction of the above-described mode of implementation, the color photosensitive material for heat development of the present invention is not limited to this combination. Therefore, the photosensitive layer may have a photosensitive layer sensitive to light in a visible light region (i.e., a blue-, green-, or red-sensitive layer). In addition, the incorporated color developing agents in the respective photosensitive layers may be the same or different.

EXAMPLES

A dye-fixing material 100 was prepared in the following way.

On a support (having a thickness of 152 μm) comprising pulp as a core material, there were coated a front-side PE layer (having a thickness of 36.0 μm) and a front-side undercoat layer (having a thickness of 0.1 μm) in that order from the front of the support; and there were coated a backside PE layer (having a thickness of 27.0 μm) and a backside undercoat layer (having a thickness of 0.5 μm) in that order from the back of the support. The layer compositions are shown in Table 2.

Next, the surface of the front-side undercoat layer was overcoated with 6 layers of coating liquids for layer formation so as to prepare 6 layers successively on the support. In this way, a dye-fixing material 100 was prepared. Constituent components for respective layers are listed in the Table 1.

TABLE 1

Construction of a dye-fixing material 100

| Layer number | Components | Coating weight (mg/m$^2$) |
|---|---|---|
| The sixth layer | Water-soluble polymer (1) | 130 |
| | Water-soluble polymer (2) | 35 |
| | Water-soluble polymer (3) | 45 |
| | Potassium nitrate | 20 |
| | Anionic surfactant (1) | 6 |
| | Anionic surfactant (2) | 6 |
| | Amphoteric surfactant (1) | 50 |
| | Stain-prevention agent (1) | 7 |
| | Stain-prevention agent (2) | 12 |
| | Matting agent (1) | 7 |
| The fifth layer | Gelatin | 250 |
| | Water-soluble polymer (1) | 25 |
| | Anionic surfactant (3) | 9 |
| | Hardener (1) | 185 |
| The fourth layer | Mordant (2) | 1850 |
| | Water-soluble polymer (2) | 260 |
| | Water-soluble polymer (4) | 1400 |
| | Latex dispersion (1) | 600 |
| | Anionic surfactant (3) | 25 |
| | Nonionic surfactant (1) | 18 |
| | Citric acid | 15 |
| | Guanidine picolinate | 2550 |
| | Sodium quinolinate | 350 |
| The third layer | Gelatin | 370 |
| | Mordant (1) | 300 |
| | Anionic surfactant (3) | 12 |
| The second layer | Gelatin | 700 |
| | Mordant (1) | 290 |
| | Water-soluble polymer (1) | 55 |
| | Water-soluble polymer (2) | 330 |
| | Anionic surfactant (3) | 30 |
| | Anionic surfactant (4) | 7 |
| | Organic solvent having a high boiling point (1) | 700 |
| | Fluorescent brightener (1) | 30 |
| | Stain-prevention agent (3) | 32 |
| | Guanidine picolinate | 360 |
| | Potassium quinolinate | 45 |
| The first layer | Gelatin | 280 |
| | Water-soluble polymer (1) | 12 |
| | Anionic surfactant (1) | 14 |
| | Sodium metaborate | 35 |
| | Hardener (1) | 185 |

Support made of polyethylene-laminated paper (having a thickness of 215 μm)

TABLE 2

| Name of layer | Composition | Thickness (μm) |
|---|---|---|
| Front-side undercoat layer | Gelatin | 0.1 |
| Front-side PE layer (glossy) | Low-density polyethylene (density: 0.923): 90.2 parts<br>surface-treated titanium oxide: 9.8 parts<br>ultramarine blue: 0.001 part | 36.0 |
| Pulp layer | Fine paper (LBKP/NBSP = 6/4 density: 1.053) | 152.0 |
| Backside PE layer (mat) | High-density polyethylene (density: 0.955) | 27.0 |
| Backside undercoat layer | Styrene/acrylate copolymer; colloidal silica; sodium polystyrene sulfonate | 0.1 |
| | | 215.2 |

Mordant (1)

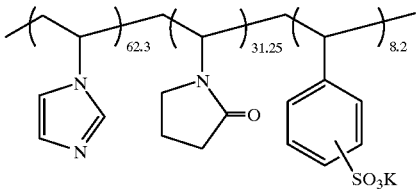

Mordant (2)

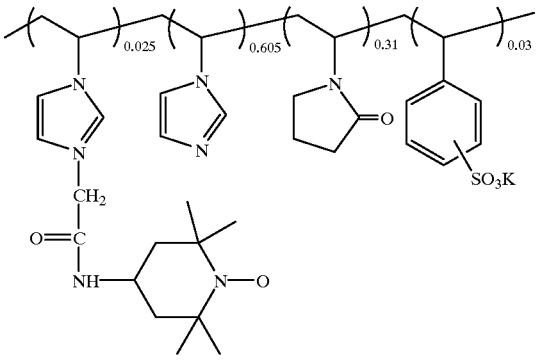

Stain-prevention agent (1)

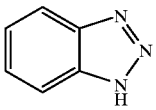

Stain-prevention agent (2)

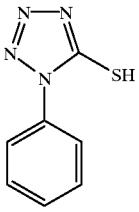

Stain-prevention agent (3)

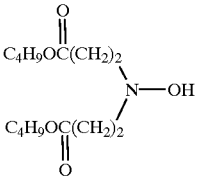

Organic solvent having a high boiling point (1)

$C_{28}H_{48.9}Cl_{7.1}$
(Enpara 40 manufactured by Ajinomoto Co., Inc.)

Water-soluble polymer (1)

Sumikagel L5-H
(manufactured by Sumitomo Chemical Co., Ltd.)

Water-soluble polymer (2)

Dextran (having a molecular weight of 70,000)

Water-soluble polymer (3)

Copper carrageenan (manufactured by Taito Co., Ltd.)

Water-soluble polymer (4)

MP Polymer MP-102 (manufactured by Kuraray Co., Ltd.)

Latex dispersion (1)

LX-438 (manufacture by Nippon Zeon Co., Ltd.

Anionic surfactant (1)

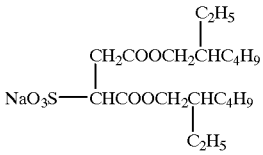

Anionic surfactant (2)

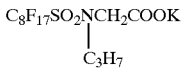

Anionic surfactant (3)

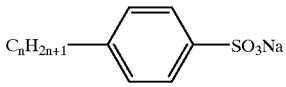

n = 12.6

Anionic surfactant (4)

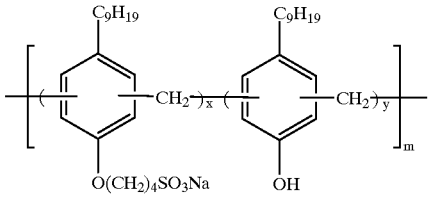

x:y = 4:6
m = 6.8

Nonionic surfactant (1)

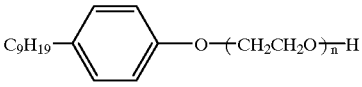

n = 85

Amphoteric surfactant (1)

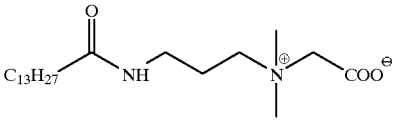

Fluorescent brightener (1)

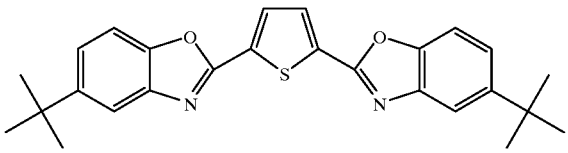

Matting agent (1)

SYLOID 79 (manufactured by Fuji Davidison Co., Ltd.)

Hardener (1)

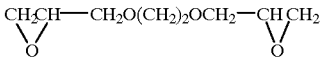

(1)

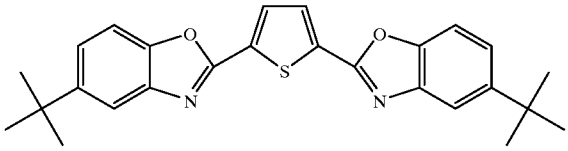

Fluorescent brightener

-continued (1)

SYLOID 79 (manufactured by Fuji Davidison Co., Ltd.)

Matting agent (1)

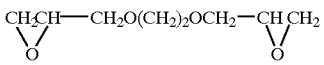

Hardener

Next, photosensitive materials for heat development 101 to 113 were prepared in the following way.

Preparation of photosensitive silver halide emulsions Photosensitive silver halide emulsion (1) [for the $5^{th}$ layer (which is sensitive to 687 nm of light)]

To an aqueous solution which was well stirred and composed of components shown in Table 3, the liquid (I) and the liquid (II) composed of components shown in Table 4 were added simultaneously over a period of 19 minutes. At 5 minutes after the addition, the liquid (III) composed of components shown in Table 4 was added over a period of 33 minutes, and the liquid (IV) composed of components shown in Table 4 was added over a period of 33 minutes and 30 seconds.

TABLE 3

| Composition | |
|---|---|
| $H_2O$ | 620 ml |
| Lime-treated gelatin | 20 g |
| KBr | 0.3 g |
| NaCl | 2 g |
| Silver halide solvent (1) | 0.03 g |
| Sulfuric acid (1N) | 16 ml |
| Temperature | 45° C. |

TABLE 4

| | Liquid (I) | Liquid (II) | Liquid (III) | Liquid (IV) |
|---|---|---|---|---|
| $AgNO_3$ | 30.0 g | None | 70.0 g | None |
| $NH_4NO_3$ | 0.125 g | None | 0.375 g | None |
| KBr | None | 13.7 g | None | 44.1 g |
| NaCl | None | 3.6 g | None | 2.4 g |
| $K_2IrCl_6$ | None | None | None | 0.039 mg |
| Total amount | 126 ml after the addition of water | 132 ml after the addition of water | 254 ml after the addition of water | 252 ml after the addition of water |

At the point in time when 15 minutes had elapsed since the start of the addition of the liquid (III), the addition of 150 ml of an aqueous solution containing 0.350% of the sensitizing dye (1) was started and the aqueous solution was added over a period of 27 minutes.

Silver halide solvent (1)

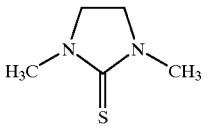

Sensitizing dye (1)

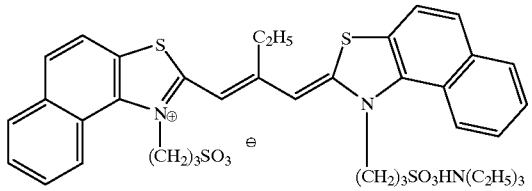

After carrying out water-washing and desalting operations according to ordinary methods (desalting operation was performed by using a precipitant a at a pH value of 3.7–4.1), 22 g of lime-treated ossein gelatin was added. The pH of the resulting mixture was adjusted to 6.0 and the pAg of the liquid was adjusted to 7.9. Following that, chemical sensitization was carried out at 60° C. The compounds that were used for the chemical sensitization are shown in Table 5. The amount of the emulsion obtained was 630 g. The emulsion was composed of monodispersed cubic silver chlorobromide grains having a coefficient of variation of 10.2% and an average grain size of 0.20 $\mu$m.

Precipitant a

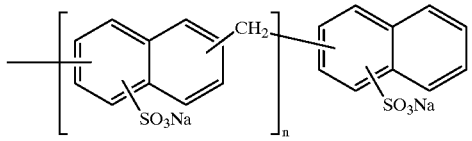

TABLE 5

| Chemicals used in the chemical sensitization | Amount added |
|---|---|
| 4-hydroxy-6-methyl-1,3,3a,7-tetrazaindene | 0.36 g |
| Sodium thiosulfate | 6.75 mg |
| Anti-fogging agent (1) | 0.11 g |
| Antiseptic (1) | 0.07 g |
| Antiseptic (2) | 3.13 g |

Anti-fogging agent (1)

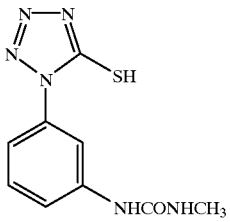

Antiseptic (1)

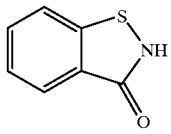

-continued

Antiseptic (2)

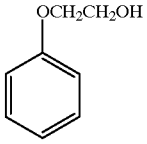

Photosensitive silver halide emulsion (2) [for the $3^{rd}$ layer (which is sensitive to 750 nm of light)]

To an aqueous solution which was well stirred and composed of components shown in Table 6, the liquid (I) and the liquid (II) composed of components shown in Table 7 were added simultaneously over a period of 18 minutes. At 5 minutes after the addition, the liquid (III) composed of components shown in Table 7 was added over a period of 24 minutes, and the liquid (IV) composed of components shown in Table 7 was added over a period of 24 minutes and 30 seconds.

TABLE 6

| Composition | |
|---|---|
| $H_2O$ | 620 ml |
| Lime-treated gelatin | 20 g |
| KBr | 0.3 g |
| NaCl | 2 g |
| Compound (a) | 0.03 g |
| Sulfuric acid (1N) | 16 ml |
| Temperature | 46° C. |

TABLE 7

| | Liquid (I) | Liquid (II) | Liquid (III) | Liquid (IV) |
|---|---|---|---|---|
| $AgNO_3$ | 30.0 g | None | 70.0 g | None |
| $NH_4NO_3$ | 0.125 g | None | 0.375 g | None |
| KBr | None | 13.7 g | None | 44.1 g |
| NaCl | None | 3.6 g | None | 2.4 g |
| $K_4[Fe(CN)_6]H_2O$ | None | None | None | 0.065 g |
| $K_2IrCl_6$ | None | None | None | 0.04 mg |
| Total amount | 126 ml after the addition of water | 131 ml after the addition of water | 280 ml after the addition of water | 289 ml after the addition of water |

After carrying out water-washing and desalting operations according to ordinary methods (desalting operation was performed by using a precipitant b at a pH value of 3.9), 22 g of ossein gelatin, which had been lime-treated and decalcified (having a calcium content of 150 ppm or less) was added. The resulting mixture was dispersed again at 40° C. Then, 0.39 g of 4-hydroxy-6-methyl-1,3,3a,7-tetrazaindene was added, and the pH was adjusted to 5.9 and the pAg was adjusted to 7.8. Following that, chemical sensitization was carried out at 70° C. using the chemicals shown in Table 8. At the final stage of the chemical sensitization, a sensitizing dye (2) was added as a methanol solution thereof (the composition of the solution is shown in Table 9). After the chemical sensitization, the temperature of the resulting mixture was lowered to 40° C. and 200 g of a gelatin dispersion of a stabilizer (1), described later, was added. The resulting mixture was well stirred to thereby obtain the desired emulsion. The amount of the emulsion obtained was 938 g. The emulsion was composed of monodispersed cubic silver chlorobromide grains having a coefficient of variation of 12.6% and an average grain size of 0.25 $\mu$m. The emulsion for the photosensitive layer which is sensitive to 750 nm of light was an emulsion having a J-band type spectral sensitivity.

Precipitant b

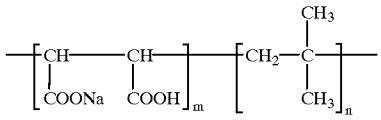

TABLE 8

| Chemicals used in the chemical sensitization | Amount added |
|---|---|
| 4-hydroxy-6-methyl-1,3,3a,7-tetrazaindene | 0.39 g |
| Triethylthiourea | 3.3 mg |
| Dispersion of a nucleic acid | 0.39 mg |
| NaCl | 0.15 g |
| KI | 0.12 g |
| Anti-fogging agent (2) | 0.10 g |
| Antiseptic (1) | 0.07 g |

TABLE 9

| Composition of dye solution | Amount added |
|---|---|
| Sensitizing dye (2) | 0.19 g |
| Methanol | 18.7 ml |

Anti-fogging agent (2)

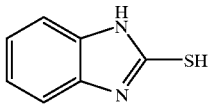

Sensitizing dye (2)

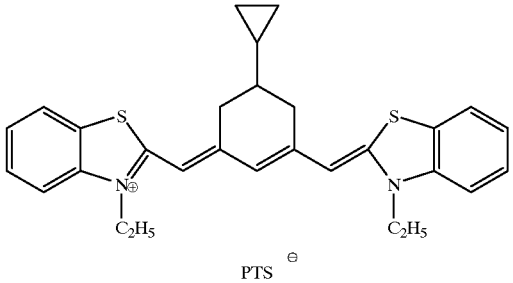

PTS: p-toluenesulfonic acid

Photosensitive silver halide emulsion (3) [for the $1^{st}$ layer (which is sensitive to 810 nm of light)]

To an aqueous solution which was well stirred and composed of components shown in Table 10, the liquid (I) and the liquid (II) composed of components shown in Table 11 were added simultaneously over a period of 18 minutes. At 5 minutes after the addition, the liquid (III) composed of components shown in Table 11 was added over a period of 24 minutes, and the liquid (IV) composed of components shown in Table 11 was added over a period of 24 minutes and 30 seconds.

TABLE 10

| Composition | |
|---|---|
| $H_2O$ | 620 ml |
| Lime-treated gelatin | 20 g |
| KBr | 0.3 g |
| NaCl | 2 g |
| Silver halide solvent (1) | 0.03 g |
| Sulfuric acid (1N) | 16 ml |
| Temperature | 50° C. |

TABLE 11

| | Liquid (I) | Liquid (II) | Liquid (III) | Liquid (IV) |
|---|---|---|---|---|
| $AgNO_3$ | 30.0 g | None | 70.0 g | None |
| KBr | None | 13.7 g | None | 44.1 g |
| NaCl | None | 3.6 g | None | 2.4 g |
| $K_4[Fe(CN)_6]H_2O$ | None | None | None | 0.04 g |
| $K_2IrCl_6$ | None | None | None | 0.02 mg |
| Total amount | 180 ml after the addition of water | 181 ml after the addition of water | 242 ml after the addition of water | 250 ml after the addition of water |

After carrying out water-washing and desalting operations according to ordinary methods (desalting operation was performed by using a precipitant a at a pH value of 3.8), 22 g of lime-treated ossein gelatin was added. The pH was adjusted to 7.4 and the pAg was adjusted to 7.8. Following that, chemical sensitization was carried out at 60° C. The compounds that were used for the chemical sensitization are shown in Table 12. The amount of the emulsion obtained was 683 g. The emulsion was composed of monodispersed cubic silver chlorobromide grains having a coefficient of variation of 9.7% and an average grain size of 0.32 $\mu$m.

TABLE 12

| Chemicals used in the chemical sensitization | Amount added |
|---|---|
| 4-hydroxy-6-methyl-1,3,3a,7-tetrazaindene | 0.38 g |
| Triethylthiourea | 3.1 mg |
| Anti-fogging agent (2) | 0.19 g |
| Antiseptic (1) | 0.07 g |
| Antiseptic (2) | 3.13 g |

Preparation of an emulsion of fine silver chloride grains [for addition to the first layer (which is sensitive to 810 nm of light)]

To an aqueous solution which was well stirred and composed of components shown in Table 13, the liquid (I) and the liquid (II) composed of components shown in Table 14 were added simultaneously over a period of 4 minutes. At 3 minutes after the addition, the liquid (III) and the liquid (IV) composed of components shown in Table 14 were added over a period of 8 minutes.

TABLE 13

| Composition | |
|---|---|
| $H_2O$ | 3770 ml |
| Lime-treated gelatin | 60 g |
| NaCl | 0.8 g |
| Temperature | 38° C. |

TABLE 14

| | Liquid (I) | Liquid (II) | Liquid (III) | Liquid (IV) |
|---|---|---|---|---|
| $AgNO_3$ | 300 g | None | 300 g | None |
| $NH_4NO_3$ | 10 g | None | 10 g | None |
| NaCl | None | 108 g | None | 104 g |
| Total amount | 940 ml after the addition of water | 940 ml after the addition of water | 1170 ml after the addition of water | 1080 ml after the addition of water |

After carrying out water-washing and desalting operations according to ordinary methods (desalting operation was performed by using the precipitant a represented by the aforedescribed structural formula at a pH value of 3.9), 132 g of lime-treated gelatin was added. The resulting mixture was dispersed again at 35° C. Then, 0.39 g of 4-hydroxy-6-methyl-1,3,3a,7-tetrazaindene was added, and the pH was adjusted to 5.7. In this way, an emulsion of fine silver chloride grains was obtained. The amount of the emulsion of fine silver chloride grains obtained was 3200 g. The average grain size was 0.1 $\mu$m.

A dispersion of colloidal silver emulsion was prepared in the following way.

To an aqueous solution which was well stirred and composed of components shown in Table 15, a liquid composed of components shown in Table 16 was added over a period of 24 minutes. Then, the precipitant a represented by the aforedescribed structural formula was added and the resulting mixture was washed with water. Following that, 43 g of lime-treated ossein gelatin was added and the pH of the mixture was adjusted to 6.3. The average grain size of the emulsion thus obtained was 0.02 $\mu$m and the amount of the emulsion was 512 g (i.e., a dispersion containing 2% of silver and 6.8% of gelatin).

TABLE 15

| Composition | |
|---|---|
| $H_2O$ | 620 ml |
| Dextrin | 16 g |
| NaOH(5N) | 41 ml |
| Temperature | 30° C. |

TABLE 16

| Composition | |
|---|---|
| $H_2O$ | 135 ml |
| $AgNO_3$ | 17 g |

Next, gelatin dispersions of hydrophobic additives were prepared in the following way.

Gelatin dispersions comprising a yellow-dye releasable compound, a magenta-dye releasable compound, and a cyan-dye releasable compound as well as a developing agent to be incorporated, respectively, were prepared according to the formulations shown in Table 17. The procedure for preparing each dispersion comprised the steps of melting oil-phase components at about 70° C. to form a homogeneous solution, blending this solution with aqueous-phase components kept at about 60° C., and dispersing the blend in a homogenizer at 10,000 rpm for 10 minutes. After that, water was added and the resulting mixture was stirred. In this way, a homogeneous dispersion was obtained.

The ethyl acetate content of the gelatin dispersion of the cyan-dye releasable compound thus obtained was reduced to one 17.6$^{th}$ of the ethyl acetate amount of Table 17 by means of ultrafiltration using ultrafiltration modules (ACV-3050 manufactured by Asahi Chemical Industry Co., Ltd.).

TABLE 17

| | Compositions of dispersions | | |
|---|---|---|---|
| | Yellow | Magenta | Cyan |
| Oil phase | | | |
| Yellow-dye releasable compound (1) | 1.68 g | None | None |
| Yellow-dye releasable compound (2) | 4.03 g | None | None |
| Cyan-dye releasable compound (3) | None | None | 4.45 g |
| Magenta-dye releasable compound (2) | None | 5.27 g | None |
| Reducing agent (1) | 0.47 g | 0.06 g | 0.29 g |
| Anti-fogging agent (3) | 0.1 g | None | 0.06 g |
| Anti-fogging agent (4) | None | 0.21 g | None |
| Surfactant (1) | 0.6 g | 0.23 g | 0.45 g |
| Solvent having a high boiling point (1) | 0.84 g | None | 1.34 g |
| Solvent having a high boiling point (2) | 2.01 g | 2.63 g | 4.47 g |
| Development accelerator (1) | 1.01 g | None | None |
| Dye (a) | 0.59 g | None | 0.14 g |
| Water | 0.19 ml | None | 0.3 g |
| Ethyl acetate | 10 ml | 16 ml | 16 ml |
| Aqueous phase | | | |
| Lime-treated gelatin | 5.5 g | 3.1 g | 2.4 g |
| Calcium nitrate | 0.05 g | 0.04 g | None |
| Surfactant (1) | None | None | None |
| Aqueous solution of sodium hydroxide (1N) | None | None | 0.07 g |
| Carboxymethyl cellulose | None | None | 31 g |
| Water | 35 ml | 31 ml | 40 ml |
| Water (after emulsification) | 40 ml | 43 ml | 0.03 ml |
| Antiseptic (1) | 0.003 g | 0.002 g | None |

A gelatin dispersion of an anti-fogging agent (4) was prepared according to the formulation shown in Table 18. The procedure for preparing the dispersion comprised the steps of melting oil-phase components at about 60° C. to form a homogeneous solution, blending this solution with aqueous-phase components kept at about 60° C., and dispersing the blend in a homogenizer at 10,000 rpm for 10 minutes. In this way, a homogeneous dispersion was obtained.

TABLE 18

| | Composition of dispersion |
|---|---|
| Oil phase | |
| Antifogging agent (4) | 0.8 g |
| Reducing agent (1) | 0.1 g |
| Solvent having a high boiling point (2) | 2.3 g |
| Solvent having a high boiling point (5) | 0.2 g |
| Surfactant (1) | 0.5 g |
| Surfactant (4) | 0.5 g |
| Ethyl acetate | 10.0 ml |
| Aqueous phase | |
| Lime-treated gelatin | 10.0 g |
| Antiseptic (1) | 0.004 g |
| Calcium nitrate | 0.1 g |
| Water | 35.0 ml |
| Make-up water | 46.0 ml |

A gelatin dispersion of a reducing agent (2) was prepared according to the formulation shown in Table 19. The procedure for preparing the dispersion comprised the steps of melting oil-phase components at about 60° C. to form a homogeneous solution, blending this solution with aqueous-phase components kept at about 60° C., and dispersing the blend in a homogenizer at 10,000 rpm for 10 minutes. In this way, a homogeneous dispersion was obtained. Ethyl acetate was removed from the dispersion by means of an apparatus for removing organic solvents under a reduced pressure.

TABLE 19

| | Composition of dispersion |
|---|---|
| Oil phase | |
| Reducing agent (2) | 7.5 g |
| Solvent having a high boiling point (1) | 4.7 g |
| Surfactant (1) | 1.9 g |
| Ethyl acetate | 14.4 ml |
| Aqueous phase | |
| Acid-treated gelatin | 10.0 g |
| Antiseptic (1) | 0.002 g |
| Antiseptic (4) | 0.004 g |
| Calcium nitrate | 0.1 g |
| Water | 136.7 ml |

A dispersion of a polymer latex (a) was prepared according to the formulation shown in Table 20. The procedure for preparing the dispersion comprised adding a surfactant (6) over a period of 10 minutes to a stirred blend of a polymer latex (a), a surfactant (5), and water in respective amounts shown in Table 20 so as to obtain a homogeneous dispersion. The salt concentration of the dispersion thus obtained was reduced to one ninth by repeated water dilution and concentration by using ultrafiltration modules (ACV-3050 manufactured by Asahi Chemical Industry Co., Ltd.).

TABLE 20

| | Composition of dispersion |
|---|---|
| Aqueous polymer latex (a) (having a solid content of 13%) | 108 ml |
| Surfactant (5) | 20 g |
| Aqueous solution of a surfactant (6) (5%) | 600 ml |
| Water | 1232 ml |

A gelatin dispersion of a stabilizer (1) was prepared according to the formulation shown in Table 21. The procedure for preparing the dispersion comprised the steps of dissolving oil-phase components at room temperature to form a homogeneous solution, blending this solution with aqueous-phase components kept at about 40° C., and dispersing the blend in a homogenizer at 10,000 rpm for 10 minutes. Water was added to the dispersion thus obtained and the resulting mixture was stirred to produce a homogeneous dispersion.

TABLE 21

| | Composition of dispersion |
|---|---|
| Oil phase | |
| Stabilizer (1) | 4.0 g |
| Sodium hydroxide | 0.3 g |
| Methanol | 62.8 g |
| Solvent having a high boiling point (2) | 0.9 g |
| Aqueous phase | |
| Decalcified gelatin (having a Ca content of 100 ppm or less) | 10.0 g |
| Antiseptic (1) | 0.04 g |
| Water | 320.5 ml |

A gelatin dispersion of zinc hydroxide was prepared according to the formulation shown in Table 22. The procedure for preparing the dispersion comprised the steps of blending/dissolving the components and then dispersing the blend for 30 minutes by means of a mill using glass beads having an average particle diameter of 0.75 mm. After the separation of the glass beads, a homogeneous dispersion was obtained (the zinc hydroxide used had a particle size of 0.25 μm).

TABLE 22

| | Composition of dispersion |
|---|---|
| Zinc hydroxide | 15.9 g |
| Carboxymethyl cellulose | 0.7 g |
| Sodium polyacrylate | 0.07 g |
| Lime-treated gelatin | 4.2 g |
| Water | 100 ml |
| Solvent having a high boiling point (2) | 0.4 g |

The preparation of a gelatin dispersion of a matting agent for use in the protective layer was carried out as follows.

A solution comprising PMMA dissolved in methylene chloride was added together with a small amount of a surfactant into gelatin and the resulting mixture was dispersed by stirring at a high speed. The methylene chloride was then removed by means of a solvent removing apparatus using a reduced pressure. In this way, a homogeneous dispersion having an average particle size of 4.3 μm was obtained.

By using the components described above, a heat developable color photosensitive material 101 shown in Tables 23–24 was prepared.

TABLE 23

Construction of color photosensitive material for heat development 101

| Layer number | Name of layer | Components | Coating weight (mg/m$^2$) |
|---|---|---|---|
| The seventh layer | Protective layer | Acid-treated gelatin | 378 |
| | | Reducing agent (2) | 70 |
| | | Solvent having a high boiling point (1) | 44 |
| | | Colloidal silver particles | 2 |
| | | Matting agent (PMMA resin) | 17 |
| | | Surfactant (1) | 19 |
| | | Surfactant (2) | 16 |
| | | Surfactant (3) | 2 |
| | | Surfactant (4) | 12 |
| | | Surfactant (6) | 17 |
| | | Dispersion polymer latex a | 14 |
| | | Calcium nitrate | 5 |
| The sixth layer | Intermediate layer | Lime-treated gelatin | 882 |
| | | Zinc hydroxide | 577 |
| | | Anti-fogging agent (4) | 18 |
| | | Reducing agent (1) | 2 |
| | | Solvent having a high boiling point (2) | 54 |
| | | Solvent having a high boiling point (5) | 6 |
| | | Surfactant (1) | 1 |
| | | Surfactant (2) | 0.5 |
| | | Surfactant (7) | 11 |
| | | Water-soluble polymer (1) | 5 |
| | | Calcium nitrate | 17 |
| The fifth layer | Photosensitive layer sensitive to 687 nm | Lime-treated gelatin | 428 |
| | | Photosensitive silver halide emulsion (1) | 287 |
| | | Magenta dye-releasable compound (2) | 487 |
| | | Solvent having a high boiling point (2) | 244 |
| | | Reducing agent (1) | 18 |
| | | Anti-fogging agent (4) | 20 |
| | | Surfactant (1) | 22 |
| | | Water-soluble polymer (1) | 11 |

TABLE 23-continued

Construction of color photosensitive material for heat development 101

| Layer number | Name of layer | Components | Coating weight (mg/m$^2$) |
|---|---|---|---|
| The fourth layer | Intermediate layer | Lime-treated gelatin | 416 |
| | | Zinc hydroxide | 271 |
| | | Anti-fogging agent (4) | 8 |
| | | Reducing agent (1) | 1 |
| | | Solvent having a high boiling point (2) | 25 |
| | | Solvent having a high boiling point (5) | 378 |
| | | Surfactant (1) | 5 |
| | | Surfactant (2) | 0.3 |
| | | Surfactant (7) | 5 |
| | | Water-soluble polymer (1) | 2 |
| | | Calcium nitrate | 8 |

TABLE 24

(Construction of color photosensitive material for heat development 101, continued from Table 23)

| | | | |
|---|---|---|---|
| The third layer | Photosensitive layer sensitive to 750 nm | Lime-treated gelatin | 404 |
| | | Photosensitive silver halide emulsion (2) | 184 |
| | | Stabilizer (1) | 8 |
| | | Cyan dye-releasable compound (3) | 428 |
| | | Dye (a) | 13 |
| | | Solvent having a high boiling point (1) | 128 |
| | | Solvent having a high boiling point (2) | 429 |
| | | Reducing agent (1) | 56 |
| | | Anti-fogging agent (3) | 5 |
| | | Surfactant (1) | 43 |
| | | Carboxymethyl cellulose | 7 |
| | | Water-soluble polymer (1) | 9 |
| The second layer | Intermediate layer | Lime-treated gelatin | 708 |
| | | Anti-fogging agent (5) | 4 |
| | | Reducing agent (1) | 2 |
| | | Surfactant (2) | 104 |
| | | Surfactant (5) | 14 |
| | | Calcium nitrate | 5 |
| The first layer | Photosensitive layer sensitive to 810 nm | Lime-treated gelatin | 569 |
| | | Photosensitive silver halide emulsion (3) | 330 |
| | | Emulsion of fine silver chloride grains | 30 |
| | | Stabilizer (1) | 8 |
| | | Yellow dye-releasable compound (1) | 119 |
| | | Yellow dye-releasable compound (2) | 285 |
| | | Sensitizing dye (3) | 0.1 |
| | | Dye (a) | 42 |
| | | Solvent having a high boiling point (1) | 59 |
| | | Solvent having a high boiling point (2) | 143 |

TABLE 24-continued (Construction of color photosensitive material for heat development 101, continued from Table 23)

| | |
|---|---|
| Surfactant (1) | 41 |
| Reducing agent (1) | 66 |
| Development accelerator (1) | 71 |
| Anti-fogging agent (3) | 6 |
| Water-soluble polymer (2) | 41 |
| Hardener (1) | 45 |

Support (paper support whose both sides are laminated with polyethylene: thickness is 135 μm)

Note: The description of the sensitizing dye, fogging agent, and the like, which are added together with the photosensitive silver halides, is omitted. Likewise, the description of small amounts of additives such as inhibitors is omitted.

Yellow dye-releasable compound (1)

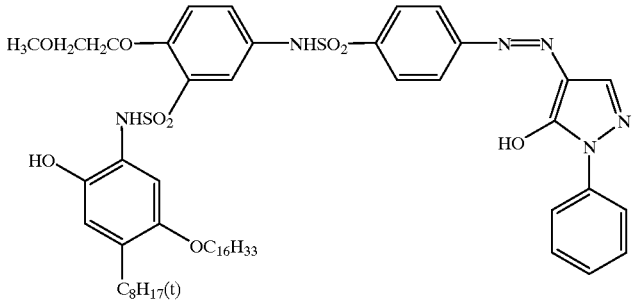

Yellow dye-releasable compound (2)

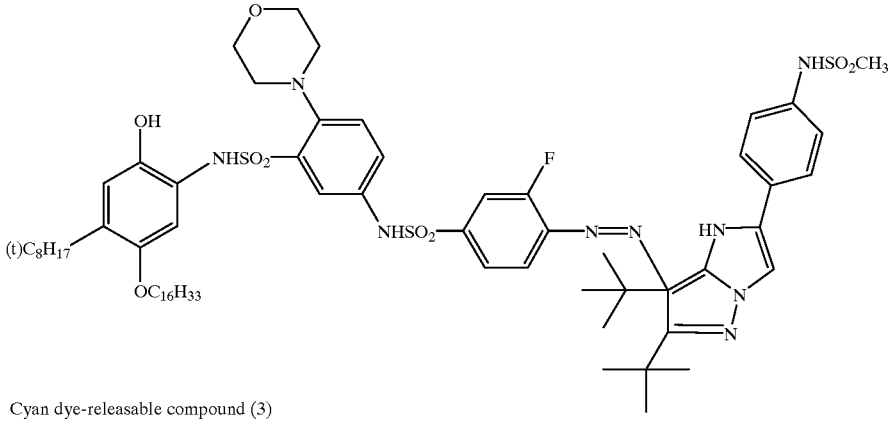

Cyan dye-releasable compound (3)

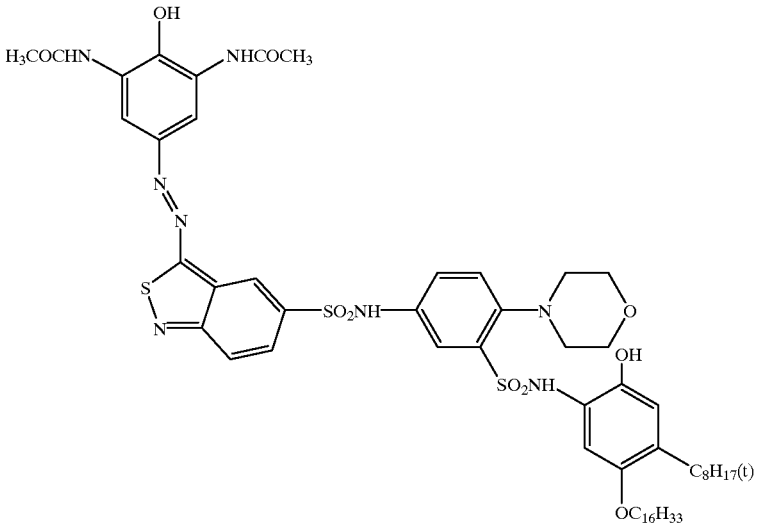

-continued
Dye (a)
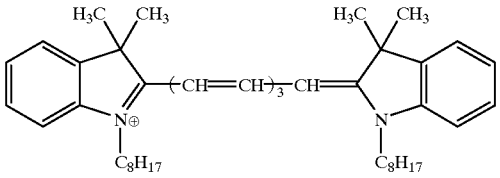
Magenta dye-releasable compound
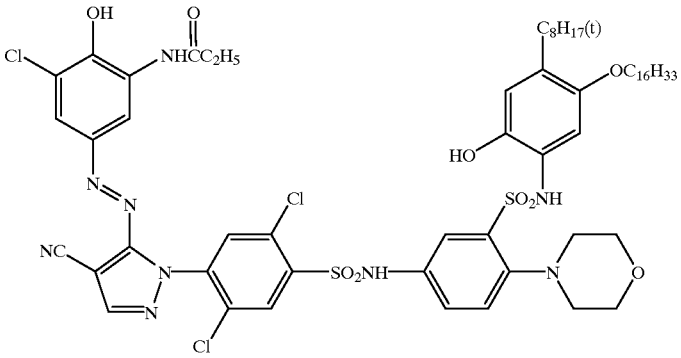
Reducing agent (1)
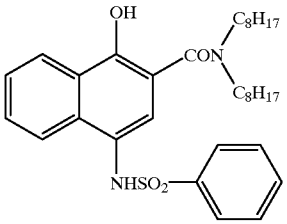
Anti-fogging agent (3)
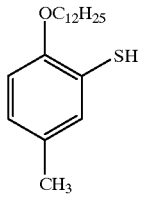
Anti-fogging agent (4)
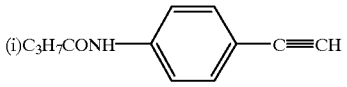
Surfactant (1)
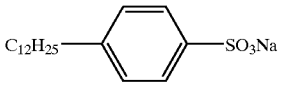
Development acelerator (1)
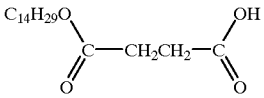
Solvent having a high boiling point (1)
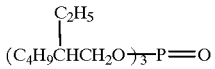
Solvent having a high boiling point (2)
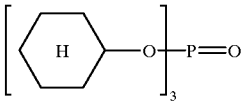
Solvent having a high boiling point (3)
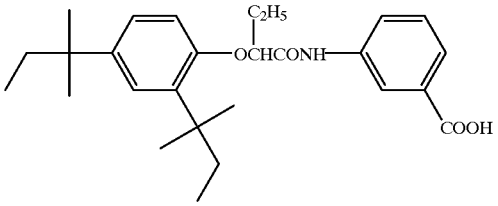
Antiseptic (1)
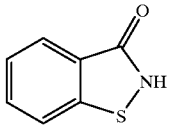
Reducing agent (2)
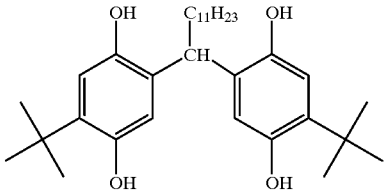

-continued
Antiseptic (4)
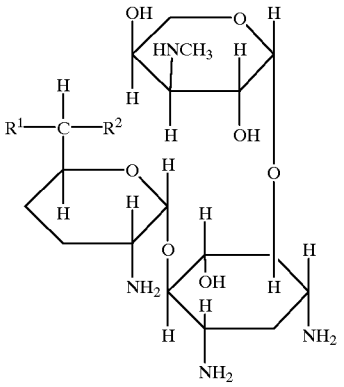
| | $R^1$ | $R^2$ |
|---|---|---|
| $C^1$ | $H_3C$— | —$NHCH_3$ |
| $C^2$ | $H_3C$— | —$NH_2$ |
| $C^{10}$ | H— | —$NH_2$ |
| $C^{20}$ | H— | —$NHCH_3$ |
Surfactant (2)
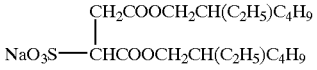
Surfactant (2)
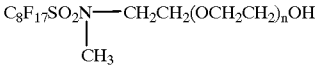
Water-soluble polymer (1)
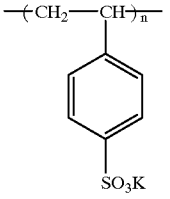
intrinsic viscosity [η] = 1.6 (0.1N NaCl, 30° C.), molecular weight: about 1,000,000
Water-soluble polymer (2)
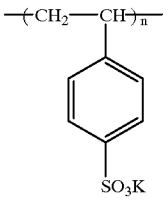
intrinsic viscosity [η] = 0.8 (0.1N NaCl, 30° C.), molecular weight: about 400,000
Anti-fogging agent (5)
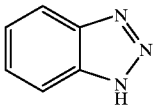
Hardener (1)
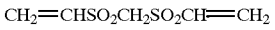
Sensitizing dye (3)
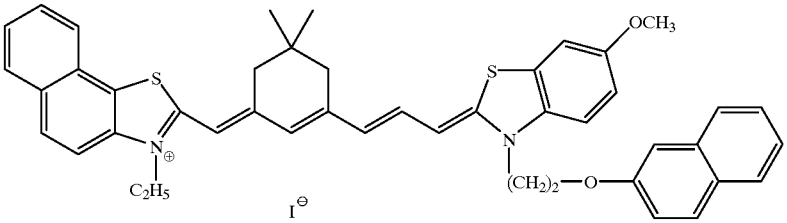

-continued

Surfactant (7)

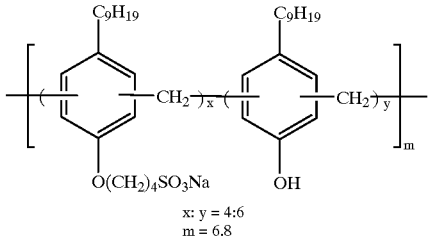

x: y = 4:6
m = 6.8

Solvent having a high boiling point (5)

$C_{28}H_{48.9}Cl_{7.1}$ (Enpara 40 manufactured by Ajinomoto Co., Inc.)

Polymer latex a

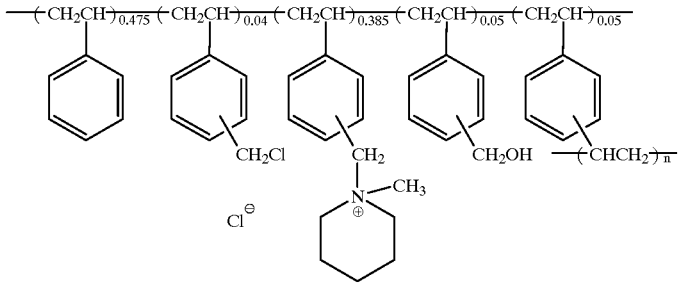

Anti-fogging agent (1)

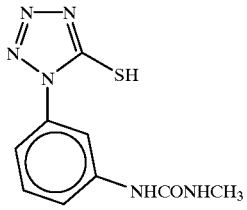

Surfactant (5)

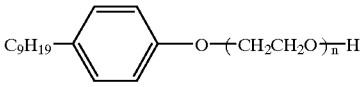

n = 20

Surfactant (4)

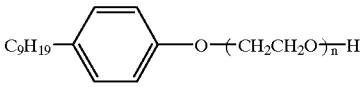

n = 50

Surfactant (6)

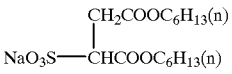

Next, color photosensitive materials for heat development 102 to 113 were prepared by replacing the dye-releasable compounds, which are to be incorporated into the fifth, third, and first layers, with the following developing agents to be incorporated and couplers in molar amounts equivalent to those of the dye-releasable compounds, respectively, as shown in Tables 25 and 26. The color photosensitive materials for heat development 103 to 113 are examples of the color photosensitive materials for heat development according to the present invention. In Tables 25 and 26, Y stands for yellow, M stands for magenta, and C stands for cyan.

Yellow coupler (Y-1)

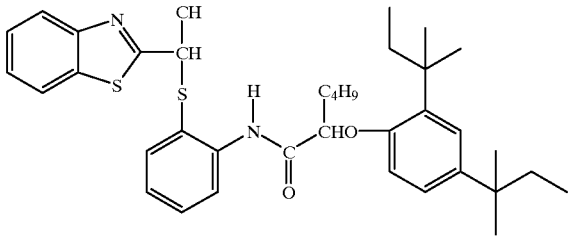

Magenta and cyan couplers (M-1, C-1)

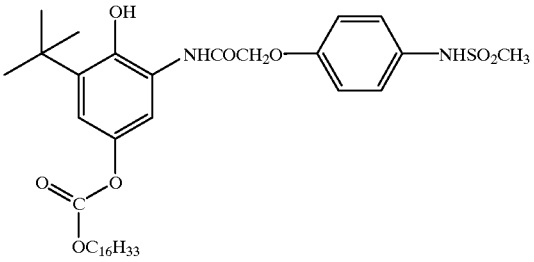

Developing agent to be incorporated (1)

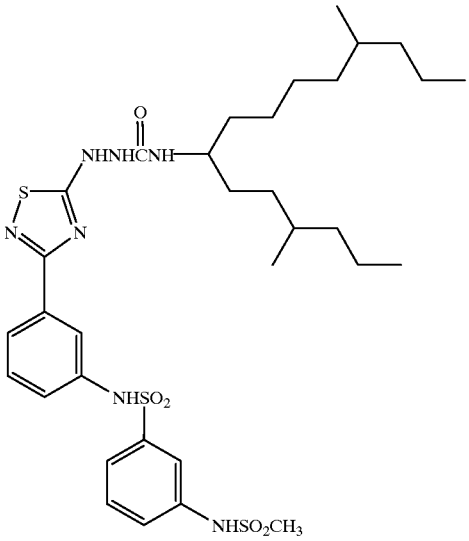

Developing agent to be incorporated (2)

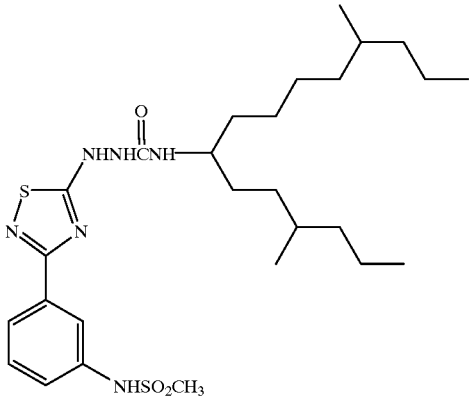

Developing agent to be incorporated (3)

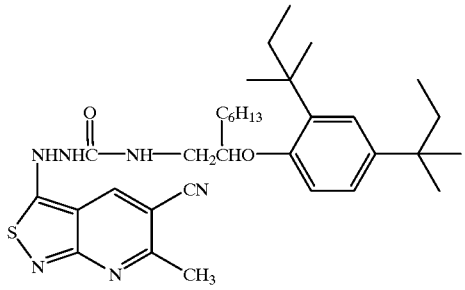

From the color photosensitive materials for heat development 101 to 113 prepared above, images were produced at 83° C. using Pictrography 4000 manufactured by Fuji Photo Film Co., Ltd. Assessments were conducted with respect to photographic characteristics and color muddiness of the images obtained. The photographic characteristics were expressed in Dmax (maximum density) at a development time of 20 seconds. The color muddiness was assessed by the density of yellow or cyan coloration at a magenta coloration density of 1.5. The results are shown in Tables 25 and 26.

TABLE 25

| | Coupler | Developing agent to be incorporated | 83° C. and 20 seconds Dmax | Color muddiness (yellow in magenta) | Color muddiness (cyan in magenta) | Remarks |
|---|---|---|---|---|---|---|
| 101 | Y: Dye-releasable compound (1)/(2) | — | 1.64 | 0.20 | 0.22 | Comparative |
| | M: Dye-releasable compound (1) | — | 1.88 | | | Example |
| | C: Dye-releasable compound (1) | — | 1.92 | | | |
| 102 | Y: Cp-67 | (1) | 1.88 | 0.66 | 0.70 | Comparative |
| | M: Cp-79 | (1) | 2.56 | | | Example |
| | C: Cp-9 | (1) | 2.61 | | | |
| 103 | Y: Y-1 | (1) | 1.82 | 0.15 | 0.16 | Example |
| | M: Cp-79 | (1) | 2.60 | | | |
| | C: C-1 | (3) | 1.88 | | | |
| 104 | Y: Cp-67 | (1) | 1.84 | 0.15 | 0.14 | Example |
| | M: M-1 | (2) | 2.62 | | | |
| | C: C-1 | (3) | 1.88 | | | |
| 105 | Y: Y-1 | (1) | 1.78 | 0.17 | 0.18 | Example |
| | M: M-1 | (2) | 2.64 | | | |
| | C: Cp-9 | (1) | 2.55 | | | |
| 106 | Y: Y-1 | (1) | 1.81 | 0.14 | 0.15 | Example |
| | M: M-1 | (2) | 2.60 | | | |
| | C: Cp-1 | (1) | 2.54 | | | |

TABLE 26

| | Coupler | Developing agent to be incorporated | 83° C. and 20 seconds Dmax | Color muddiness (yellow in magenta) | Color muddiness (cyan in magenta) | Remarks |
|---|---|---|---|---|---|---|
| 107 | Y: Y-1 | (1) | 1.78 | 0.14 | 0.13 | Example |
| | M: M-1 | (2) | 2.61 | | | |
| | C: Cp-11 | (2) | 2.58 | | | |
| 108 | Y: Y-1 | (1) | 1.77 | 0.15 | 0.16 | Example |
| | M: M-1 | (2) | 2.61 | | | |
| | C: Cp-13 | (1) | 2.58 | | | |
| 109 | Y: Y-1 | (1) | 1.81 | 0.18 | 0.18 | Example |
| | M: M-1 | (2) | 2.59 | | | |
| | C: Cp-15 | (2) | 2.60 | | | |
| 110 | Y: Y-1 | (1) | 1.77 | 0.17 | 0.17 | Example |
| | M: M-1 | (2) | 2.61 | | | |
| | C: Cp-20 | (2) | 2.55 | | | |
| 111 | Y: Y-1 | (1) | 1.78 | 0.16 | 0.15 | Example |
| | M: M-1 | (2) | 2.51 | | | |
| | C: Cp-25 | (2) | 2.59 | | | |
| 112 | Y: Y-1 | (1) | 1.81 | 0.15 | 0.14 | Example |
| | M: M-1 | (2) | 2.59 | | | |
| | C: Cp-33 | (1) | 2.60 | | | |
| 113 | Y: Y-1 | (1) | 1.81 | 0.15 | 0.12 | Example |
| | M: M-1 | (2) | 2.61 | | | |
| | C: Cp-31 | — | 2.59 | | | |

As can be seen from Tables 25 and 26, the color photosensitive materials for heat development 103 to 113 constituting the examples of the present invention exhibit good color formation even when the development time was short. In addition, the color muddiness of these color photosensitive materials for heat development was found to be slight in comparison with the color photosensitive materials for heat development 101 and 102 constituting the comparative examples.

What is claimed is:

1. A heat developable color photosensitive material, said material comprising:

a support having disposed thereon a photosensitive layer including at least two layers, any one of the layers containing a photosensitive silver halide, a binder, a metal compound having a solubility at 20° C. of 0.5 grams or less in 100 grams in water, a complex forming compound, wherein a metal ion of said metal compound is capable of reacting with said complex forming compound to generate a base, and a carbamoylhydrazine-based compound, one layer containing a substantially colorless coupler which forms a diffusive dye by coupling with the oxidized form of the carbamoylhydrazine-based compound, another layer containing a compound represented by the general formula (1), wherein the hue of the diffusive dye, which is formed by the coupling reaction between the substantially colorless compound and the oxidized form of the carbamoylhydrazine-based compound, and the hue of the diffusive dye residue, which is represented by azo dye in the general formula (1), differ from each other and the general formula (1) being as follows:

$Cp\text{-}(L)_n\text{-azo dye}$ General formula (1)

wherein Cp represents a coupler residue, L represents a bivalent linking group, n is 0 or 1, azo dye represents a diffusive azo dye residue, and $-(L)_n$-azo dye is linked to the active site of coupling.

2. A heat developable color photosensitive material according to claim 1, Cp is selected from the coupler residues represented by the following general formula (4)

General formula (4)

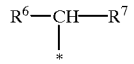

wherein $R^6$ and $R^7$ each represents independently an aryl group, a heterocyclic group, an alkoxycarbonyl group, an aryloxycarbonyl group, an acyl group, a carbamoyl group, a sulfamoyl group, a cyano group, a sulfonyl group, or a sulfinyl group, $R^6$ and $R^7$ may join together to form a 5-, 6-, or 7-membered ring, $R^6$ and $R^7$ may not be an aryl group at the same time; and -* indicates the site to which $-(L)_n$-azo dye bonds;

General formula (5)

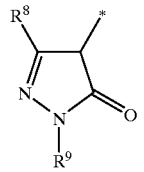

wherein $R^8$ represents a hydrogen atom or a substituent group, $R^9$ represents an alkyl group, an aryl group, or a heterocyclic group; and -* indicates the site to which $-(L)_n$-azo dye bonds;

General formula (6)

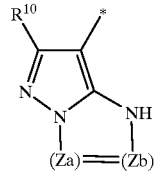

wherein $R^{10}$ represents a hydrogen atom or a substituent group; Za and Zb independently represents —N═ or —C(R11)═; R11 represents a hydrogen atom, an alkyl group, an aryl group or a heterocyclic group; and -* indicates the site to which $-(L)_n$-azo dye bonds;

General formula (7)

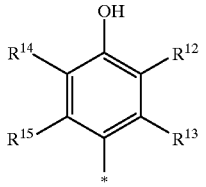

wherein $R^{12}$, $R^{13}$, $R^{14}$, and $R^{15}$ independently represents a hydrogen atom or a substituent group and $R^{14}$ and $R^{15}$ may join together to form a 5-, 6-, or 7-membered saturated ring; and -* indicates the site to which $-(L)_n$-azo dye bonds;

General formula (8)

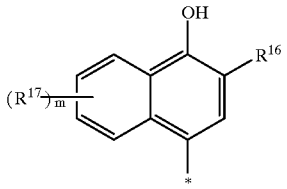

wherein $R^{16}$ represents a hydrogen atom or a substituent group; $R^{17}$ represents a substituent group; m is an integer of 0 to 4; and -* indicates the site to which $-(L)_n$-azo dye bonds;

General formula (9)

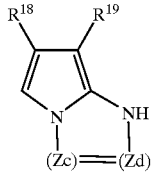

wherein $R^{18}$ and $R^{19}$ independently represents a hydrogen atom or a substituent group; Zc and Zd independently represents —N═ or ═C($R^{20}$)—; $R^{20}$ represents a hydrogen atom, an alkyl group, an aryl group, or a heterocyclic group; and -* indicates the site to which $-(L)_n$-azo dye bonds.

3. A heat developable color photosensitive material according to claim 2, wherein Cp is selected from the coupler residues represented by said general formulae (4), (6), (7) and (8).

4. A heat developable color photosensitive material according to claim 2, wherein Cp is selected from the coupler residues represented by said general formula (4).

5. A heat developable color photosensitive material according to claim 4, wherein $R^6$ and $R^7$ independently represents a heterocyclic group, an acyl group, an alkoxycarbonyl group, a carbamoyl group, or a cyano group.

6. A heat developable color photosensitive material according to claim 4, wherein $R^6$ represents a heterocyclic group; and $R^7$ represents a heterocyclic group, an acyl group, an alkoxycarbonyl group, a carbamoyl group, or a cyano group.

7. A heat developable color photosensitive material according to claim 4, wherein $R^6$ represents an acyl group; and $R^7$ represents an alkoxycarbonyl group, a carbamoyl group, an acyl group, or a cyano group.

8. A heat developable color photosensitive material according to claim 4, wherein $R^6$ represents an alkoxycarbonyl group; and $R^7$ represents an alkoxycarbonyl group, a carbamoyl group, or a cyano group.

9. A heat developable color photosensitive material according to claim 4, wherein $R^6$ represents a carbamoyl group; and $R^7$ represents a carbamoyl group or a cyano group.

10. A heat developable color photosensitive material according to claim 4, wherein $R^6$ is a cyano group and $R^7$ is a cyano group.

11. A heat developable color photosensitive material according to claim 1, wherein L represents a bivalent group selected from the bivalent groups consisting of —OC(═O)— and the groups represented by the following general formula (T-1) to (T-3):

*-W-($Y^1$=$Y^2$)$_j$-C($R^{21}$) ($R^{22}$)-** General formula (T-1)

*-W-CO-** General formula (T-2)

*-W-LINK-E-** General formula (T-3)

wherein, in general formulae (T-1) to (T-3), * indicates the site to which the active site for coupling of the coupler bonds, ** indicates the site to which -azo dye of the general formula (1) bonds and W represents an oxygen atom, a sulfur atom, or —N(|)—$R^{23}$; and wherein in general formula (T-1), $Y^1$ and $Y^2$ independently represents a substituted or unsubstituted methylene group or a nitrogen atom, when $Y^1$ and $Y^2$ each represents a substituted methylene group, any of the two substituent groups selected from the substituents groups thereof, $R^{21}$, $R^{22}$, and $R^{23}$, when W represents N-$R^{23}$, may join together to form a ring structure, $R^{21}$ and $R^{22}$ each represents independently a hydrogen atom, an alkyl group, an aryl group or a heterocyclic group, $R^{23}$ represents an alkyl group, an aryl group, an acyl group, or a sulfonyl group, and j is 0, 1, or 2; in the general formula (T-3), E represents an electrophilic group, LINK represents a linking group which creates a steric relationship enabling W and E to carry out an intramolecular nucleophilic substitution reaction.

12. A heat developable color photosensitive material, said material comprising:

a support having disposed thereon a photosensitive layer sensitive to the light of a first wavelength region λ1 and a second photosensitive layer sensitive to light of a second wavelength region λ2, wherein the first photosensitive layer contains a photosensitive silver halide sensitive to the light of the region λ1, a binder, a metal compound having a solubility at 20° C. of 0.5 grams or less in 100 grams in water, a complex forming compound, wherein a metal ion of said metal compound is capable of reacting with said complex forming compound to generate a base, a carbamoylhydrazine-based compound, and a substantially colorless coupler which forms a diffusive dye by coupling one layer containing a substantially colorless coupler which forms a diffusive dye by coupling with the oxidized form of the carbamoylhydrazine-based compound, and wherein the second photosensitive layer contains a photosensitive silver halide sensitive to light of the region λ2, a binder, a metal compound having a solubility at 20° C. of 0.5 grams or less in 100 grams in water, a complex forming compound, wherein a metal ion of said metal compound is capable of reacting with said complex forming compound to generate a base, a carbamoylhydrazine-based compound, and a compound represented by the following general formula (1), wherein λ1 is not equal to λ2, wherein the hue of the diffusive dye, which is formed by the coupling reaction between the substantially colorless compound and the oxidized form of the carbamoylhydrazine-based compound, and the hue of the diffusive dye residue, which is represented by azo dye in the general formula (1), differ from each other and the general formula (1) being as follows:

$Cp\text{-}(L)_n\text{-azo dye}$ General formula (1)

wherein Cp represents a coupler residue, L represents a bivalent linking group, n is 0 or 1, azo dye represents a diffusive azo dye residue, and $-(L)_n$-azo dye is linked to the active site of coupling.

13. A heat developable color photosensitive material according to claim 12, Cp is selected from the coupler residues represented by the following general formula (4)

General formula (4)

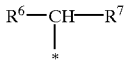

wherein $R^6$ and $R^7$ each represents independently an aryl group, a heterocyclic group, an alkoxycarbonyl group, an aryloxycarbonyl group, an acyl group, a carbamoyl group, a sulfamoyl group, a cyano group, a sulfonyl group, or a sulfinyl group, $R^6$ and $R^7$ may join together to form a 5-, 6-, or 7-membered ring, $R^6$ and $R^7$ may not be an aryl group at the same time; and -* indicates the site to which $-(L)_n$-azo dye bonds;

General formula (5)

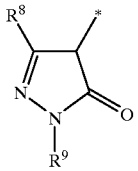

wherein $R^8$ represents a hydrogen atom or a substituent group, $R^9$ represents an alkyl group, an aryl group, or a heterocyclic group; and * indicates the site to which $-(L)_n$-azo dye bonds;

General formula (6)

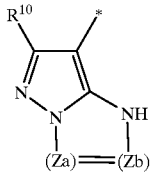

wherein $R^{10}$ represents a hydrogen atom or a substituent group; Za and Zb independently represents —N═ or —C(R11)═; R11 represents a hydrogen atom, an alkyl group, an aryl group or a heterocyclic group; and -* indicates the site to which $-(L)_n$-azo dye bonds;

General formula (7)

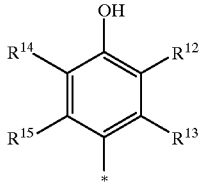

wherein $R^{12}$, $R^{13}$, $R^{14}$, and $R^{15}$ independently represents a hydrogen atom or a substituent group and $R^{14}$ and $R^{15}$ may join together to form a 5-, 6-, or 7-membered saturated ring; and -* indicates the site to which $-(L)_n$-azo dye bonds;

General formula (8)

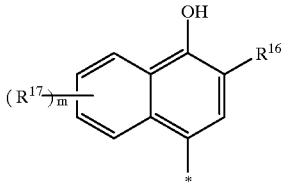

wherein $R^{16}$ represents a hydrogen atom or a substituent group; $R^{17}$ represents a substituent group; m is an integer of 0 to 4; and -* indicates the site to which $-(L)_n$-Dye bonds;

General formula (9)

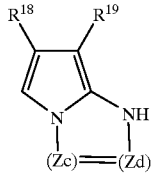

wherein $R^{18}$ and $R^{19}$ independently represents a hydrogen atom or a substituent group; Zc and Zd independently represents —N═ or ═C($R^{20}$)—; $R^{20}$ represents a hydrogen atom, an alkyl group, an aryl group, or a heterocyclic group; and -* indicates the site to which $-(L)_n$-azo dye bonds.

14. A heat developable color photosensitive material according to claim 12, wherein Cp is selected from the coupler residues represented by said general formulae (4), (6), (7) and (8).

15. A heat developable color photosensitive material according to claim 12, wherein Cp is selected from the coupler residues represented by said general formula (4).

16. A heat developable color photosensitive material according to claim 12, wherein L represents a bivalent group selected from the bivalent groups consisting of —OC(═O)— and the groups represented by the following general formula (T-1) to (T-3):

$*\text{-W-}(Y^1{=}Y^2)_f\text{-C}(R^{21})(R^{22})\text{-}^{**}$ General formula (T-1)

*-W-CO-** General formula (T-2)

*-W-LINK-E-** General formula (T-3)

wherein, in general formulae (T-1) to (T-3), * indicates the site to which the active site for coupling of the coupler bonds, ** indicates the site to which -azo dye of the general formula (1) bonds and W represents an oxygen atom, a sulfur atom, or

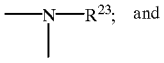

wherein in general formula (T-1), $Y^1$ and $Y^2$ independently represents a substituted or unsubstituted methylene group or a nitrogen atom, when $Y^1$ and $Y^2$ each represents a substituted methylene group, any of the two substituent groups selected from the substituents groups thereof, $R^{21}$, $R^{22}$, and $R^{23}$, when W represents N-$R^{23}$ may join together to form a ring structure, $R^{21}$ and $R^{22}$ each represents independently a hydrogen atom, an alkyl group, an aryl group or a heterocyclic group, $R^{23}$ represents an alkyl group, an aryl group, an acyl group, or a sulfonyl group, and j is 0, 1, or 2; in the general formula (T-3), E represents an electrophilic group, LINK represents a linking group which creates a steric relationship enabling W and E to carry out an intramolecular nucleophilic substitution reaction.

* * * * *